US011821282B2

(12) United States Patent
Wood et al.

(10) Patent No.: US 11,821,282 B2
(45) Date of Patent: Nov. 21, 2023

(54) WELLBORE COMPLETION APPARATUS

(71) Applicant: 8Sigma Energy Services Incorporated, Calgary (CA)

(72) Inventors: Blake Wood, Calgary (CA); Nigel Dabreo, Calgary (CA)

(73) Assignee: 8Sigma Energy Services Incorporated, Calgary (CA)

( * ) Notice: Subject to any disclaimer, the term of this patent is extended or adjusted under 35 U.S.C. 154(b) by 131 days.

(21) Appl. No.: 17/324,983

(22) Filed: May 19, 2021

(65) Prior Publication Data

US 2021/0363855 A1 Nov. 25, 2021

Related U.S. Application Data

(60) Provisional application No. 63/092,963, filed on Oct. 16, 2020, provisional application No. 63/027,168, filed on May 19, 2020.

(51) Int. Cl.

| | |
|---|---|
| ***E21B 33/129*** | (2006.01) |
| ***E21B 33/12*** | (2006.01) |
| *E21B 34/14* | (2006.01) |

(52) U.S. Cl.

CPC ..... *E21B 33/1292* (2013.01); *E21B 33/1208* (2013.01); *E21B 34/142* (2020.05)

(58) Field of Classification Search

CPC ..... E21B 33/1291; E21B 33/1292; E21B 33/1293; E21B 33/1208; E21B 34/142; E21B 34/14; E21B 23/04

See application file for complete search history.

(56) References Cited

U.S. PATENT DOCUMENTS

| | | | | |
|---|---|---|---|---|
| 3,819,850 | A | 6/1974 | Perry et al. | |
| 4,098,334 | A | 7/1978 | Crowe | |
| 9,534,471 | B2 | 1/2017 | Etzel | |
| 2007/0221384 | A1 | 9/2007 | Murray | |
| 2015/0167428 | A1 | 6/2015 | Hofman et al. | |
| 2019/0153816 | A1 | 5/2019 | Campbell | |
| 2019/0323316 | A1 * | 10/2019 | Brown | E21B 33/128 |

(Continued)

FOREIGN PATENT DOCUMENTS

WO 2016028154 A1 2/2016

OTHER PUBLICATIONS

USPTO Non-Final Office Action issued in U.S. Appl. No. 16/866,120, dated Jan. 31, 2023.

(Continued)

*Primary Examiner* — Kristyn A Hall
(74) *Attorney, Agent, or Firm* — Ridout & Maybee LLP

(57) ABSTRACT

A wellbore completion apparatus includes an engager having an engageable surface configured for becoming engaged to a surface of the wellbore is disclosed. The apparatus is configurable in an engagement-ready state and an engagement state. Actuation of the apparatus such that it transitions from the engagement-ready state to the engagement state is with effect that the engageable surface becomes engaged to the wellbore surface. In the engagement-ready state, the engager can include a first free end and a second free end, and the transitioning to the engagement steady is effected in response to relative displacement between the first and second free ends. In the engagement state, the engager can be configured in a loop configuration.

28 Claims, 50 Drawing Sheets

(56) References Cited

U.S. PATENT DOCUMENTS

| | | | |
|---|---|---|---|
| 2019/0352998 | A1 | 11/2019 | Wolf et al. |
| 2020/0347693 | A1 | 11/2020 | Wood et al. |

OTHER PUBLICATIONS

USPTO Final Office Action issued in U.S. Appl. No. 16/866,120, dated May 27, 2022.
USPTO Non-Final Office Action issued in U.S. Appl. No. 16/866,120, dated Oct. 5, 2021.

* cited by examiner

WELLBORE COMPLETION APPARATUS

CROSS-REFERENCE TO RELATED APPLICATIONS

This application claims priority to U.S. Provisional Patent Application No. 63/027,168, filed on May 19, 2020 under the title "WELLBORE COMPLETION APPARATUS", the contents of which are hereby expressly incorporated by reference into the present application, and also claims priority to U.S. Provisional Patent Application No. 63/092,963, filed on Oct. 16, 2020 under the title "WELLBORE COMPLETION APPARATUS", the contents of which are hereby expressly incorporated by reference into the present application.

FIELD

The present disclosure relates to a wellbore completion apparatus configured for deployment into a wellbore via a conveyance apparatus, such as a workstring, e-line, or wireline. In some aspects, the present disclosure relates to a wellbore completion apparatus, configured for deployment into a wellbore and for becoming engaged to a surface within the wellbore for effecting zonal isolation with the wellbore.

BACKGROUND

In hydraulic fracturing operations, rock is fractured by a pressurized liquid as a means of stimulating the subterranean formation. The process involves the high-pressure injection of a fracking fluid into a wellbore to create cracks in the formations through which a reservoir fluid will flow more freely. In order to effect fluid communication between a wellbore that has been drilled into the formation ports or perforations are formed within the wellbore casing.

Fracturing operations and other wellbore operations often involve the deployment of a wellbore completion apparatus or other device within the wellbore for becoming engaged within the wellbore. Some devices require corresponding features or cooperating surfaces disposed within the wellbore for becoming engaged to the wellbore. Some devices have complex structures and actuation mechanisms in order to effect engagement of the device within the wellbore which often adds to the overall costs of the device and the overall costs associated with the wellbore operations. Traditional devices may also require lengthy removal processes, for example mill-out of drilling out of the devices in order to achieve the desired production diameter for the wellbore so as to achieve more optimal operating conditions.

Hydraulic fracturing operations often take place in stages wherein one zone or region of the formation is stimulated, via injection of a pressurized fluid, at a time. In order to effect zonal isolation within the wellbore, a wellbore completion apparatus, such as frac plugs, are often used to create a seal within the wellbore between an uphole and downhole region of the wellbore. Once the seal has been effected by the frac plug, a perforating tool is deployed within the wellbore to a location uphole of the frac plug, which tool is activated for perforating the casing to establish fluid communication between the formation and the wellbore. Pressurized fluid is the injected into the formation, through the perforations to stimulate the reservoir. Once a zone has been stimulated, another frac plug is deployed downhole in proximity to the next region of the formation to be stimulated, which is uphole from the location of the previous frac plug, and the process continues.

Once the all of the zones associated with the formation have been stimulated, removal of the frac plugs is required in order to achieve optimal operating conditions. Accordingly, in some instances, frac plugs are made of dissolvable material, which dissolves over time. The material required to make dissolvable frac plugs, however, is expensive and adds to the overall cost of the frac plugs and the overall operating costs of the well. In other instances, the frac plugs that are set within the wellbore must be milled or drilled out in order to achieve the desired production diameter for the wellbore so as to achieve more optimal operating conditions. Milling and/or drilling operations can be lengthy and time consuming due to the overall size of the frac plugs and the amount of material the must be milled or drilled out before production can begin. Lengthy milling and/or drilling operations also add to the overall operating costs of the well as full production cannot begin until the frac plugs are removed.

Accordingly, a wellbore completion apparatus that, in some instances, may be used as a frac plug, which has reduced manufacturing costs relative to traditional frac plugs is desirable. Additionally, in some instances, a wellbore completion apparatus or device having a simplified engagement structure and installation process may also be desirable. A wellbore completion apparatus that, in some instances, may offer more cost effective removal processes may also be desirable.

SUMMARY

In one aspect of the present disclosure there is provided a wellbore completion apparatus configured for deployment through a passage defined within a wellbore, comprising: an engager; wherein: the apparatus is configurable in at least an engagement-ready state and an engagement state. In the engagement-ready state: the engager includes a first free end and a second free end; the first free end is displaceable relative to the second free end. In the engagement state: the engager defines an engageable surface-defining loop; and the engageable surface-defining loop defines an engageable surface for engaging a wellbore surface of the wellbore; and the apparatus is transitionable from the engagement-ready state to the engagement state in response to relative displacement between the first free end and the second free end.

In another aspect of the present disclosure there is provided a wellbore completion apparatus configured for deployment through a passage defined within a wellbore, comprising: an engager including an engageable surface; wherein: the apparatus is configurable in at least an engagement-ready state and an engagement state. In the engagement-ready state: the engager includes a first free end and a second free end; and the first free end is displaceable relative to the second free end; the apparatus is transitionable from the engagement-ready state to the engagement state in response to relative displacement between the first free end and the second free end; and in response to the transitioning, at least a portion of the engageable surface becomes displaced outwardly relative to the central axis of the apparatus.

In another aspect of the present disclosure there is provided a wellbore completion apparatus configured for deployment through a passage defined within a wellbore, comprising: an engager defining an engageable surface for engaging a wellbore surface of the wellbore; wherein: the apparatus is configurable in at least an engagement-ready state and an engagement state. In the engagement-ready state: the engager includes a first free end and a second free end; the first free end is displaceable relative to the second free end; and an outermost surface of the engageable surface is spaced apart from the central axis of the apparatus by a minimum distance D1. The apparatus is transitionable from the engagement-ready state to the engagement state in response to relative displacement between the first free end and the second free end. In the engagement state: an outermost surface of the engageable surface is spaced apart from the central axis of the apparatus by a minimum distance D2; and the minimum distance D2 is greater than the minimum distance D1.

In another aspect of the present disclosure, there is provided a wellbore completion apparatus for disposition within a passage defined within a wellbore, comprising: an engager defining an engageable surface for engaging a wellbore surface of the wellbore, the engageable surface and the wellbore surface are co-operatively configured such that the engagement includes a sealing engagement of the engageable surface to the wellbore surface; wherein: the apparatus is configurable in at least an engagement-ready state and an engagement state. In the engagement-ready state: the engager includes a first free end and a second free end; the first free end is displaceable relative to the second free end; and while the apparatus is disposed within the wellbore, the engageable surface is spaced apart from the wellbore surface. In the engagement state: a seat is defined and co-operatively configured with a wellbore obstruction device with effect that seating of the wellbore obstruction device on the seat effects occluding of a flow communicator defined by the apparatus; and while the apparatus is disposed within the wellbore, and the wellbore obstruction device is seated on the seat, the engageable surface is engaged to the wellbore surface such that the sealing engagement of the engageable surface to the wellbore surface is established and the occluding of the flow communicator is established, and the sealing engagement and the occluding are co-operating with effect that flow communication, across the apparatus, is sealed; and the apparatus is transitionable from the engagement-ready state to the engagement state in response to relative displacement between the first free end and the second free end.

In another aspect of the present disclosure there is provided a wellbore completion apparatus configured for deployment through a passage defined within a wellbore, comprising: an engager defining an engageable surface for engaging a wellbore surface of the wellbore; wherein: the apparatus is configurable in at least an engagement-ready state and an engagement state. In the engagement-ready state: the engager is disposed in a helical configuration or a spiral configuration; and an outermost surface of the engageable surface is spaced apart from the central axis of the apparatus by a minimum distance D1. In the engagement state: an outermost surface of the engageable surface is spaced apart from the central axis of the apparatus by a minimum distance D2; and the minimum distance D2 is greater than the minimum distance D1.

In another aspect of the present disclosure there is provided a wellbore completion apparatus configured for deployment through a passage defined within a wellbore, comprising: an engager defining an engageable surface for engaging a wellbore surface of the wellbore; wherein: the apparatus is configurable in at least an engagement-ready state and an engagement state. In the engagement-ready state, the engager is disposed in a helical configuration or a spiral configuration; and the apparatus is transitionable from the engagement-ready state to the engagement state in response to outwardly displacement, relative to the central axis of the apparatus, of at least a portion of the engageable surface.

In another aspect of the present disclosure there is provided a wellbore completion apparatus for disposition within a passage defined within a wellbore, comprising: an engager defining an engageable surface for engaging a wellbore surface of the wellbore, the engageable surface and the wellbore surface are co-operatively configured such that the engagement includes a sealing engagement of the engageable surface to the wellbore surface; wherein: the apparatus is configurable in at least an engagement-ready state and an engagement state; the apparatus is transitionable from the engagement-ready state to the engagement state in response to outward displacement, relative to the central axis of the apparatus, of at least a portion of the engageable surface. In the engagement-ready state: the engager is disposed in a helical configuration or a spiral configuration; and while the apparatus is disposed within the wellbore, the engageable surface is spaced apart from the wellbore surface; and in the engagement state: a seat is defined and co-operatively configured with a wellbore obstruction device with effect that seating of the wellbore obstruction device on the seat effects occluding of a flow communicator defined by the apparatus; and while the apparatus is disposed within the wellbore, and the wellbore obstruction device is seated on the seat, the engageable surface is engaged to the wellbore surface such that the sealing engagement of the engageable surface to the wellbore surface is established and the occluding of the flow communicator is established, and the sealing engagement and the occluding are co-operating with effect that flow communication, across the apparatus, is sealed.

In another aspect of the present disclosure there is provided A wellbore completion apparatus configured for deployment through a passage defined by a passage-defining conductor surface of a passage-defining conductor emplaceable within a wellbore, the passage-defining conductor surface including a wellbore surface portion-defined loop, comprising: an engager defining an engageable surface co-operatively configured with the passage-defining conductor for engaging the entirety of the wellbore surface portion-defined loop of the passage-defining conductor surface; wherein: the apparatus is configurable in an engagement-ready state and an engagement state. In the engagement-ready state: the engager includes a first free end and a second free end; the first free end is displaceable relative to the second free end; and while the apparatus is disposed within the wellbore, there is an absence of engagement of the engageable surface to the entirety of the wellbore surface portion-defined loop. In the engagement state; while the apparatus is disposed within the wellbore, the engagement of the engageable surface to the entirety of the wellbore surface portion-defined loop is established; and the apparatus is transitionable from the engagement-ready state to the engagement state in response to relative displacement between the first free end and the second free end.

In another aspect of the present disclosure there is provided a wellbore completion apparatus configured for deployment through a passage defined within a wellbore, comprising: an engager including an engageable surface for engaging a wellbore surface of the wellbore; wherein: the engageable surface is defined by metallic material; the engagement with the wellbore surface, for which the engageable surface is configured, includes: (i) a sealing engagement, and (ii) a gripping engagement; the apparatus is transitionable from an engagement-ready state to an engagement state. In the engagement-ready state: an outermost surface of the engageable surface is spaced apart from the central axis of the apparatus by a minimum distance D1. In the engagement state: an outermost surface of the engageable surface is spaced apart from the central axis of the apparatus by a minimum distance D2; the minimum distance D2 is greater than the minimum distance D1; and the apparatus is co-operatively configured with the wellbore surface such that, while the apparatus is disposed in the engagement state within the wellbore, engagement of the engageable surface to the wellbore surface is established with effect that: (i) the engageable surface is sealingly engaged to the wellbore surface; and (ii) displacement of the apparatus, relative to the wellbore surface, in a direction that is perpendicular to an axis that is normal to the engageable surface, is resisted.

In another aspect of the present disclosure there is provided a wellbore completion apparatus configured for deployment into a wellbore, comprising: an engager including an engageable surface for engaging a wellbore surface of the wellbore; wherein: the engageable surface is defined by metallic material; the engagement with the wellbore surface, for which the engageable surface is configured includes: (i) a sealing engagement, and (ii) a gripping engagement; the apparatus is transitionable from an engagement-ready state to an engagement state in response to outwardly displacement, relative to the central axis of the apparatus, of at least a portion of the engageable surface; and the apparatus is co-operatively configured with the wellbore surface such that, while the apparatus is disposed in the engagement state within the wellbore, engagement of the engageable surface to the wellbore surface is established with effect that: (i) sealing engagement between the engageable surface and the wellbore surface is established; and (ii) displacement of the apparatus, relative to the wellbore surface, in a direction that is perpendicular to an axis that is normal to the engageable surface, is resisted.

BRIEF DESCRIPTION OF THE DRAWINGS

Reference will now be made, by way of example, to the accompanying drawings which show example embodiments of the present application, and in which:

FIG. 7AA is a schematic illustration of another example embodiment of a wellbore completion apparatus according to the present disclosure in an engagement-ready state in a spiral configuration;

FIG. 7AB is a schematic illustration of a top view of the wellbore completion apparatus of FIG. 7AA;

FIG. 10AA is a schematic illustration of the wellbore completion apparatus of FIG. 10 in the engagement state;

FIG. 32 is a front view of a wellbore completion apparatus according to another example embodiment of the present disclosure disposed in an engagement-ready state;

FIG. 37AA is a cross-sectional view of the wellbore completion apparatus of FIG. 37 with a wellbore obstruction device seated within the wellbore completion apparatus as shown in FIG. 37A, with an alternate embodiment of the engager;

FIG. 37AB is a cross-sectional view (similar to FIG. 36A) of the alternate embodiment of the engager of the wellbore completion apparatus shown in FIG. 37AA;

Similar reference numerals may have been used in different figures to denote similar components.

DESCRIPTION OF EXAMPLE EMBODIMENTS

As used herein, the terms "up", "upward" or "uphole", etc. mean relativistically in closer proximity to the surface and further away from the bottom of the wellbore, when measured along the longitudinal axis of the wellbore. The terms "down", "downward", "lower", or "downhole" mean relativistically, further away from the surface and in closer proximity to the bottom of the wellbore, when measured along the longitudinal axis of the wellbore.

Figure 34:
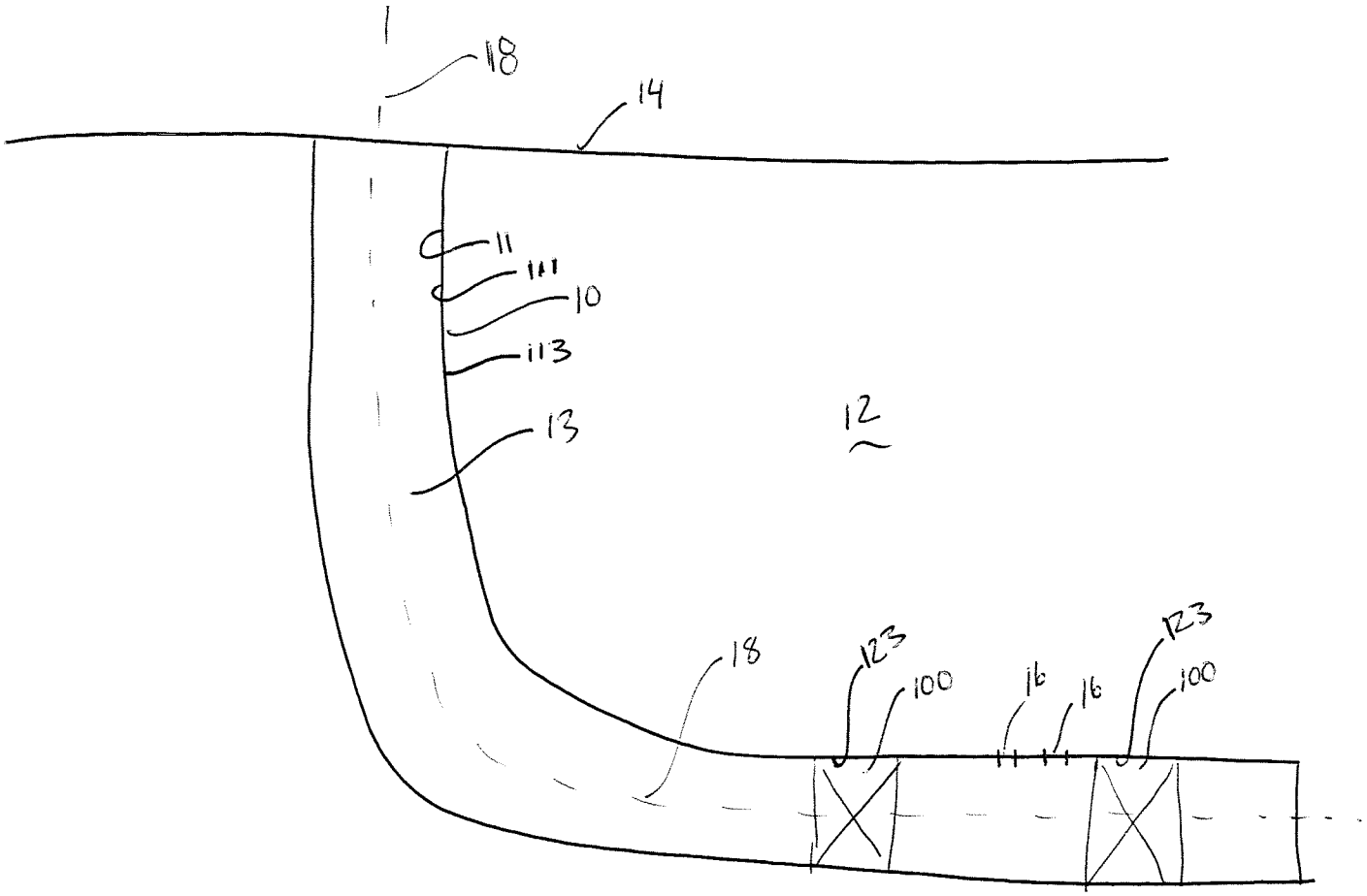
FIG. 34 is a schematic illustration of a system for effecting zonal isolation between the surface and a subterranean formation via a wellbore.

Referring to FIG. 34, there is shown a schematic illustration of a wellbore completion apparatus 100 that is deployable within a wellbore 10 for effecting zonal isolation within the wellbore 10 such that selective stimulation of a particular zone of a subterranean formation 12, such as a reservoir, can be effected. Suitable wellbores 10 include vertical, horizontal, deviated or multi-lateral wells. The stimulation is effected by supplying pressurized fluid (e.g. frac fluid), from the surface 14, via the wellbore 10, to the formation 12, the pressurized fluid being communicated or delivered to a zone of the formation 12. In this respect, a passage 13 is defined within the wellbore 10 which effects flow communication between the surface 14 and the subterranean formation 12.

In some wellbore operations, a wellbore completion apparatus 100 is deployed within the wellbore 10, via a conveyance apparatus. Accordingly, in some embodiments, the wellbore completion apparatus 100 is configured for engagement with a conveyance apparatus such that the wellbore completion apparatus 100 is configured for deployment into a wellbore 10, via the conveyance apparatus. In some embodiments, for example, a suitable conveyance apparatus includes a workstring, e-line, and wireline.

Referring now to FIGS. 1-33, 35-39, and 41-48 there are shown schematic illustrations of a wellbore completion apparatus 100 according to example embodiments of the present disclosure. In some embodiments, for example, the wellbore completion apparatus 100 is configured for effecting zonal isolation within the wellbore 10. Accordingly, in some embodiments, the wellbore completion apparatus 100 is deployable through the passage 13 defined within the wellbore 10. In some embodiments, for example, the wellbore completion apparatus 100 is deployable through the passage 13 via the conveyance apparatus. The wellbore 10 has a central longitudinal axis 18.

In some embodiments, for example, the wellbore completion apparatus 100 is deployable through the passage 13 of a wellbore 10 that is defined by a passage-defining conductor surface 111 of a passage-defining conductor 113. In some embodiments, for example, the passage-defining conductor surface 111 of the passage-defining conductor 113 is the interface between the subterranean formation 12 and the passage 13 (e.g. an open hole completion). In some embodiments, for example, the passage-defining conductor 113 is a wellbore string 11, such as, for example, casing or tubing. In some embodiments, for example, the wellbore completion apparatus 100 is configured for deployment within casing or tubing sizes ranging from 2.375 inches to 9.575 inches.

In those embodiments where the passage-defining conductor 113 is a wellbore string such as casing 11, in some of these embodiments, for example, flow communication between the surface 14 and a desired zone of the subterranean formation 12 is effected via a flow communicator 16. In some embodiments, the flow communicator 16 is in the form of perforations within the wellbore string that are established, such as, for example, with a perforating gun. In some embodiments, for example, the flow communicator 16 is in the form of one or more ports that are selectively openable with a sliding sleeve.

The wellbore completion apparatus 100 is deployable through the passage 13 defined by the wellbore 10 via the conveyance apparatus. In some embodiments, for example, the conveyance apparatus includes a setting tool. Accordingly, in some embodiments, for example, while the wellbore completion apparatus 100 is being deployed through the passage 13, the wellbore completion apparatus 100 is releasably secured to the setting tool of the conveyance apparatus such that the wellbore completion apparatus 100 is releasably retained by the setting tool as the wellbore completion apparatus 100 is deployed through the passage 13. In some embodiments, for example, the wellbore completion apparatus 100 is releasably secured to the setting tool via a setting tool adapter (not shown).

In some embodiments, for example, the setting tool is configured for transmitting an actuation force to the wellbore completion apparatus 100. Accordingly, the wellbore completion apparatus 100 is releasably secured to the setting tool such that once the wellbore completion apparatus 100 is deployed to a desired location within the passage 13, via the conveyance apparatus, the wellbore completion apparatus 100 and the setting tool are cooperatively configured such that actuation of the setting tool is with effect that an actuation force is transmitted to the wellbore completion apparatus 100, via the setting tool. Transmission of the actuation force to the wellbore completion apparatus 100, via the setting tool, is with effect that the wellbore completion apparatus 100 becomes disposed in an engagement state. In some embodiments, for example, as the wellbore completion apparatus 100 becomes disposed in the engagement state 28, in response to application of the actuation force via the setting tool, the wellbore completion apparatus 100 becomes engaged to the passage-defining conductor surface 111 and is released from retention by the setting tool such that the setting tool can be retracted from within the passage 13, via the conveyance apparatus, while the wellbore completion apparatus 100 remains disposed in engagement with the passage-defining conductor surface 111. Exemplary embodiments of the setting tool include a Baker E4 No. 10 Setting Tool™ and a Baker E4 No. 20 Setting Tool™. In some embodiments, for example, the wellbore completion apparatus 100 includes an engager 20. The engager 20 defines an engageable surface 22 for engaging a wellbore surface of the wellbore 10 with the engageable surface 22. In this respect, while the apparatus is disposed in the engagement state, the engageable surface 22 is engaged to the passage-defining conductor surface 111. In some embodiments, for example, in addition to the engageable surface 22 of the engager 20 becoming engaged to the passage-defining conductor surface 111 in response to the transmission of the actuation force to the apparatus 100, via the setting tool, the apparatus 100 becomes released from retention by the setting tool such that the apparatus 100 remains disposed in engagement with the passage-defining conductor surface 111 once the setting tool is retracted or removed from the passage 13 via the conveyance apparatus.

Figure 1:
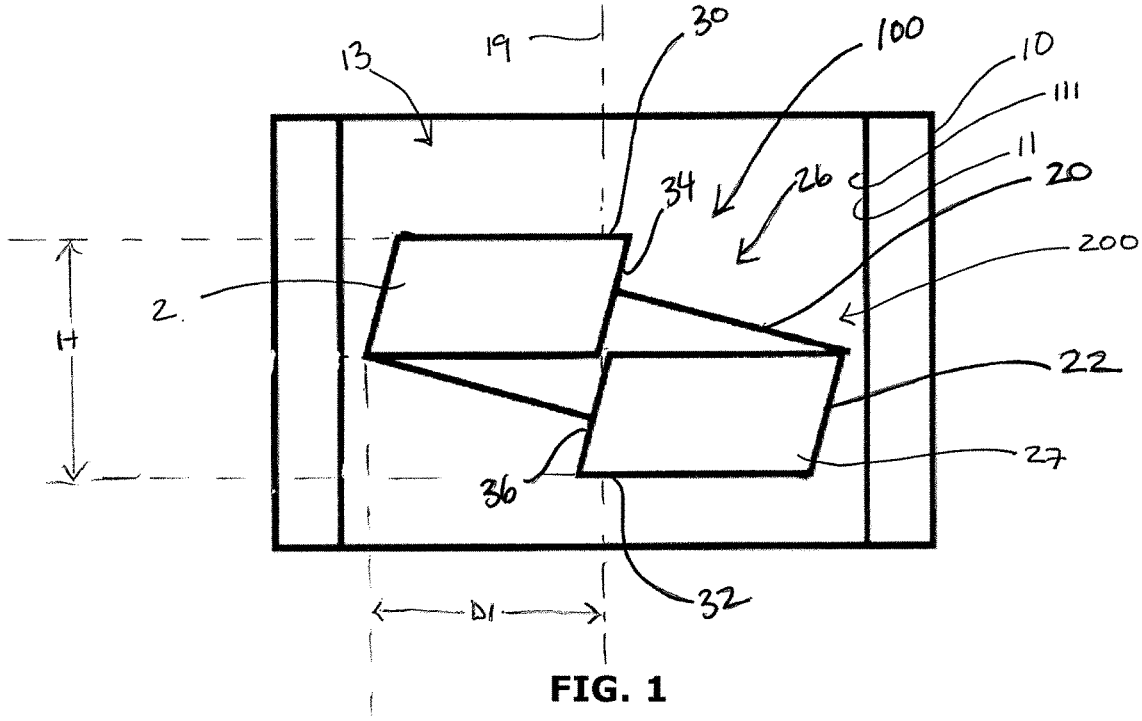
FIG. 1 is a schematic illustration of a wellbore completion apparatus according to an example embodiment of the present disclosure deployed within a wellbore in an engagement-ready state.
Figure 2:
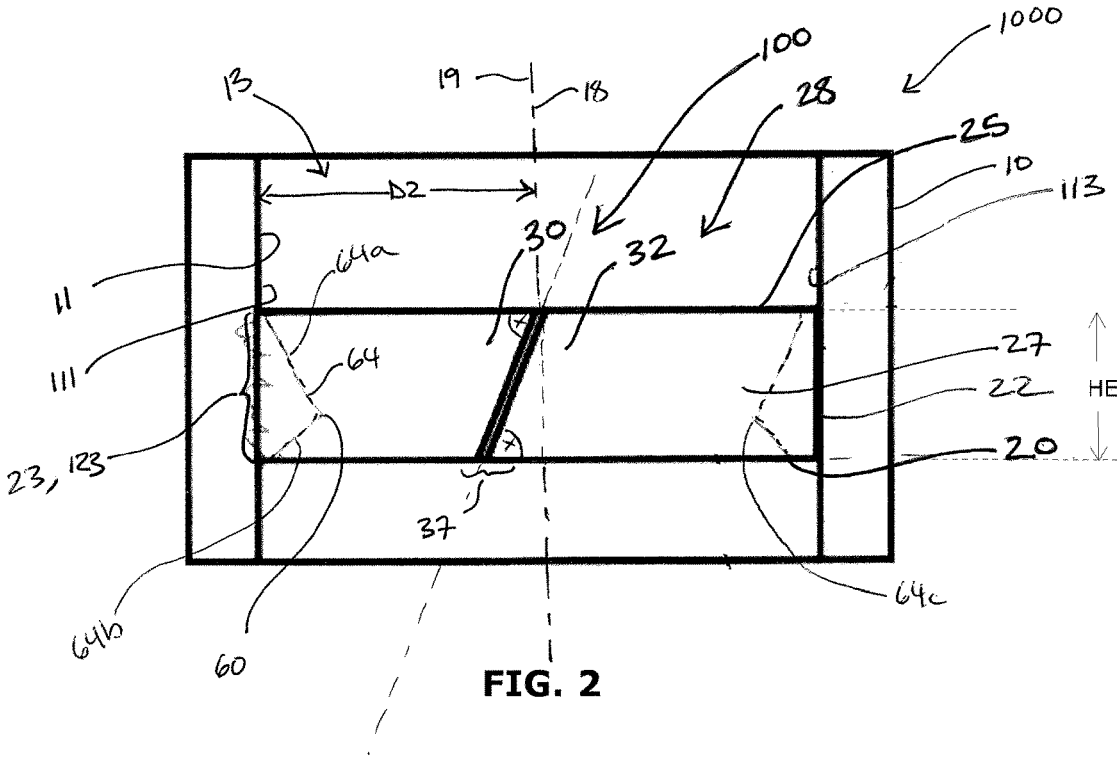
FIG. 2 is a schematic illustration of the wellbore completion apparatus of FIG. 1 in an engagement state.
Figure 3:
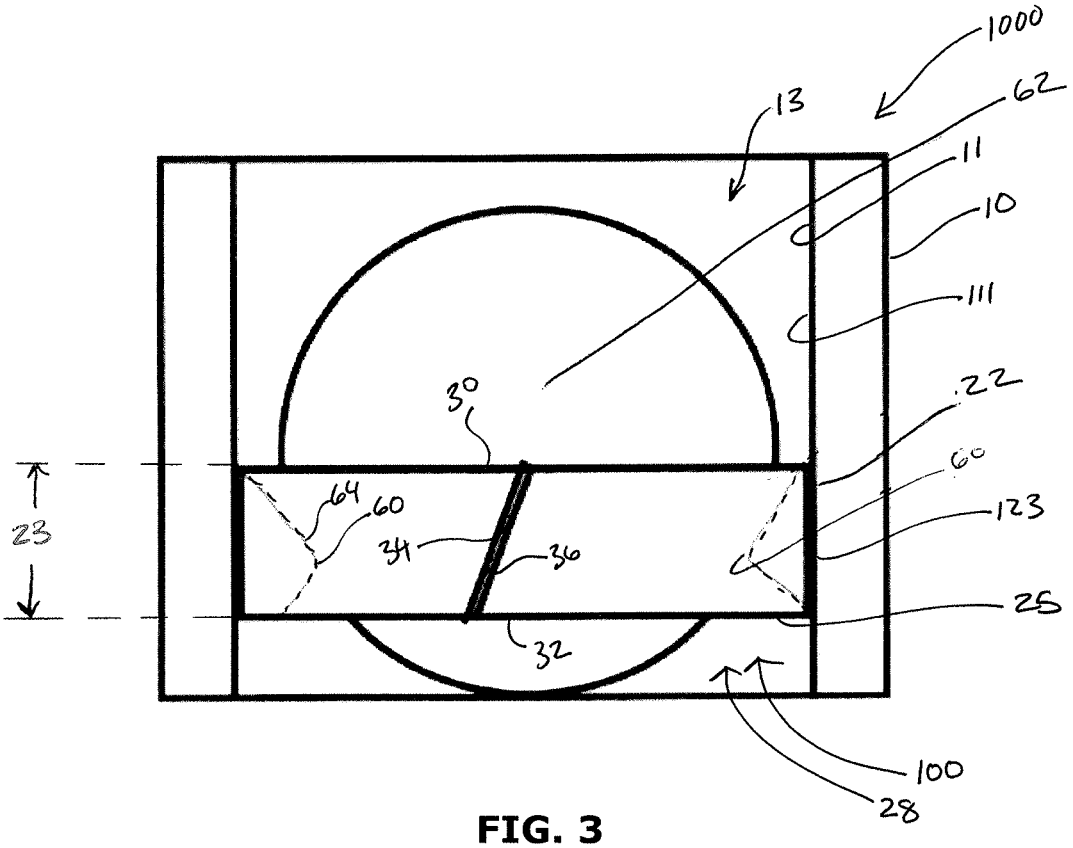
FIG. 3 is a schematic illustration of a wellbore obstruction device seated on the wellbore completion apparatus of FIG. 2.

Referring now, for example, to the example embodiment illustrated in FIGS. 1-3, the wellbore completion apparatus 100 is configurable in at least an engagement-ready state 26 (see for instance FIG. 1) and an engagement state 28 (see for instance FIG. 2). In some embodiments, for example, the apparatus 100 is disposed in the engagement-ready state 26 while being deployed through the passage 13. Accordingly, in some embodiments, the wellbore completion apparatus 100 is releasably secured to the setting tool of the conveyance apparatus while the wellbore completion apparatus 100 is disposed in the engagement-ready state 26. Once deployment of the apparatus 100 within the passage 13 is effected to a desired location, application of the actuation force, transmitted to the apparatus 100 via the conveyance apparatus and the setting tool, effects actuation of the apparatus 100 such that the apparatus 100 transitions from the engagement-ready state 26 to the engagement state 28. In some embodiments, for example, while the apparatus 100 is releasably retained by the setting tool in the engagement-ready state 26 and is disposed within the wellbore 10 such that the engageable surface 22 is disposed in alignment with the passage-defining conductor surface 111, in response to actuation by the setting tool, the apparatus 100 transitions from the engagement-ready state 26 (as shown in FIG. 1) to the engagement state 28 (as shown in FIG. 2), and, in response to the transitioning, the engagement of the engageable surface 22 to the passage-defining conductor surface 111 is established.

In some embodiments, for example, the engagement of the engageable surface 22 to the passage-defining conductor surface 111 is established along an engagement interface 23, and the engagement interface 23 spans a minimum distance, measured along an axis that is parallel to the central axis of the apparatus 100, of at least 0.25 inches, such as, for example, at least 0.75 inches, such as, for example, at least one (1) inch, such as, for example, at least 1.5 inches. In some embodiments, for example, this minimum distance is at least 0.75 inches and no more than eight (8) inches. In some embodiments, for example, this minimum distance is at least one (1) inch and no more than (8) inches. In some embodiments, for example, this minimum distance is at least 1.5 inches and no more than eight (8) inches.

In some embodiments, for example, while the wellbore completion apparatus 100 is disposed in the engagement state 28, the engageable surface 22 is a band, and the band is defined by a height "HE". In some embodiments, for example, the minimum height HE, measured along an axis that is parallel to the central axis 19 of the apparatus 100, and the minimum height HE of the band is at least 0.25 inches, such as, for example, at least 0.75 inches, such as, for example, at least one (1) inch, such as, for example, at least 1.5 inches. In some embodiments, for example, this minimum height HE is at least 0.75 inches and no more than eight (8) inches. In some embodiments, for example, this minimum height H is at least one (1) inch and no more than 8 inches. In some embodiments, for example, this minimum height HE is at least 1.5 inches and no more than 8 inches. In some embodiments, for example, the maximum height HE is less than 36 inches.

Figure 2A:
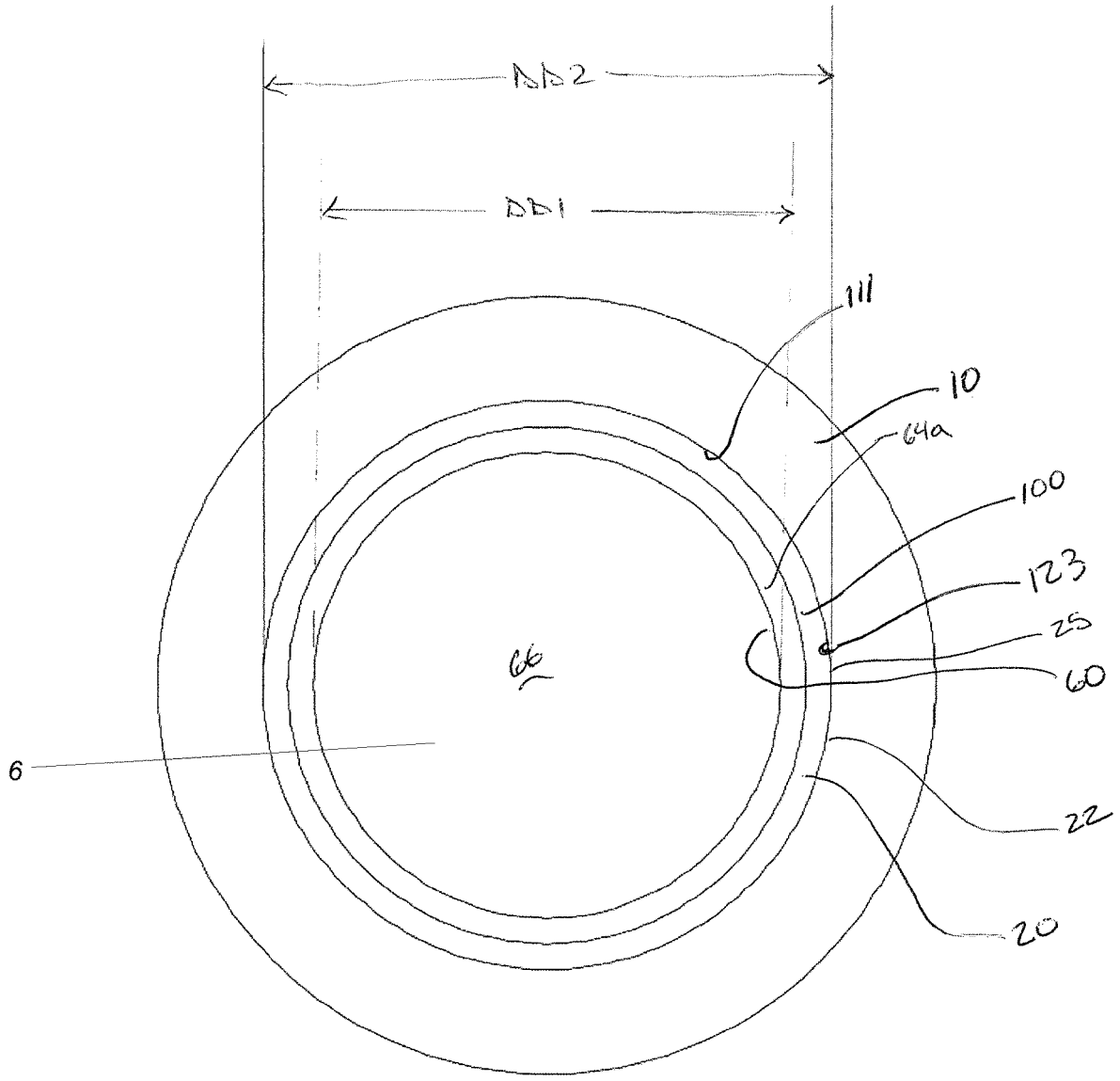
FIG. 2A is a schematic illustration of a top view of the wellbore completion apparatus of FIG. 2 disposed in the engagement state within a wellbore.

With reference now to FIGS. 2 and 2A, in some embodiments, for example, actuation of the apparatus 100, such that the apparatus 100 transitions from the engagement-ready state 26 to the engagement state 28, is with effect that an engageable surface-defining loop 25 is established by the engager 20. In some embodiments, for example, the engageable surface-defining loop 25 is absent in the engagement-ready state 26. In some embodiments, for example, the engageable surface-defining loop 25 is established only in the engagement state 28.

The engageable surface-defining loop 25 defines the engageable surface 22. In some embodiments, for example, the engageable surface-defining loop 25 of the apparatus 100 includes an arcuate profile. In some embodiments, for example, the engageable surface-defining loop 25 has a circular profile. In some embodiments, for example, the engagement interface 23, along which the engagement of the engageable surface-defining loop 25 to the passage-defining conductor surface 111 is established, is defined by an interface-defined loop. In some embodiments, for example, the minimum distance of the interface-defined loop, measured about the perimeter of the interface-defined loop is at least two (2) inches, such as, for example, at least three (3) inches, such as, for example, at least four (4) inches.

In some embodiments, for example, the transitioning of the apparatus 100 from the engagement-ready state 26 to the engagement state 28 is effected by deformation of the engager 20 in response to application of the actuation force transmitted to the wellbore completion apparatus 100 via the setting tool (not shown). In response to application of the actuation force to the wellbore completion apparatus 100 via the setting tool, the engager 20 deforms from a first configuration, associated with the engagement-ready state 26, to a second configuration, associated with the engagement state 28. In some embodiments, the deformation may include elastic deformation. In some embodiments, the deformation includes plastic deformation. In some embodiments, the deformation includes a combination of elastic deformation and plastic deformation. Accordingly, in some embodiments, the actuation force transmitted to the wellbore completion apparatus 100 via the setting tool is such that the actuation force effects plastic deformation of the engager 20 such that the engager 20 deforms from the first configuration to the second configuration. In such example embodiments, once the wellbore completion apparatus 100 is released from retention by the setting tool as the wellbore completion apparatus 100 transitions from the engagement-ready state 26 to the engagement state 28 and the actuation force is no longer applied to the wellbore completion apparatus 100, via the setting tool, the engager 20 remains disposed in the second configuration and the wellbore completion apparatus 100 remains disposed in the engagement state 28.

In some embodiments, for example, the wellbore completion apparatus 100 includes an actuating assembly 400 as shown for instance in the example embodiments illustrated in FIGS. 16-19, 20-24, 32-39 and 41-48. In such example embodiments, the engager 20 is disposed on the actuating assembly 400 and is co-operatively configured with the actuating assembly 400 for co-operative disposition in a first configuration, associated with the engagement-ready state 26, and a second configuration associated with the engagement state 28. In such example embodiments, the engager 20 is retained on the actuating assembly 400 and, in example embodiments wherein the wellbore completion apparatus 100 is deployed within the passage 13 via a conveyance apparatus with a setting tool, the wellbore completion apparatus 100 is releasably secured to the setting tool while the engager 20 and the actuating assembly 400 are co-operatively disposed in the first configuration, associated with the engagement-ready state 26. In some embodiments, for example, actuation of the setting tool is with effect that the actuation force is applied to the actuating assembly 400, via the setting tool, which effects actuation of the actuating assembly 400. Actuation of the actuating assembly 400, via the setting tool, is with effect that the engager 20 and the actuating assembly 400 become co-operatively disposed in the second configuration, associated with the engagement state 28, which effects: (i) deformation of the engager 20 such that the engageable surface 22 engages the passage-defining conductor surface 111 of the wellbore 10, and (ii) release of the wellbore completion apparatus 100 from the setting tool such that the setting tool can be retracted from the passage 13 via the conveyance apparatus while the wellbore completion apparatus 100 remains disposed in engagement with the passage-defining conductor surface 111 of the wellbore 10. Accordingly, in such example embodiments, actuation of the actuating assembly 400 is with effect that the actuation force transmitted to the actuating assembly 400, via the setting tool, is transmitted to the engager 20, via the actuating assembly 400, which effects deformation of the engager 20 into engagement with the passage-defining conductor surface 111 such that the apparatus 100 becomes disposed in the engagement state 28 and is released from the setting tool. Once the wellbore completion apparatus 100 is released from the setting tool, the actuating assembly 400 maintains an outwardly applied engaging force, relative to the central axis 19 of the apparatus 100, on the engager 20 such that the engagement between the engageable surface 22 of the engager 20 of the wellbore completion apparatus 100 with the passage-defining conductor surface 111 is maintained.

In some embodiments, for example, actuation of the actuating assembly 400 via the setting tool effects elastic deformation of the engager 20 from the first configuration associated with the engagement-ready state 26 to the second configuration associated with the engagement state 28. Continued application of the outwardly applied engaging force on the engager 20 by the actuating assembly 400, once the wellbore completion apparatus 100 is released from the setting tool, is with effect that the engager 20 remains disposed in the second configuration associated with the engagement state 28.

In some embodiments, for example, actuation of the actuating assembly 400 via the setting tool effects plastic deformation of the engager 20 from the first configuration associated with the engagement-ready state 26 to the second configuration associated with the engagement state 28. In some embodiments, for example, actuation of the actuating assembly 400 via the setting tool effects both plastic deformation and elastic deformation of the engager 20 from the first configuration associated with the engagement-ready state 26 to the second configuration associated with the engagement state 28.

In some embodiments, for example, the engagement of the engageable surface 22 to the passage-defining conductor surface 111 is with effect that engageable surface 22 of the engager 20 is sealingly engaged to the passage-defining conductor surface 111. In this respect, in some embodiments, for example, the engagement of the engageable surface 22 to the passage-defining conductor surface 111 is a sealing engagement.

In some embodiments, for example, the engagement of the engageable surface 22 to the passage-defining conductor surface 111 is with effect that displacement of the apparatus 100, relative to the passage-defining conductor surface 111, in a direction that is perpendicular to an axis that is normal to the engageable surface 22, is resisted. In this respect, in some embodiments, for example, the engagement includes a gripping engagement to the passage-defining conductor surface 111. In some embodiments, for example, the gripping engagement is with effect that displacement of the wellbore completion apparatus 100 relative to the passage-defining conductor surface 111, in a direction that is perpendicular to an axis that is normal to the engageable surface 22, is resisted. In some embodiments, for example, the gripping engagement is with effect that the wellbore completion apparatus is self-supporting.

In some embodiments, for example, the engagement of the engageable surface 22 to the passage-defining conductor surface 111 is with effect that: (i) the engageable surface 22 is sealingly engaged to the passage-defining conductor surface 111, and (ii) displacement of the apparatus 100, relative to the passage-defining conductor surface 111, in a direction that is perpendicular to an axis that is normal to the engageable surface 22, is resisted. In this respect, the engagement between the apparatus 100 and the passage-defining conductor surface 111 while the apparatus 100 is disposed within the wellbore 10 and disposed in the engagement state 28 is both a sealing engagement and a gripping engagement. In some embodiments, for example, the engagement of the engageable surface 22 to the passage-defining conductor surface 111 is with effect that the sealing engagement is effective and displacement of the apparatus 100, relative to the passage-defining conductor surface 111, in a direction that is perpendicular to an axis that is normal to the engageable surface 22 is resisted, versus an applied force of between 1000 lbf and 100,000 lbf. In some embodiments, for example, the engagement of the engageable surface 22 to the passage-defining conductor surface 111 is with effect that the sealing engagement is effective and displacement of the apparatus 100, relative to the passage-defining conductor surface 111, in a direction that is perpendicular to an axis that is normal to the engageable surface 22 is resisted in response to applied pressures within the range of 100 psi to 20,000 psi.

In some embodiments, for example, the engageable surface 22 includes surface enhancement features 29 for effecting the gripping engagement of the apparatus 100 to the passage-defining conductor surface 111. In some embodiments, for example, the surface enhancement features 29 include teeth, as illustrated for example in FIGS. 16-17. In some embodiments, for example, the surface enhancement features 29 include an undulated surface. In some embodiments, for example, the surface enhancement features 29 include a plurality of ridges that extend about the outer perimeter of the engager 20 as illustrated for example in FIG. 32. In some embodiments, for example, actuation of the apparatus 100 to the engagement state 28, with effect that the engageable surface 22 becomes disposed in engagement with the passage-defining conductor surface 111, includes deformation of the surface enhancement features 29. In some embodiments, for example, the deformation of the surface enhancement features 29 is with effect that the surface enhancement features 29 (such as the teeth or ridges) flatten against or are compressed against the passage-defining conductor surface 111. In some embodiments, for example, the deformation of the surface enhancement features 29 is with effect that the surface enhancement features 29 (such as the teeth or ridges), become embedded within the passage-defining conductor surface 111. Accordingly, in some embodiments, for example, as the apparatus 100 transitions to the engagement state 28 such that the engageable surface 22 deforms against the passage-defining conductor surface 111, is with effect that the engageable surface 22 creates an interference fit between the engager 20 of the apparatus 100 and the passage-defining conductor surface 111 with effect that the apparatus 100 becomes disposed in gripping engagement with the passage-defining conductor surface 111.

In some embodiments, for example, the engager 20 includes a substrate 21 and one or more surface enhancement features 29 attached (such as, for example, embedded, or adhered) to the substrate 21.

In some embodiments, for example, the one or more surface enhancement features 29 is in the form of gripping components which define at least a portion of the engageable surface 22 of the engager 20. With reference to the example embodiment of FIGS. 35-39, in some embodiments, for example, the surface enhancement features 29 includes grippers 172 that are disposed within and distributed about the outer surface of the substrate 21 that defines the engager 20.

In some embodiments, for example, the grippers 172 include disk-shaped buttons (or slip buttons) comprised of tungsten carbide, ceramics or high strength steel that are disposed within recessed openings 174 that are disposed at spaced apart intervals within the substrate 21. In some example embodiments, the recessed openings 174 are drilled into the substrate 21 and the grippers 172, in the form of disks or buttons comprising a hardened material, are inserted within the recessed openings 174. In order to facilitate insertion of the disks or buttons, in some embodiments, the substrate, defining the recessed openings 174, is first heated for effecting thermal expansion of the substrate 21 and thereby increasing the size of the recessed openings 174, which allows for insertion of the grippers 172. The heated substrate 21 is then permitted to cool creating an interference fit between the disk or button-shaped grippers 172 and the substrate 21. In some embodiments, for example, the grippers 172 are bonded to the substrate 21 with adhesive, such as, for example, an adhesive manufactured by Loctite™.

In some embodiments, for example, the grippers 172 are disposed within the recessed openings 174 such that the grippers 172 are each, independently, disposed at an angle relative to an axis that extends normal to the substrate 21. In some embodiments, the grippers 172 include sharp edges such that, while the apparatus 100 is deployed within the wellbore 10 and transitions from the engagement-ready state 26 to the engagement state 28 bringing the engageable surface 22 of the engager 20 into engagement with the passage-defining conductor surface 111, the sharp edges of the grippers 172 dig into and embed themselves within the passage-defining conductor surface 111 of the conductor surface-defined loop 123, which provides a further gripping effect between the apparatus 100 and the passage-defining conductor surface 111.

In order to effect deformation of the engager 20, in some embodiments, for example, the substrate 21 includes a low yield material. In some embodiments, for example, the low yield material has an ultimate tensile yield strength that is less than 130 ksi. In some embodiments, for example, the low yield material is selected such that application of the actuation force to the apparatus 100 via the setting tool will effect plastic deformation of the engager 20. In some embodiments, for example, the low yield material includes a metallic material. In some embodiments, for example, the metallic material includes one of the following alternatives: magnesium alloys, aluminum alloys, low strength steel alloys, cast irons, cooper alloys, or brass alloys. In some embodiments, for example, the low yield material includes a polymeric material. In some embodiments, for example, the polymeric material includes one of the following alternatives: PEEK (Polyetheretherketone), PET (Polyethylene Terephthalate), PTFE (Polytetrafluoroethylene), Epoxies, or Composites of Polymers and Fibers (e.g. composite material). In some embodiments, the low yield material includes dissolvable metals. In some embodiments, the low yield material includes dissolvable plastics.

In some embodiments, for example, the low yield material is surface treated for obtaining a hardened material for defining at least a portion of the engageable surface 22 of the engager 20, such that the one or more surface enhancement features 29 include the hardened material. In some embodiments, for example, the surface treatment includes surface hardening. In some embodiments, for example, the surface treatment includes surface hardening of steel materials. In some embodiments, the surface treatment includes anodizing of aluminum materials. In some embodiments, for example, the surface treating is with effect that the obtained engageable surface 20 has superior gripping functionality versus the low yield material.

With reference again to the example embodiment of FIGS. 1-3, in some embodiments, for example, while the apparatus 100 is disposed in the engagement-ready state 26, the engageable surface 22 includes an outermost surface that is spaced apart from a central axis 19 of the apparatus 100 by a minimum distance D1 (a distance that is measured along an axis that is perpendicular to the central axis 19). While the apparatus 100 is disposed in the engagement state 28, the engageable surface 22 includes an outermost surface that is spaced apart from the central axis 19 of the apparatus 100 by a minimum distance D2 (a distance that is measured along an axis that is perpendicular to the central axis 19), wherein the minimum distance D2 is greater than the minimum distance D1. For each one of the engagement-ready state 26 and the engagement state 28, independently, the outermost surface is defined by at least a portion of the engageable surface 22 and, relative to any remaining portion of the engageable surface 22, is disposed furthest from the central axis 19 of the apparatus 100. In some embodiments, for example, the ratio of the minimum distance D2 to the minimum distance D1 is at least 101:100. In some embodiments, for example, the ratio is at least 1.05, such as, for example, 1.1, such as, for example, 1.15.

In some embodiments, for example, while the apparatus 100 is disposed within the wellbore 10, in the engagement-ready state 26, the engageable surface 22 includes an outermost surface that is spaced apart from the central longitudinal axis 18 of the wellbore 10 by a minimum distance D1 (a distance that is measured along an axis that is perpendicular to the central longitudinal axis 18), and, in the engagement state, the engageable surface 22 includes an outermost surface that is spaced apart from the central longitudinal axis 18 of the wellbore 10 by a minimum distance D2 (a distance that is measured along an axis that is perpendicular to the central longitudinal axis 18), and the minimum distance D2 is greater than the minimum distance D1. For each one of the engagement-ready state 26 and the engagement state 28, independently, the outermost surface is defined by at least a portion of the engageable surface 22 and, relative to any remaining portion of the engageable surface, is disposed furthest from the central longitudinal axis 18 of the wellbore 10. In some embodiments, for example, the ratio of the minimum distance D2 to the minimum distance D1 is at least 101:100. In some embodiments, for example, the ratio is at least 1.05, such as, for example, 1.1, such as, for example, 1.15.

In some embodiments, for example, while the wellbore completion apparatus 100 is disposed within the wellbore 10, actuation of the apparatus 100, such that the apparatus 100 transitions from the engagement-ready state 26 to the engagement state 28, is with effect that at least a portion of the engageable surface 22 becomes displaced further outwardly (such as, for example, radially outwardly) relative to the central axis 19 of the apparatus 100. In some embodiments, for example, the at least a portion of the engageable surface 22 is the entirety of the engageable surface, such that, while the wellbore completion apparatus 100 is disposed within the wellbore 10, actuation of the apparatus 100, such that the apparatus 100 transitions from the engagement-ready state 26 to the engagement state 28, is with effect that the entirety of the engageable surface 22 becomes displaced further outwardly (such as, for example, radially outwardly) relative to the central axis 19 of the apparatus 100. In some embodiments, the distance, measured along an axis that is perpendicular to the central axis 19, by which the at least a portion of the engageable surface 22 is displaced is at least 1/32 of an inch, such as, for example, at least 0.25 inches, such as, for example, at least 3/8 of an inch, such as for example, at least 0.5 inches.

In some embodiments, for example, while the wellbore completion apparatus 100 is disposed within the wellbore 10, actuation of the apparatus 100, such that the apparatus 100 transitions from the engagement-ready state 26 to the engagement state 28, is with effect that at least a portion of the engageable surface 22 becomes displaced further outwardly (such as, for example, radially outwardly) relative to the central longitudinal axis 18 of the wellbore 10. In some embodiments, for example, the at least a portion of the engageable surface 22 is the entirety of the engageable surface 22, such that, while the wellbore completion apparatus 100 is disposed within the wellbore 10, actuation of the apparatus 100, such that the apparatus 100 transitions from the engagement-ready state 26 to the engagement state 28, is with effect that the entirety of the engageable surface 22 becomes displaced further outwardly (such as, for example, radially outwardly) relative to the central longitudinal axis 18 of the wellbore 10. In some embodiments, the distance, measured along an axis that is perpendicular to the central longitudinal axis 18, by which the at least a portion of the engageable surface 22 is displaced is at least 1/32 of an inch, such as, for example, at least 0.25 inches, such as, for example, at least 3/8 of an inch, such as for example, at least 0.5 inches.

Referring again to FIGS. 2 and 2A, in some embodiments, for example, actuation of the apparatus 100, such that the apparatus 100 transitions from the engagement-ready state 26 to the engagement state 28, is with effect that the engageable surface 22 becomes engaged to a conductor surface-defined loop 123 defined by the passage-defining conductor surface portion of the passage-defining conductor surface 111 of the passage-defining conductor 113. In some embodiments, for example, the conductor surface-defined loop 123 has a circular profile.

With reference now to FIGS. 3, 12-14, 22-24 and 29, in some embodiments, for example, the apparatus 100 is configured such that, in the engagement state 28, the apparatus 100 further includes a seat 60 for receiving a wellbore obstruction device 62. In some embodiments, for example, the seat 60 is defined by the actuating assembly 400 on which the engager 20 is mounted The seat 60 is cooperatively configured with the wellbore obstruction device 62 with effect that seating of the wellbore obstruction device 62 on the seat 60 effects occluding of a flow communicator 6 defined by the apparatus 100. The flow communicator 6 is provided for effecting flow communication across the apparatus 100, such as, for example, for facilitating production, as described below.

In some embodiments, for example, the seat 60 is obtained in response to the transitioning of the apparatus 100 from the engagement-ready state 26 to the engagement state 28. In some embodiments, for example, the seat 60 is absent in the engagement-ready state. In some embodiments, for example, the seat 60 is defined only in the engagement state.

Exemplary wellbore obstruction devices 62 include a plug that is conveyable through the wellbore 10 from the surface. In some embodiments, for example, the wellbore obstruction device 62 includes any one of the following alternatives: a ball, a plug, a disk or a dart.

In some embodiments, for example, the wellbore obstruction device 62 is integrated within the apparatus 100. In this respect, in some embodiments, for example, the apparatus 100 includes a flow control member, such that the wellbore obstruction device 62 is the flow control member. In some embodiments, for example, the flow control member is in the form of a flapper valve.

With reference, in particular, to FIG. 3, in some embodiments, for example, while the wellbore completion apparatus 100 is deployed within the wellbore 10 and disposed in the engagement state 28 such that the engageable surface-defining loop 25 is obtained and is disposed in engagement with the conductor surface-defined loop 123, and a wellbore obstruction device 62 is seated on the seat 60, flow communication across the apparatus 100 is sealed. See, for instance, the example embodiment illustrated in FIG. 3, wherein a wellbore obstruction device 62 in the form of a drop ball is seated on the seat 60 defined by the wellbore completion apparatus 100 in the engagement state 28. Accordingly, in some embodiments, disposition of the apparatus 100 in the engagement state 28 is with effect that a sealed interface is defined between the engageable surface-defining loop 25 and the conductor surface-defined loop 123, and once a plug or wellbore obstruction device 62 is seated on the seat 60, flow communication through the passage 13 across the apparatus 100 is sealed. By effecting the sealing of flow communication across the apparatus 100, a sealed interface is established within the passage 13, enabling, for example, stimulation of a zone of the subterranean formation 12 via perforations disposed uphole of this sealed interface.

Referring to the example embodiment of FIGS. 1-3, the engager 20 of the wellbore completion apparatus 100 includes a first free end 30 and a second free end 32, wherein the first free end 30 is displaceable relative to the second free end 32. The first free end 32 includes a first mating surface 34 and the second free end 34 includes a second mating surface 36.

In the engagement-ready state 26, as shown in FIG. 1, the first free end 32 and the second free end 34 of the engager 20 are spaced apart relative to one another along an axis having a component that is parallel to the central axis 19 of the apparatus 100. In the engagement state 28, as shown in FIG. 2, the first free end 30 and the second free end 32 of the engager 20 are disposed such that the first mating surface 34 and the second mating surface 36 are disposed in abutting engagement such that the engageable surface-defining loop 25 is defined. In the subject example embodiment, the wellbore completion apparatus 100 transitions from the engagement-ready state 26 to the engagement state 28 in response to relative displacement between the first free end 30 and the second free end 32, from the first configuration defined in the engagement-ready state 26, to the second configuration defined in the engagement state 28, such that the engageable surface-defining loop 25 is established. In some embodiments, for example, while the apparatus 100 is deployed within the wellbore 10 and is deployed to the desired location within the wellbore 10, actuation of the wellbore completion apparatus 100 by way of application of the actuation force, via the setting tool, effects displacement of the first free end 30 relative to the second free end 32 such that the first mating surface 34 is brought into abutting engagement with the second mating surface 36, thereby establishing the engageable-surface defined loop 25.

With reference now to FIGS. 2A, 3 and 12-14, in some embodiments, for example, while the apparatus 100 is disposed in the engagement state 28, the flow communicator 6 is in the form of an opening 66 that extends through the apparatus 100, and the engager 20 defines the opening 66. In the subject example embodiment, the opening 66 is defined by the inner surface 64 of the engager 20. The inner surface 64 is configured such that while the apparatus 100 is disposed in the engagement state 28, the opening 66 has a diameter, DD1, that is less than the diameter, DD2, defined by the engageable surface-defining loop 25. In some embodiments, the inner surface 64 is defined by inwardly sloping sidewalls 64*a*, 64*b* that converge towards each other and meet at an innermost surface 64*c*, the innermost surface 64*c* defining opening 66. The upper inwardly sloping sidewall 64*a* and the innermost surface 64*c* of the inner surface 64 of the engager 20 define the seat 60 for receiving the wellbore obstruction device 62. In some embodiments, for example, the inner surface 64 of the engager 20 may include a concave upper surface for receiving a corresponding wellbore obstruction device 62. A concave inner surface portion may be useful, for example, when the wellbore obstruction device 62 is in the form of a drop ball or similar device. Once the wellbore obstruction device 62 is deployed through the passage 13 and is seated on the seat 60, the passage or opening 66 through the wellbore completion apparatus 100 is occluded with effect that flow communication across the wellbore completion apparatus 100 is sealed effectively isolating the portion of the passage 13 that extends downhole of the apparatus 100 from the portion of the passage 13 that extends uphole of the apparatus 100.

With reference to FIGS. 1-3, 7, 8, 9, 11, in some embodiments, for example, the first mating surface 34 and the second mating surface 36 are co-operatively shaped for slidable displacement relative to one another. Accordingly, in some embodiments, the transitioning of the wellbore completion apparatus 100 from the engagement-ready state 26 to the engagement state 28, such that the first mating surface 34 and the second mating surface 36 are disposed in a configuration whereby the engager 20 defines the engageable surface-defining loop 25, is guided at least in part by sliding displacement between the first mating surface 34 and the second mating surface 36 of the first and second free ends 30, 32 of the engager 20. In some embodiments, for example, the transitioning of the apparatus 100 from the engagement-ready state 26 to the engagement state 28 such that the first mating surface 34 and the second mating surface 36 become disposed in abutting engagement 37 such that the engager 20 defines the engageable surface-defining loop 25, is guided, at least in part, by sliding displacement between the first mating surface 34 and the second mating surface 36 of the first and second free ends 30, 32 of the engager 20.

Figure 11:
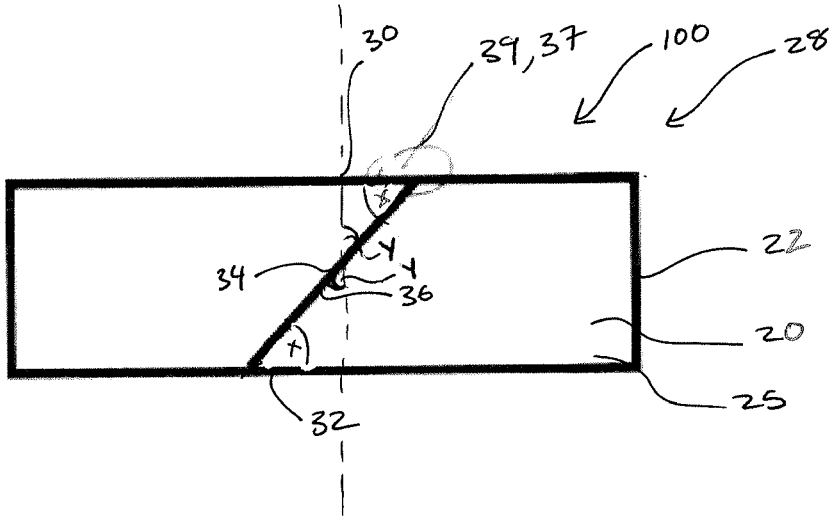
FIG. 11 is a schematic illustration of the wellbore completion apparatus of FIG. 1 in the engagement state.
Figure 12:
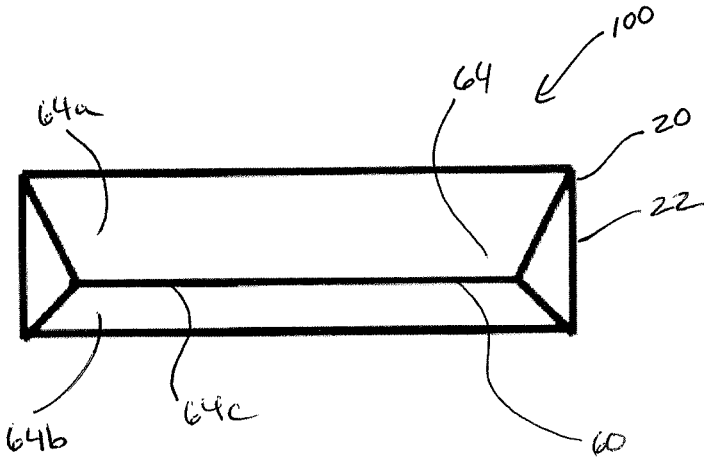
FIG. 12 is a cross-sectional view of the wellbore completion apparatus FIG. 11 taken along section line 12-12 shown in FIG. 13.
Figure 13:
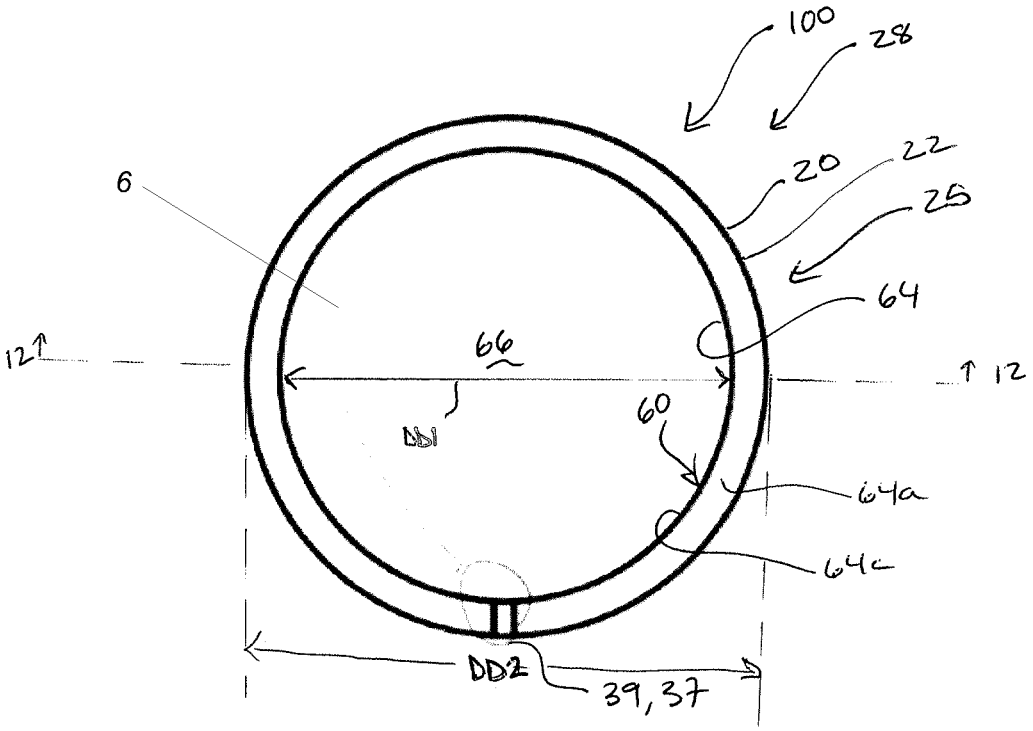
FIG. 13 is a schematic top view of the wellbore completion apparatus of FIG. 11.
Figure 14:
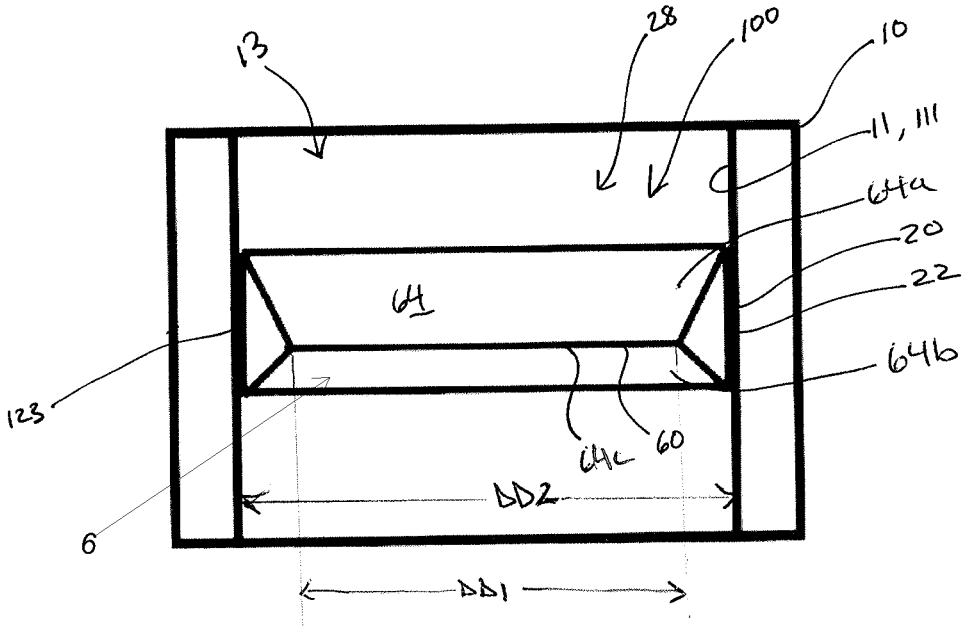
FIG. 14 is a schematic illustration of a cross-sectional view of the wellbore completion apparatus of FIG. 11 in the engagement state disposed within a wellbore.
Figure 15:
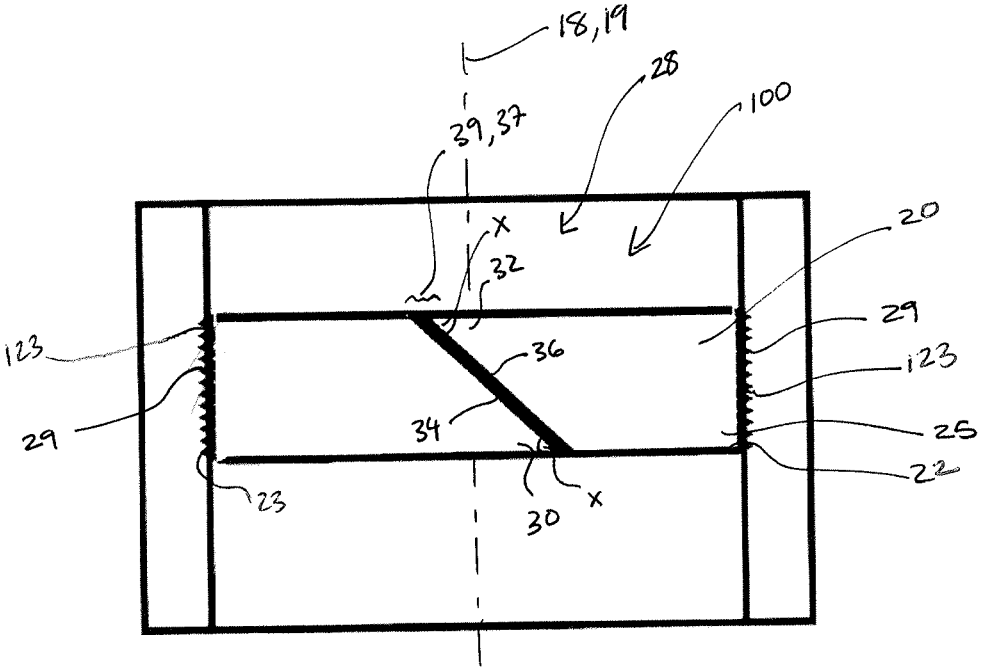
FIG. 15 is schematic illustration of a front view of a wellbore completion apparatus disposed within the wellbore in the engagement state including a schematic illustration of the gripping engagement between the wellbore completion apparatus and the wellbore feature.

With reference to FIGS. 2, 11 and 15, in some embodiments, for example, the first mating surface 34 and the second mating surface 36 are each, independently, disposed at an angle, X, relative to an axis that is normal to the central axis 19 of the apparatus 100. Accordingly, in some embodiments the first and second mating surfaces 34, 36 are each, independently angled such that relative displacement between the first free end 30 and the second free end 32, in response to application of the actuation force applied by the setting tool, brings the angled, first mating surface 34 and the angled, second mating surface 36 into contact engagement and continued displacement of the first and second free ends 30, 32, relative to one another, along the angled first mating surface 34 and the angled second mating surface 36, urges outward displacement of the engageable surface 22 of the engager 20 with effect that the engageable surface 22 of the engageable surface-defining loop 25 is disposed in engagement with the conductor surface-defined loop 123.

In some embodiments, for example, while the apparatus 100 is deployed within the wellbore 10 and is disposed in the engagement state 28, one of the first and second mating surfaces 34, 36 is oriented in an upwardly facing direction at an angle, Y, that is greater than 45 degrees relative to the central longitudinal axis 18 of the wellbore 10, as illustrated for example in FIG. 11, while the other one of the first and second mating surfaces 34, 36 is oriented in a downwardly facing direction and at an angle, relative to the central axis 18 of the wellbore 10 that is complementary to the one of the first and second mating surfaces 34, 36, for establishing the abutting engagement 37 between the first mating surface 34 and the second mating surface 36 such that the engageable surface-defining loop 25 is established. In some embodiments, while the apparatus 100 is deployed within the wellbore 10, the upwardly facing angled surface and the downwardly facing angled surface are co-operatively configured such that transitioning of the apparatus 100 to the engagement state 28 from the engagement-ready state 26 is such that once the first mating surface 34 and the second mating surface 36 are displaced relative to one another such that the first mating surface 34 and the second mating surface 36 are disposed in contact engagement, continued displacement of the first mating surface 34 relative to the second mating surface 36 along the complementary upwardly facing and downwardly facing angled first and second mating surfaces, urges displacement of the engageable surface 22 in an outward direction relative to the central axis 18 the wellbore 10 such that the engageable surface-defining loop 25 is established and the apparatus 100 becomes disposed in the engagement state 28.

Figure 8:
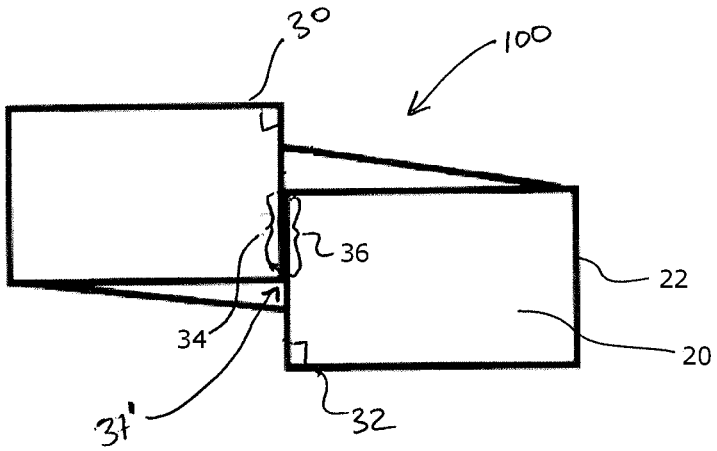
FIG. 8 is a schematic illustration of another example embodiment of a wellbore completion apparatus according to the present disclosure in an engagement state.

Referring now to the example embodiment of FIG. 8, in some embodiments, for example, the first mating surface 34 and the second mating surface 36 are each, independently, disposed at an angle relative to an axis that is normal to the central axis 19 of the apparatus 100 of about 90 degrees. While the apparatus 100 is deployed within the wellbore 10 and is disposed in the engagement state 28 such that the engager 20 defines the engageable surface-defining loop 25, the engageable surface defined loop 25 is established by abutting engagement of the first mating surface 34 with the corresponding second mating surface 26 of the engager 20.

Figure 5:
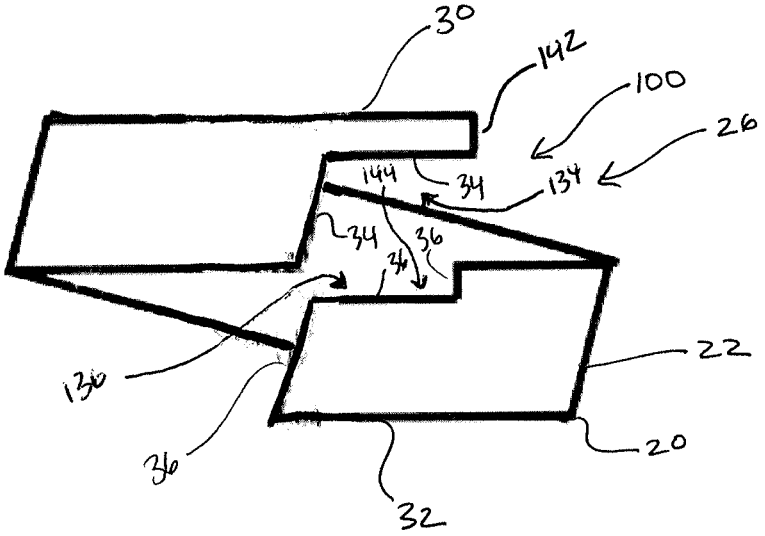
FIG. 5 is a schematic illustration of another example embodiment of a wellbore completion apparatus according to the present disclosure in an engagement-ready state.

Referring now, in particular to the example embodiment of FIG. 5, in some embodiments, for example, the first free end 30 and the second free end 32 of the engager 20 are co-operatively shaped such that, while the apparatus 100 is disposed in the engagement state 28, the first free end 30 and the second free end 32 are disposed in a complementary, mating configuration.

As shown in FIG. 5, in some embodiments, the first mating surface 34 of the first free end 30 defines a first mating profile 134 while the second mating surface 36 of the second free end 32 defines a complementary, second mating profile 136. While the apparatus 100 is disposed in the engagement-ready state 26, the first free end 30 and the second free end 32 are spaced apart from each other along an axis having a component that is parallel to the central axis 19 of the apparatus such that there is an absence of contact between the first mating profile 134 defined by the first mating surface 34 of the first free end 30, and the second mating profile 136 defined by the second mating surface 36 of the second free end 32, the first and second free ends 30, 32 being disposed for relative displacement relative to one another. In the engagement stated 28, the first free end 30 and the second free end 32 are disposed such that the first mating profile 134 is disposed in abutting engagement with the second mating profile 136 such that the mating configuration between the first free end 30 and the second free end 32 is established with effect that the engageable surface-defining loop 25 is established. As shown in FIG. 5, in some embodiments, for example, the first mating profile 134 includes a projection 142 and the second mating profile 136 includes a recessed area 144 such that disposition of the first free end 30 and the second free end 32 in the connected configuration is with effect that the projection 142 defined by the first mating profile 134 is received within the recessed area 144 defined by the second mating profile 136, the first and second mating profiles 134, 136 being complementary to one another. Transitioning of the apparatus 100 from the engagement-ready state 26 to the engagement state 28, via application of the actuation force applied to the apparatus 100 by the setting tool, effects relative displacement between the first free end 30 and the second free end 32 of the engager 20 such that the projection 142 defined by the first mating profile 134 of the first free end 30 is disposed within the recessed area 144 defined by the complimentary second mating profile 136 of the second free end 32 of the engager 20 such that the engageable surface-defining loop 25 is established. In the subject example embodiment, the first mating profile 134 and the second mating profile 136 are co-operatively shaped such that relative displacement between the first free end 30 and the second free end 32 along an axis having a component that is parallel to the central axis 19 of the apparatus 100 is limited by the projection 142 impinging against a surface of the second mating profile 136 that defines the recessed area 144 such that the first mating profile 134 and the second mating profile 136 are disposed in abutting engagement.

Figure 6:
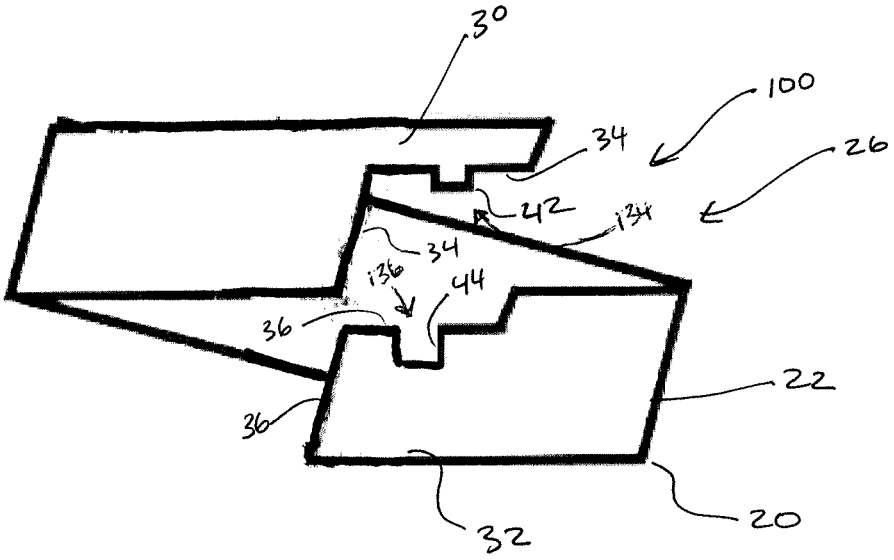
FIG. 6 is a schematic illustration of another example embodiment of a wellbore completion apparatus according to the present disclosure in an engagement-ready state.
Figure 5A:
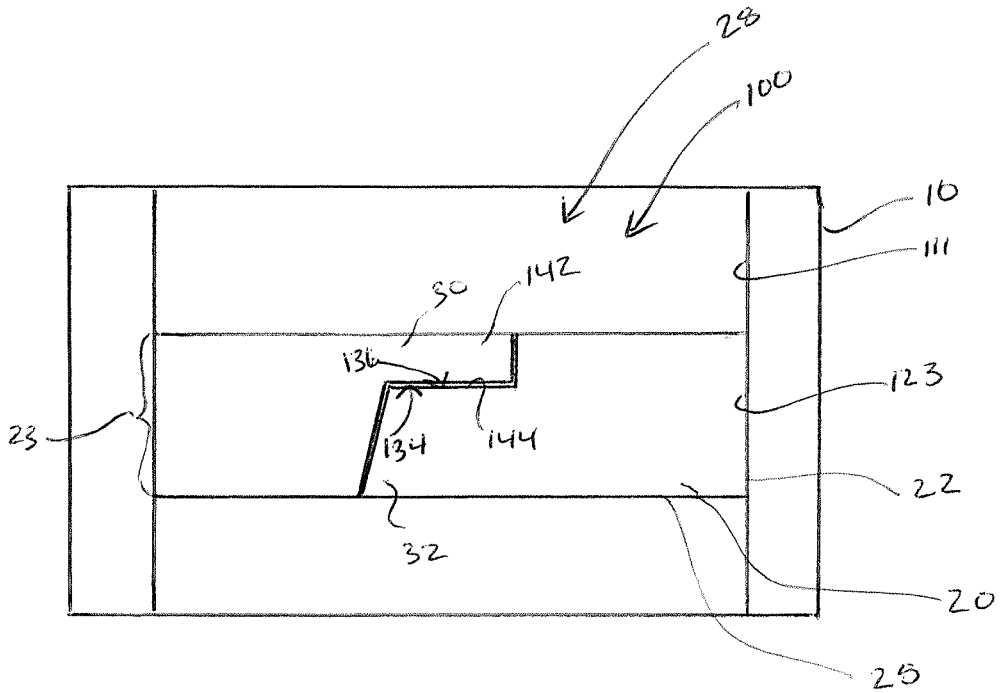
FIG. 5A is a schematic illustration of the wellbore completion apparatus of FIG. 5 in the engagement state.
Figure 6A:
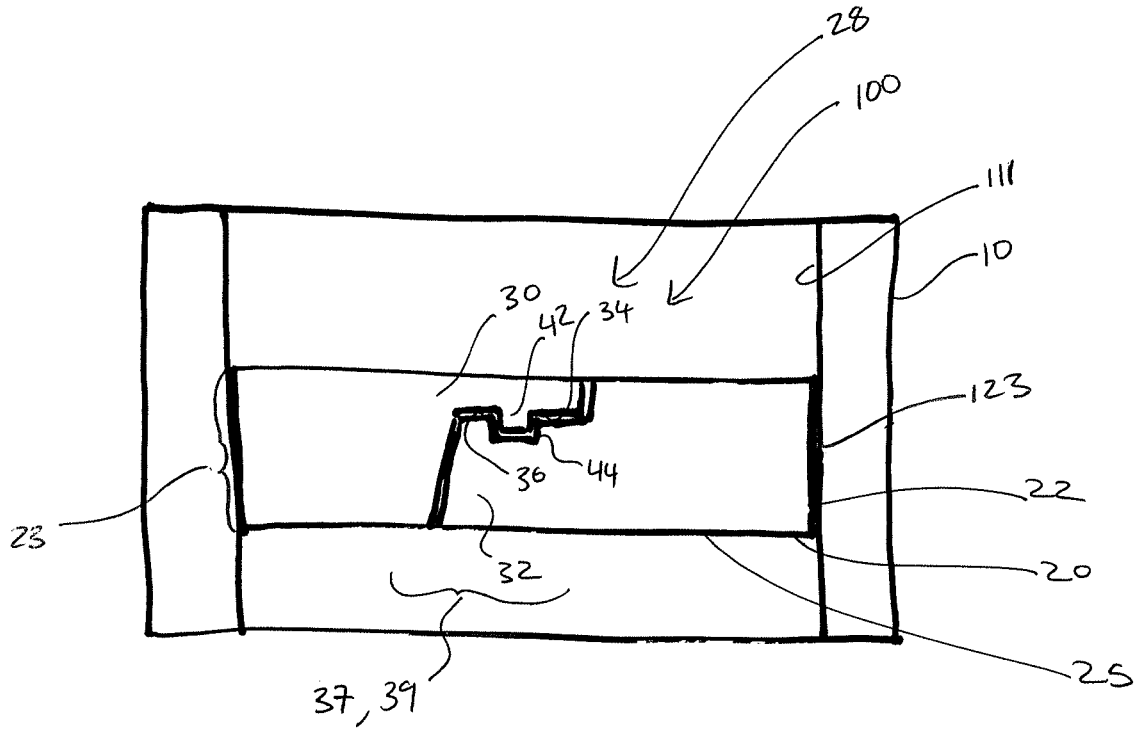
FIG. 6A is a schematic illustration of the wellbore completion apparatus of FIG. 6 in the engagement state.

Referring now in particular to the example embodiments illustrated in FIGS. 6 and 6A, in some embodiments, for example, the first free end 30 and the second free end 32 of the engager 20 are co-operatively shaped such that, while the apparatus 100 is disposed in the engagement state 28, the first free end 30 and the second free end 32 are disposed in a connected configuration 39. More specifically, in some embodiments, the first mating surface 34 of the first free end 30 defines a first mating profile 134 while the second mating surface 36 of the second free end 32 defines a complementary, second mating profile 136 wherein the first mating profile and the second mating profile include complementary, interlocking components such that disposition of the apparatus 100 in the engagement state 28, wherein the engager 20 defines the engageable surface-defining loop 25 is with effect that the first free end 30 and the second free end 32 are disposed in a connected configuration 39, as illustrated in FIG. 6A.

With reference now to FIGS. 6 and 6A, in some embodiments, for example, one of the first mating profile 134 and the second mating profile 136 includes a male interlocking element 42 while the other one of the first and second mating profiles 134, 136 includes a female interlocking element 44. In such embodiments, for example, while the apparatus 100 is disposed in the engagement-ready state 26, as illustrated in FIG. 6, the first free end 30 and the second free end 32 are spaced apart from each other along an axis having a component that is parallel to the central axis 19 of the apparatus 100 such that relative displacement between the first free end 30 and the second free end 32, in response to application of an actuation force applied by the setting tool, brings the first mating profile 134 into mating contact or abutting engagement with the second mating profile 136 such that the male interlocking element 42 is disposed within the corresponding female interlocking element 44 with effect that the apparatus 100 transitions from the engagement-ready state 26 to the engagement state 28, as illustrated in FIG. 6A. In such example embodiments, disposition of the male interlocking element 42 within the corresponding female interlocking element 44 is with effect that the first free end 30 and the second free end 32 of the engager 20 are disposed in a connected configuration 39 such that the engageable surface-defining loop 25 is established. While the connected configuration 39 is established, relative displacement between the first free end 30 and the second free end 32 away from each other, along an arcuate path, is resisted due to interference between the male interlocking element 42 within the corresponding female interlocking element 44. In some embodiments, disposition of the male interlocking element 42 within the corresponding female interlocking element 44 serves to locate the first free end 30 relative to the second free end 32 in the configuration defining the engageable surface-defining loop 25.

Referring again to the example embodiments illustrated in FIGS. 1-3, 4, 5, 6, 6A, 8, 11 and 15, in some embodiments, for example, while the apparatus 100 is disposed in the engagement-ready state 26, the apparatus 100 is disposed in a helical configuration 200.

With reference, in particular, to FIGS. 1, 4, 5 and 6, while the apparatus 100 is disposed in the engagement-ready state 26, the first free end 30 and the second free end 32 of the apparatus 100 are spaced apart from each other along an axis having a component that is parallel to the central axis 19 of the apparatus 100, such that the engager 20 is disposed in a helical configuration 200. Accordingly, in some embodiments, while the apparatus 100 is disposed in the engagement-ready state 26, the engager 20 is shaped, for example, like a corkscrew that curves about the central axis 19 of the apparatus 100.

In some embodiments, for example, while the apparatus 100 is disposed in the helical configuration 200, the first free end 30 and the second free end 32 of the engager 20 are spaced apart from each other along an axis having a component that is parallel to the central axis 19 of the apparatus 100, such that the engager 20 defines at least one complete helix turn about the central axis 19 of the apparatus 100 as illustrated, for example, in FIG. 1, as the engager 20 extends between the first free end 30 and the second free end 32. In some embodiments, for example, the first free end 30 and the second free end 32 of the engager 20 are spaced apart from each other along an axis having a component that is parallel to the central axis 19 of the apparatus 100, such that the engager 20 defines more than one complete helix turn about the central axis 19 of the apparatus 100. With reference to the example embodiment illustrated in FIG. 1, while the apparatus 100 is disposed in the engagement-ready state 26 and the engager 20 is disposed in the helical state, the overall height, "H", of the apparatus 100 or the engager 20 of the apparatus 100 corresponds to the pitch of the helix defined by the engager 20 while the apparatus 100 is disposed in the engagement-ready state 26.

While the apparatus 100 is in the engagement-ready state 26 and the engager 20 is disposed in the helical configuration 200, the outermost surface of the engager 20 is spaced apart from the central axis 19 of the apparatus 100 by a minimum distance D1, as shown, for example, in FIG. 1. The minimum distance D1, as defined by the helical configuration 200 of the engager 20, is such that the overall outer dimension defined by the outer surface of the engager 20 less than the width of the passage 13 defined by the passage-defining conductor surface 111. Therefore, while the apparatus 100 is disposed in the engagement-ready state 26 and is deployed through the passage 13 defined by the passage-defining conductor surface 111, the apparatus 100 can move through the passage 13 with minimal to no interference, or minimal to no contact, with the passage-defining conductor surface 111 due to the reduced overall outer dimension defined by the engager 20 while disposed in the helical configuration 200.

Once the apparatus 100 is deployed to the desired location within the wellbore 10, application of the actuation force by the setting tool (not shown) effects relative displacement between the first free end 30 and the second free end 32. The relative displacement effected between the first free end 30 and the second free end 32 as the apparatus 100 transitions from the engagement-ready state 26 to the engagement state 28, includes relative displacement between the first free end 30 and the second free end 32 of the engager 20 along an axis having a component that is parallel to the central axis 19 of the apparatus 100, as well as relative displacement between the first free end 30 and the second free end 32 in a radially outwardly direction, relative to the central axis 19 of the apparatus 100, such that the first mating surface 34 and the second mating surface 36 become disposed in abutting engagement and the engager 20 transitions from the helical configuration 200 to a configuration wherein the engageable surface 22 defines the engageable surface-defining loop 25 with effect that the apparatus 100 becomes disposed in the engagement state 28. In the engagement state, the engageable surface 22 of the engageable surface-defining loop 25 includes an outermost surface that is spaced apart from the central longitudinal axis 18 of the wellbore 10 by the minimum distance D2, and the minimum distance D2 is greater than the minimum distance D1.

Actuation of the apparatus 100 such that the apparatus 100 transitions from the engagement-ready state 26, wherein the engager 20 is disposed in the helical configuration 200, to the engagement state 28, wherein the engageable surface 22 defines the engageable surface-defining loop 25, is with effect that at least a portion of the engageable surface 22 is displaced further outwardly relative to the central axis 19 of the apparatus 100, relative to the disposition of the engageable surface 22 of the engager 20 while the apparatus 100 is disposed in the engagement-ready state 26. In some embodiments, for example, transitioning of the wellbore completion apparatus 100 from the engagement-ready state 26 to the engagement state 28, with effect that the engageable surface 22 of the engager 20 is displaced further outwardly relative to the central axis 19 of the apparatus 100, is effected, at least in part, by displacement of the engager 20 along a helical path such that the engageable surface-defining loop 25 is established.

Figure 7:
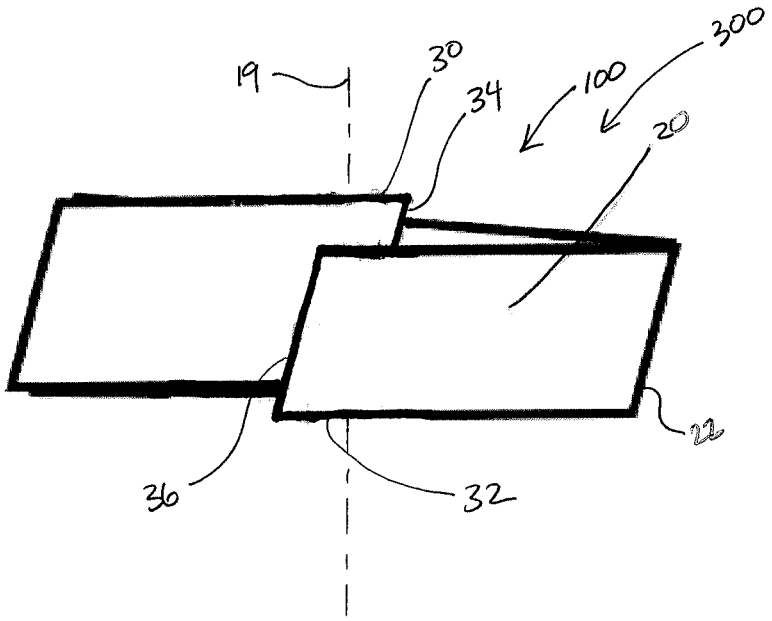
FIG. 7 is a schematic illustration of another example embodiment of a wellbore completion apparatus according to the present disclosure in an engagement-ready state in a spiral-helical configuration.
Figure 7A:
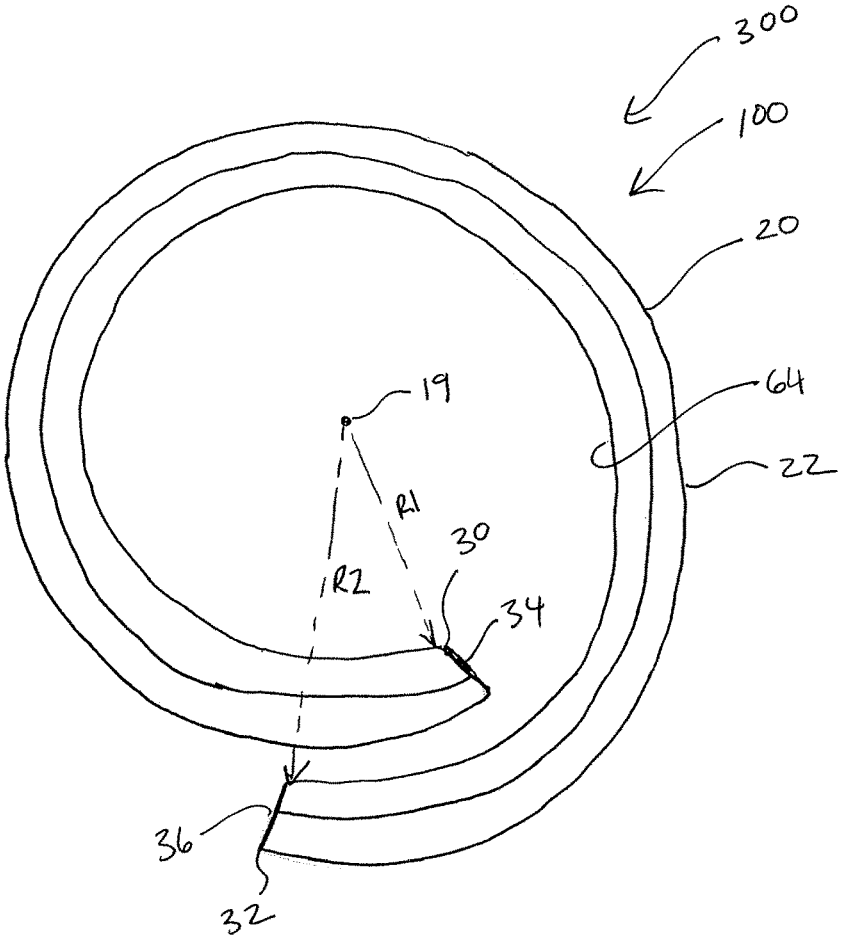
FIG. 7A is a schematic illustration of a top view of the wellbore completion apparatus of FIG. 7.
Figure 7A:
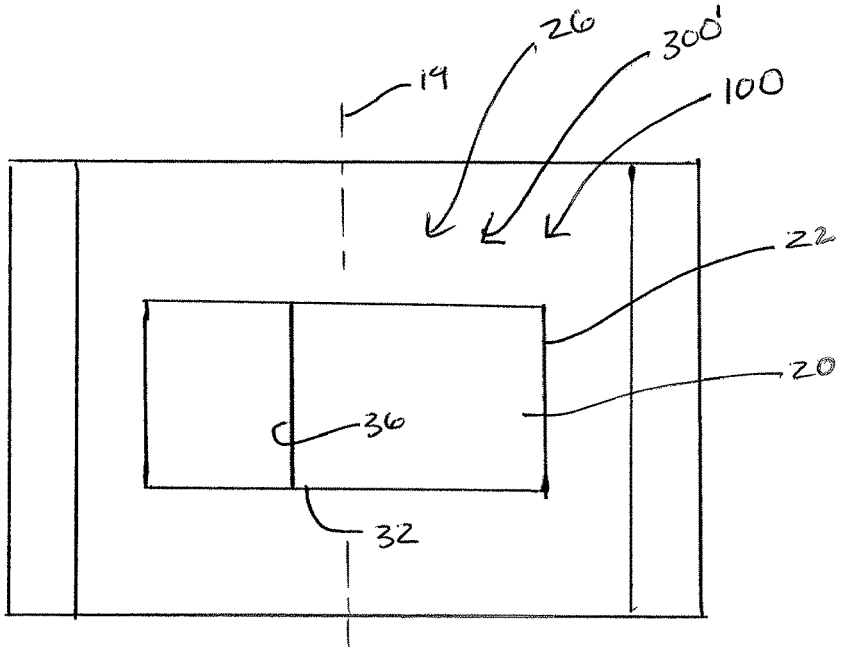
Figure 7A:
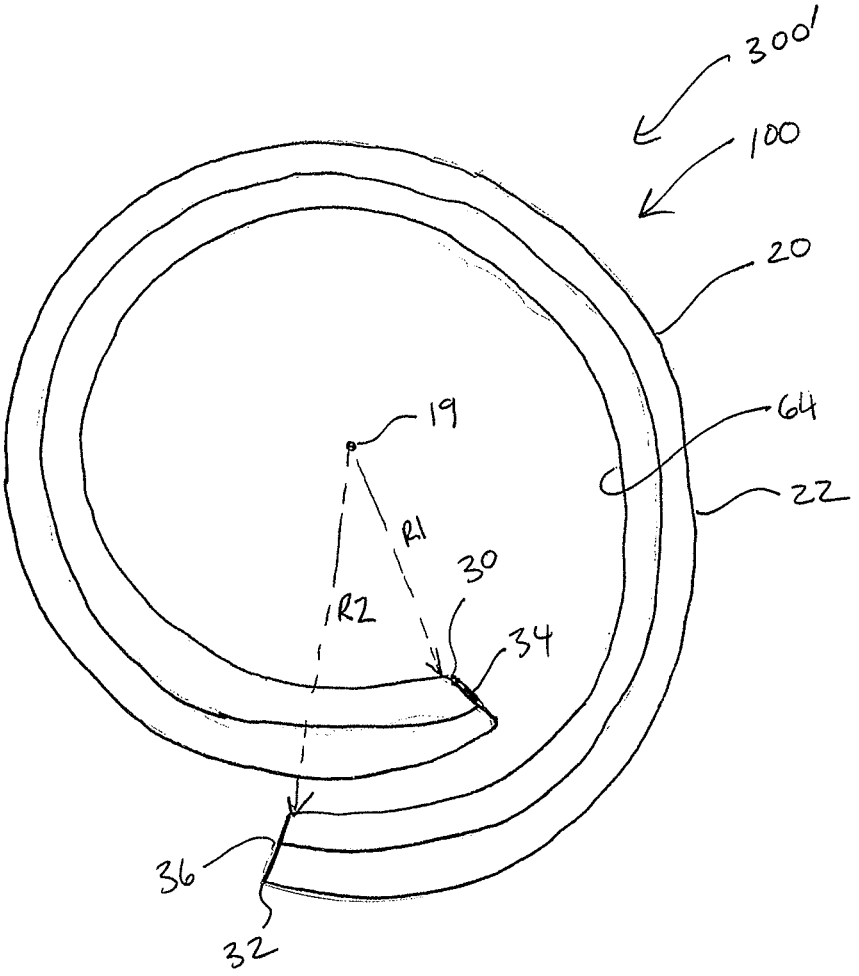

Referring now to the example embodiment illustrated in FIGS. 7 and 7A, in some embodiments, while the apparatus 100 is disposed in the engagement-ready state 26, the apparatus 100 is disposed in a spiral helical configuration 300. Accordingly, while the apparatus 100 is disposed in the engagement-ready state 26, in addition to the first free end 30 and the second free end 32 of the engager 20 being spaced apart from each other along an axis having a component that is parallel to the central axis 19 of the apparatus 100, the first free end 30 and the second free end 32 of the engager 20 are radially spaced apart from each other, relative to the central axis 19 of the apparatus 100, such that the first mating surface 34 is more inwardly disposed relative to the central axis 19 of the apparatus 100 as compared to the second mating surface 36 defined by the second free end 32 of the engager 20. Accordingly, as illustrated schematically in FIG. 7, while the apparatus 100 is disposed in the engagement-ready state 26, the first free end 30 of the engager 20 is disposed further uphole relative to the second free end 32 of the engager 20, while also being more inwardly disposed, relative to the central axis 19 of the apparatus 100, relative to the disposition of the second free end 32 of the engager 36. More specifically, as illustrated schematically in FIG. 7A, while the apparatus 100 is disposed in the engagement-ready state 26, the first free end 30 is spaced from the central axis 19 of the apparatus 100 by a first distance, R1 (that is measured along an axis that is perpendicular to the central axis 19), while the second free end 32 is spaced from the central axis 19 of the apparatus 100 by a second distance, R2 (that is measured along an axis that is perpendicular to the central axis 19), wherein R2 is greater than R1. Accordingly, the first mating surface 34 defined by the first free end 30 of the engager 20 is more inwardly disposed, relative to the central axis 19 of the apparatus 100, as compared to the disposition of the second mating surface 36 defined by the second free end 32, relative to the central axis 19 of the apparatus 100.

Actuation of the apparatus 100 such that the apparatus 100 transitions from the engagement-ready state 26, wherein the engager 20 is disposed in the spiral helical configuration 300, to the engagement state 28, wherein the engageable surface 20 defines the engageable surface-defining loop 25, is effected by relative displacement, between the first free end 30 and the second free end 32 of the engager 20, along an axis having a component that is parallel to the central axis of the apparatus 100, as well as relative displacement between the first free end 30 and the second free end 32 of the engager 20 in a radially outwardly direction, relative to the central axis 19 of the apparatus 100, such that the first mating surface 34 and the second mating surface 36 become disposed in abutting engagement. In some embodiments, for example, transitioning of the apparatus 100 from the engagement-ready state 26 to the engagement state 28 is effected by displacement of the engager 20, relative to the central axis 19 of the apparatus 100, along a spiral-helical path.

Referring now to FIGS. 7AA and 7AB, in some embodiments, for example, while the apparatus 100 is disposed in the engagement-ready state 26, the apparatus 100 is disposed in a spiral configuration 300'. In such example embodiments, while the apparatus 100 is disposed in the engagement-ready state 26, the first free end 30 and the second free end 32 of the engager 20 are radially spaced apart from each other, relative to the central axis 19 of the apparatus 100, such that the first free end 30 is more inwardly disposed relative to the central axis 19 of the apparatus 100 (by the first radial distance R1) as compared to the second free end 32 (by the second radial distance R2) while the first free end 30 and the second free end 32 of the engager 20 are both disposed within the same plane that is normal to the central axis 19 of the apparatus 100. Therefore, the first free end 30 and the second free end 32 would be spaced apart from one another along an axis that is characterized by: (i) a component that is parallel to an axis that is normal to the central axis 19 of the apparatus 100, and (ii) the absence of a component that is parallel to the central axis 19 of the apparatus 100. Accordingly, in such example embodiments, actuation of the apparatus 100 such that it transitions from the engagement-ready state 26, wherein the engager 20 is disposed in a spiral configuration 300', to the engagement state 28, wherein the engageable surface defines the engageable surface-defining loop 25, is effected by outward displacement of the engager 20, relative to the central axis 19 of the apparatus 100, along a spiral path until the engageable surface-defining loop 25 is defined.

Figure 4:
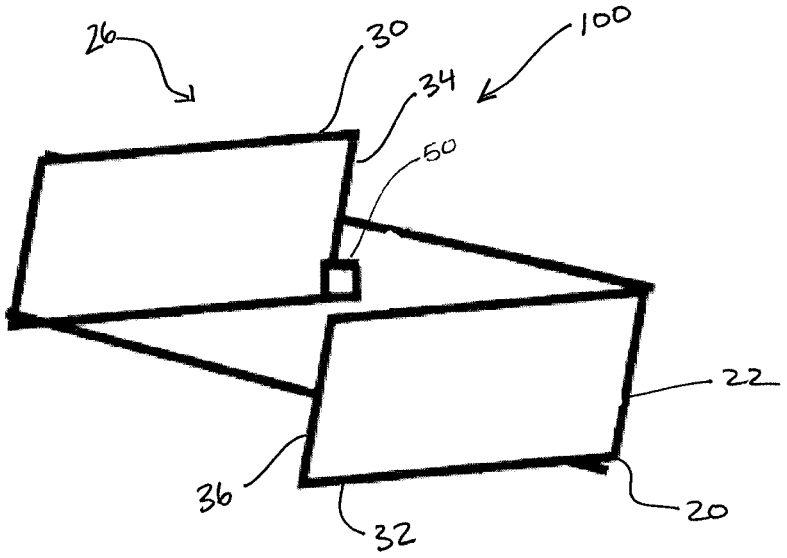
FIG. 4 is a schematic illustration of another example embodiment of a wellbore completion apparatus according to the present disclosure in an engagement-ready state.

With reference now to the example embodiment illustrated in FIG. 4, in some embodiments, the wellbore completion apparatus 100 includes features for preventing the unintentional transitioning of the apparatus 100 from the engagement-ready state 26 to the engagement state 28. More specifically, in some embodiments, the apparatus 100 includes an interference member, which serves to prevent the unintentional actuation of the apparatus 100 from the engagement-ready state 26 to the engagement state 28. The interference member 50 can be incorporated into the apparatus 100 for any of the previously described embodiments wherein the engager 20 includes first and second free ends 30, 32 that are spaced apart from each other, while the apparatus 100 is disposed in the engagement-ready state 26, and whether the apparatus 100 is disposed in a helical configuration (as shown for example in FIG. 1), a spiral-helical configuration 300 (as shown in FIG. 7) or a spiral configuration 300' (as shown in FIG. 7AA).

Referring now to the example embodiment of FIG. 4, in some embodiments, one of the first free end 30 and the second free end 32 of the engager 20 of the apparatus 100 includes an interference member 50 that projects from one of the first or second mating surface 34, 36 of the one of the first or second free end 30, 32. With specific reference to the example embodiment illustrated in FIG. 4, the first free end 30 of the engager 20 includes the interference member 50, the interference member 50 extending or projecting from the first mating surface 34 defined by the first free end 30.

While the apparatus 100 is disposed in the engagement-ready state 26, as illustrated in FIG. 4, the first free end 30 and the second free end 32 of the engager 20 are spaced apart from each other such that the interference member 50 is spaced apart from and disposed out of contact with the second free end 32 of the engager 20. In some embodiments, the first free end 30 and the second free end 32 are spaced apart from each other along an axis having a component that is parallel to the central axis 19 of the apparatus 100 such that the interference member 50 defined by the first free end 30 is spaced apart from the second free end 32 along an axis having a component parallel to the central axis 19 of the apparatus 100. In some embodiments, for example, the first free end 30 and the second free end 32 are spaced apart from each other radially relative to the central axis 19 of the apparatus 100 such that the first free end 30 is more inwardly disposed relative to the second free end 32, relative to the central axis of the apparatus 100. In such embodiments, the interference member 50 defined by the first free end 30 is inwardly disposed relative to the second free end 32, relative to the central axis 19 of the apparatus 100. In some embodiments, for example, the first free end 30 and the second free end 32 are spaced apart from each other along an axis having a component that is parallel to the central axis of the apparatus 100 as well as along an axis having a component that is normal to the central axis 19 of the apparatus 100.

The interference member 50 is configured such that transitioning of the apparatus 100 into the engagement state 28, from the engagement-ready state 26, prior to transmission of an actuation force that exceeds a predetermined threshold amount (or that is less than the required actuation force for actuation of the apparatus 100), is prevented by interference between the interference member 50 and the second free end 32 of the engager 20. More specifically, the interference member 50 is configured such that, in the event that a force is applied to the apparatus 100, while the apparatus 100 is disposed in the engagement-ready state 26, that is sufficient to effect relative displacement between the first free end 30 and the second free end 32 of the engager 20, but that is less than the actual required actuation force necessary to effect actuation of the apparatus 100 into the engagement state 28, the relative displacement between the first free end 30 and the second free end 32 of the engageable-surface-defining portion 20 will be limited by interference between the interference member 50 impinging against the second free end 32 of the engager 20. Therefore, disposition of the apparatus 100 into the engagement state 28 such that the first mating surface 34 defined by the first free end 30 and the second mating surface 36 defined by the second free end 32 are brought into abutting engagement 37 such that the engageable surface-defining loop 25 is established, is effected only once an actuation force that exceeds a predetermined threshold amount, or that is equal to or greater than the predetermined actuation force required to actuate the apparatus 100, is applied to the apparatus 100 by the setting tool. Accordingly, application of a force that exceeds the predetermined threshold amount, or that is at least equal to the predetermined actuation force required to actuate the apparatus 100, as applied by the setting tool, effects shearing of the interference member 50 from the first free end 30 of the engager 20 as the interference member 50 impinges against the second free end 32 of the engager 20. The shearing of the interference member 50 from the first free end 30 of the engager 20 allows further relative displacement between the first free end 30 and the second free end 32, which further relative displacement establishes the engageable surface-defining loop 25 such that the apparatus 100 is disposed in the engagement state 28. In some embodiments, the shearing of the interference member 50 from the first free end 30 of the engager 20 is effected in response to relative displacement between the first free end 30 and the second free end 32 along an axis having a component that is parallel to the central axis 19 of the apparatus 100. In some embodiments, the shearing of the interference member 50 from the first free end 30 of the engager 20 is effected in response to relative displacement between the first free end 30 and the second free end 32 along an axis having a component that is normal to the central axis 19 of the apparatus 100. In some embodiments, for example, the shearing of the interference member 50 from the first free end 30 of the engager 20 is effected in response to relative displacement between the first free end 30 and the second free end 32 that is effected along an axis having a component that is parallel to the central axis 19 of the apparatus 100 and along an axis having a component that is normal to the central axis 19 of the apparatus 100. The shearing of the interference member 50 from the first free end 30 of the engager 20 allows further relative displacement between the first free end 30 and the second free end 32 which further relative displacement brings the first mating surface 34, defined by the first free end 30, and the second mating surface 36, defined by the second free end 32, into abutting engagement 37 such that the apparatus 100 becomes disposed in the engagement state 28, with effect that the engageable surface-defining loop 25 is established. In some embodiments, for example, the interference member 50 includes a shear pin. In some embodiments, for example, the inclusion of an interference member 50 serves to reduce the likelihood of the wellbore apparatus 100 transitioning to the engagement state 26 as it is being run-in-hole prior to the apparatus 100 being deployed to the desired location within the wellbore 10. In some embodiments, for example, the predetermined threshold force required to shear the interference member 50 is at least 500 lb. In some of these embodiments, for example, the predetermined threshold force required to shear the interference member 50 is less than 25,000 lbf.

Figure 10:
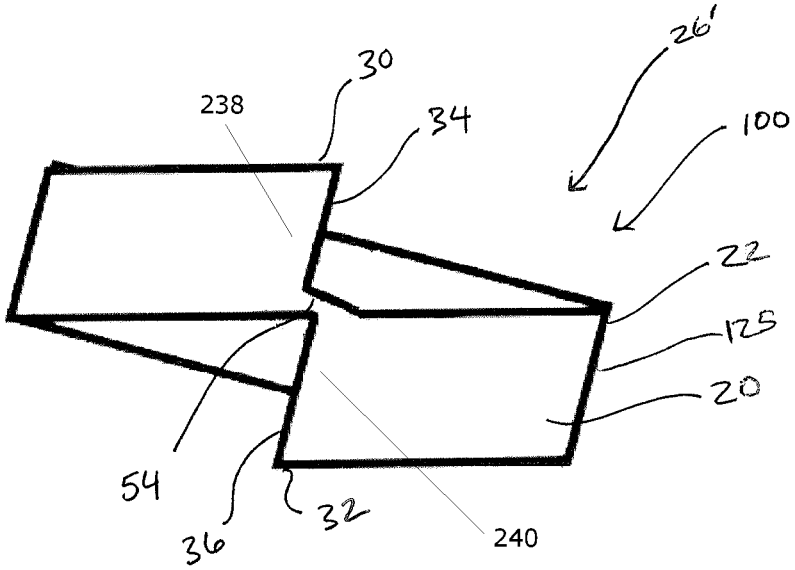
FIG. 10 is a schematic illustration of another example embodiment of a wellbore completion apparatus according to the present disclosure in an initiation state.

Referring now to FIG. 10, in some embodiments, for example, in order to prevent unintentional actuation of the apparatus 100 such that the apparatus 100 transitions to the engagement state 28 prior to transmission of an actuation force to the apparatus 100 that exceeds the predetermined threshold amount, the wellbore completion apparatus 100 is configured for deployment within the wellbore 10 in an initiation state 26'. In the initiation state, there is an absence of the first free end 30 and the second free end 32. In some embodiments, for example, while the apparatus 100 is disposed in the initiation state 26', the engager 20 is defined by an initiation state-defined loop 125. Accordingly, in some embodiments, for example, while the apparatus 100 is disposed in the initiation state 26' and the engager 20 is defined by the initiation state-defined loop 125, a first end portion 238 of the engager 20 and a second end portion 240 of the engager are interconnected. In some embodiments, for example, the engager 20 includes a frangible portion 54, wherein the frangible portion 54 defines the interconnection between the first end portion 238 and the second end portion 240. In such example embodiments, the frangible portion 54 that establishes the interconnection between the first end portion 238 and the second end portion 240 is configured such that relative displacement between the first end portion 238 and the second end portion 240 is resisted.

Figure 10A:
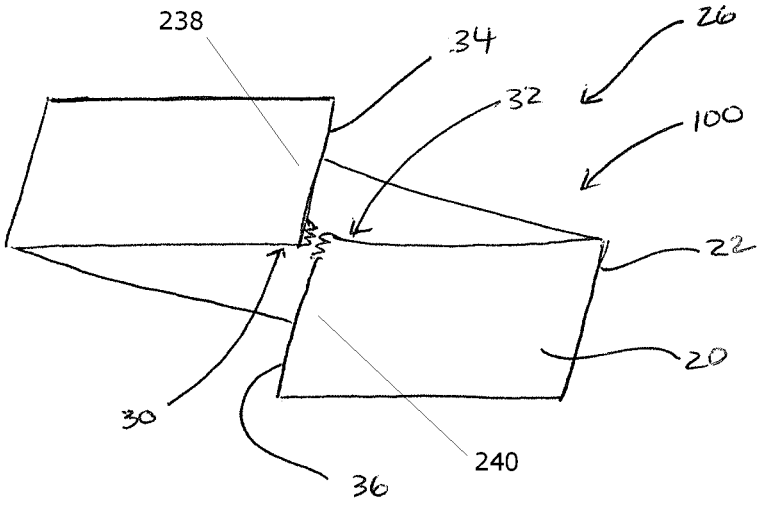
FIG. 10A is a schematic illustration of the wellbore completion apparatus of FIG. 10 in the engagement-ready state.
Figure 10A:
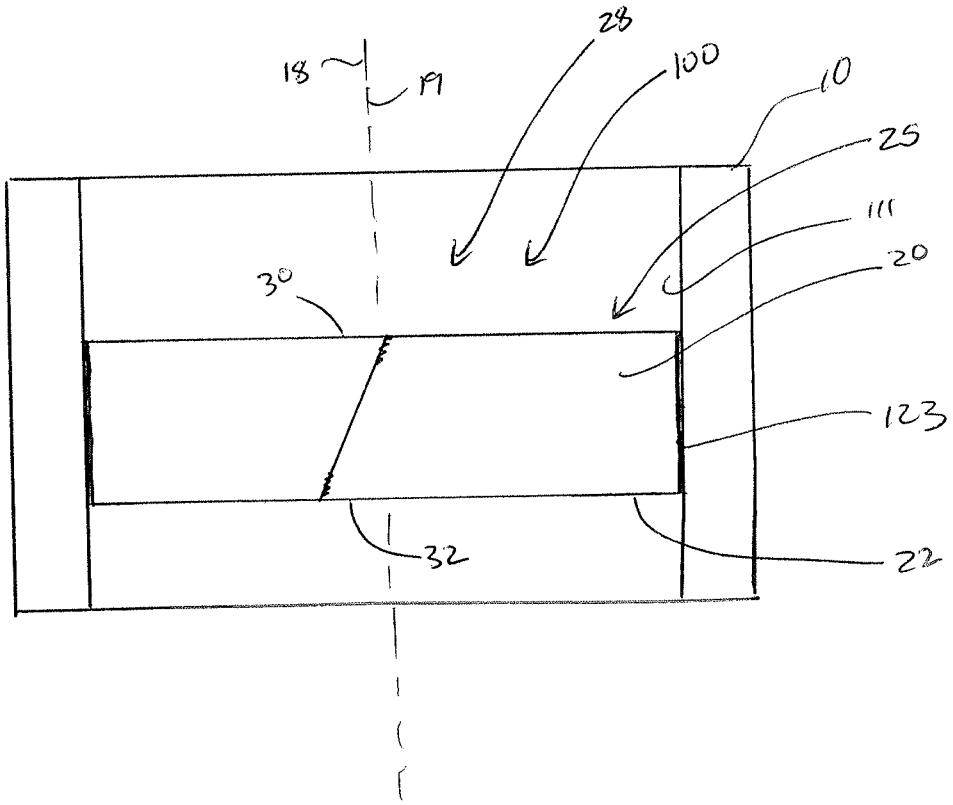

In order to effect transitioning of the apparatus 100 illustrated in FIG. 10 into the engagement state 28, application of a force, or an applied stimulus, that exceeds the predetermined threshold amount is required in order to fracture or defeat the frangible portion 54 of the engager 20. Accordingly, in some embodiments, for example, while the wellbore completion apparatus 100 is disposed in the initiation state 26', the apparatus 100 is configured to cooperate with an applied stimulus, for example an applied stimulus transmitted to the apparatus 100 via the setting tool, such that, in response to receiving the applied stimulus, the apparatus transitions from the initiation state 26' to the engagement-ready state 26. Once the frangible portion 54 is defeated, the first end portion 238 is separated from the second end portion 240 such that the first free end 30 and the second free end 32 are established, as illustrated, for example, in FIG. 10A, and the first free end 30 and the second free end 32 are displaceable relative to one another. Accordingly, in some embodiments, for example, once the applied stimulus is received by the apparatus 100, the frangible portion 54 is defeated with effect that the first free end 30 of the engager 20 and the second free end 32 of the engager 20 are established and disposed for relative displacement relative to one another such that the apparatus 100 is disposed in the engagement-ready state 26. Once the frangible portion 54 of the engager 20 is defeated and the apparatus 100 is disposed in the engagement-ready state 26, relative displacement between the first free end 30 and the second free end 32 of the engageable-surface-defining portion 20 is effectible such that transitioning of the apparatus 100 from the engagement-ready state 26 to the engagement state 28 is permitted. Accordingly, defeating of the frangible portion 54 of the engager 20 is with effect that there is an absence of connection between as illustrated, for example, in FIG. 10A such that relative displacement between the first free end 30 and the second free end 32 is permissible. Relative displacement between the first free end 30 and the second free end 32 is with effect that at least a portion of the engageable surface 22 of the engager 20 is displaced further outwardly relative to the central axis 19 of the apparatus 100 and the engageable surface-defining loop 25 is established. In some embodiments, for example, defeating of the frangible portion 54 of the engager 20, in response to the application of the predetermined threshold force, or applied stimulus, applied to the apparatus 100 by the setting tool, is with effect that the first free end 30 of the engager 20 and the second free end 32 of the engager 20 are established and disposed for displacement relative to one another such that the first mating surface 34 defined by the first free end 30, and the second mating surface 36 defined by the second free end 32 can be displaced into abutting engagement 37 in response to application of the required actuation force, applied to the apparatus 100 by the setting tool, for transitioning the apparatus 100 from the engagement-ready state 20 to the engagement state 28. In some embodiments, for example, defeating of the frangible portion 54 includes shearing of a connection between as illustrated, for example, in FIG. 10A such that the first free end 30 and the second free end 32 of the engager 20 are defined and the displaceability of the first free end 30 relative to the second free end 32 is established. In some embodiments, for example, the predetermined threshold force required to defeat the frangible portion 54 of the engager 20 is at least 50 lbf. In some of these embodiments, for example, the predetermined threshold force required to defeat the frangible portion 54 of the engager 20 is less than 25,000 lbf.

In some embodiments, for example, while the apparatus 100 is disposed in the initiation state 26', the engager 20 is defined by the initiation state loop 125 wherein the initiation state-defined loop 125 is established by the frangible portion 54 that extends between and interconnects the first mating surface 34 and the second mating surface 36. Transitioning of the apparatus 100 from the initiation state 26' to the engagement state 28, via the engagement-ready state 26, is with effect that the engager 20 transitions from the initiation state-defined loop 125 to the engageable surface-defining loop 25. Accordingly, in such example embodiments, the engageable surface defined loop 25 is established in response to relative displacement between the first free end 30 and the second free end 32, once the frangible portion 54 of the engager 20 has been defeated. Transitioning of the engager 20 from the initiation state-defined loop 125 to the engageable surface-defining loop 25 is such that the engageable surface 22, defined by the engager 20, that establishes the engageable surface defining loop 25, is displaced further outwardly relative to the central axis 19 of the apparatus 100 relative to the disposition of the engageable surface 22 of the engager 20, relative to the central axis 19 of the apparatus 100, that establishes the initiation state-defined loop 125. Accordingly, while the apparatus 100 is disposed in the initiation state 26' and the apparatus 100 is being deployed within the wellbore 10, the outermost surface of the engageable surface 22 of the engager 20 that establishes the initiation state-defined loop 125, is spaced apart from the central axis of the apparatus 19 by the minimum distance D1 (a distance that is measured along an axis that is perpendicular to the central axis 19) that is less than the distance required to effect engagement between the engageable surface 22 and the passage-defining conductor surface 111 of the wellbore 10.

Figure 9:
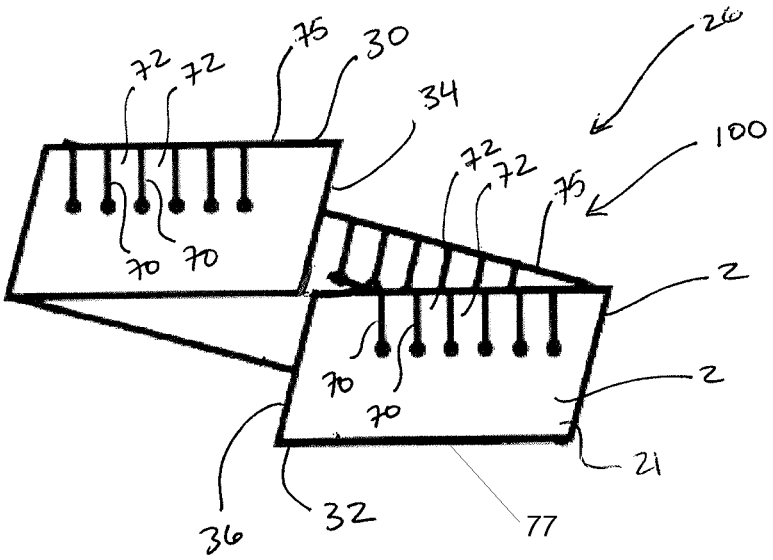
FIG. 9 is a schematic illustration of another example embodiment of a wellbore completion apparatus according to the present disclosure in an engagement-ready state.

Referring now to FIG. 9, in some embodiments, for example, the wellbore completion apparatus 100 includes a plurality of slits 70 disposed in spaced apart arrangement along the engager 20 between the first free end 30 and the second free end 32 of the engager 20. The slits 70 are disposed at spaced apart intervals along the engager 20 and extend downwardly from an upper edge 75 of the engager 20 into the body or the substrate 21 that defines the engager 20 of the apparatus 100. The plurality of slits 70 define a plurality of grippers 72 disposed about the upper perimeter of the engager 20, each gripper 72 being defined by the portion of the engager 20 that is disposed between adjacent slits 70 of the plurality of slits 70. Prior to actuation of the apparatus 100, the grippers 72 are disposed, generally, in alignment with the outer surface 22 of the engager 20, as illustrated in FIG. 9.

As in the previously described embodiments, transitioning of the apparatus 100 from the engagement-ready state 26 to the engagement state 28 is effected by relative displacement between the first free end 30 and the second free end 32 with effect that the engageable surface 22 of the engager 20 becomes disposed further outwardly relative to the central axis 19 of the apparatus 100 as a result of the deformation of the engager 20 that occurs in response to application of the actuation force to the apparatus 100 via the setting tool. In the subject example embodiment, deformation of the engager 20 in response to the application of the actuation force effects outward flaring of the grippers 72 that are disposed about the upper perimeter of the engager 20 relative to the central axis 19 of the apparatus 100. The outward flaring of the grippers 72 relative to the central axis 19 of the apparatus 100 provides an increased gripping effect between the engageable surface 22 and the conductor surface-defined loop 123 by further increasing the interference fit that is effected between the engageable surface 22 and the conductor surface-defined loop 123. In some instances, the grippers 72 provide an increased gripping effect and increased sealing effect between the engageable surface 22 of the engager 20 and the conductor surface-defined loop 123 as the apparatus 100 transitions from the engagement-ready state 26 to the engagement state 28 since the plurality of slits 70 disposed about the upper edge 75 of the engager 20 increases the overall deformability of the engager 20 of the apparatus 100, which increased deformability facilitates deformation of the engager 20 as the apparatus 100 transitions from the engagement-ready state 26 to the engagement state 28. By increasing the deformability of the upper edge of the engager 20 due to the inclusion of the plurality of slits 70 that define the grippers 72, the individual grippers 72 each, independently, deform more easily in response to application of the same actuation force with effect that increased deformation about the upper edge or upper perimeter of the engager 20 occurs. The increased deformation about the upper edge or upper perimeter of the engager 20, that results from the deformation of the individual grippers 72, increases the gripping engagement and the sealing engagement that is established between the engageable surface 22 and the conductor surface-defined loop 123 once the apparatus 100 is disposed in the engagement state 28. In some embodiments, for example, the engager 20 of the wellbore completion apparatus 100 includes a plurality of slits 70 disposed in spaced apart arrangement along a bottom or lower edge surface 77 of the engager 20 between the first free end 30 and the second free end 32 of the engager 20 with the slits 70 extending upwardly from the lower edge surface of the engager 20 into the body or the substrate 21 that defines the engager 20 of the wellbore completion apparatus 100, as shown for instance in the example embodiment of FIG. 41. In some embodiments, for example, the engager 20 includes a plurality of slits 70 disposed in spaced apart arrangement along the upper edge surface 75 of the engager 20 between the first free end 30 and the second free end 32 of the engager 20 as well as a plurality of slits 70 disposed in spaced apart arrangement along a bottom or lower edge surface of the engager 20 between the first free end 30 and the second free end 32 of the engager 20.

Figure 45:
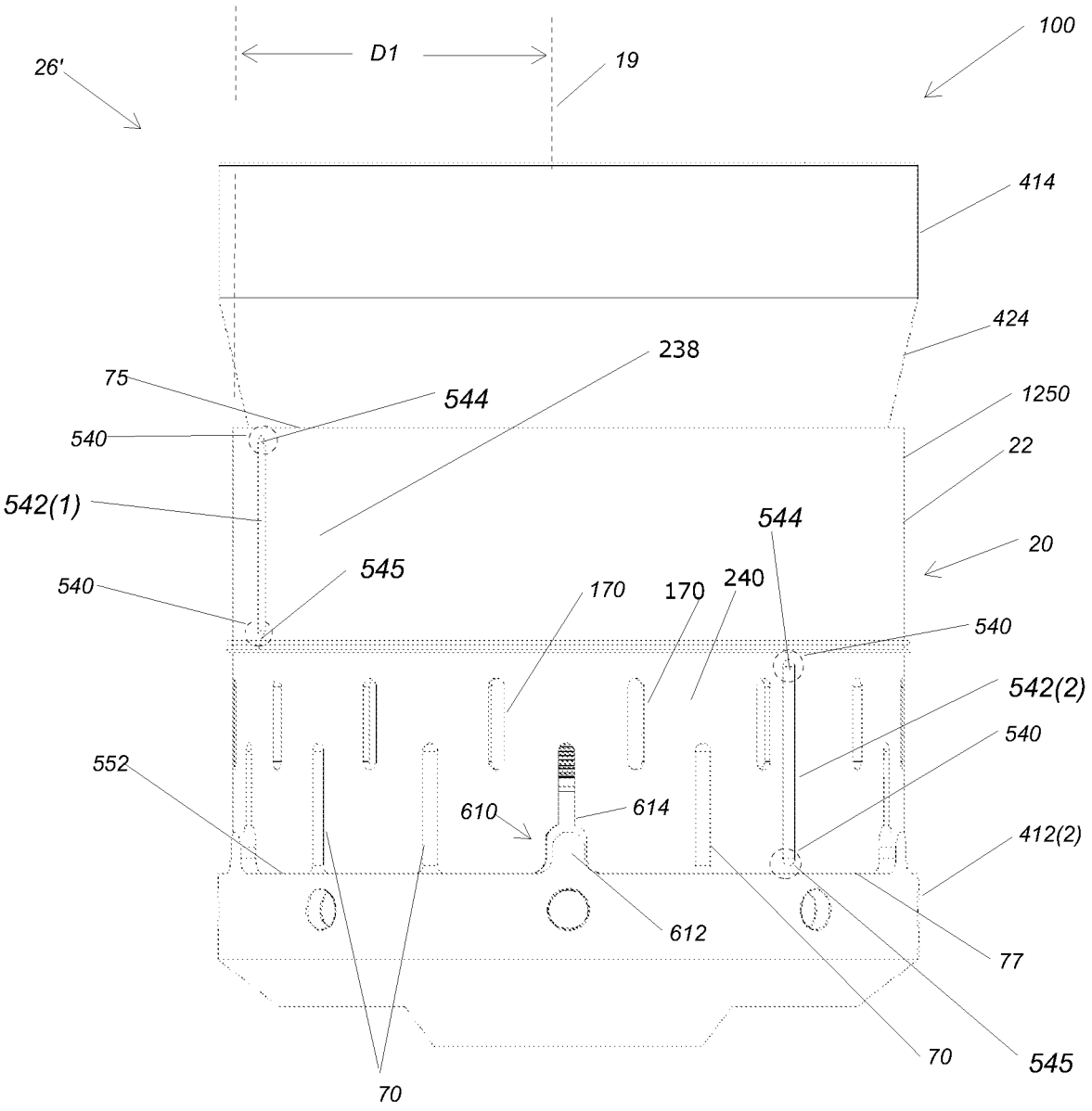
FIG. 45 is a front view of a wellbore completion apparatus according to another example embodiment of the present disclosure disposed in an initiation state, similar to the embodiment of FIG. 41.
Figure 46:
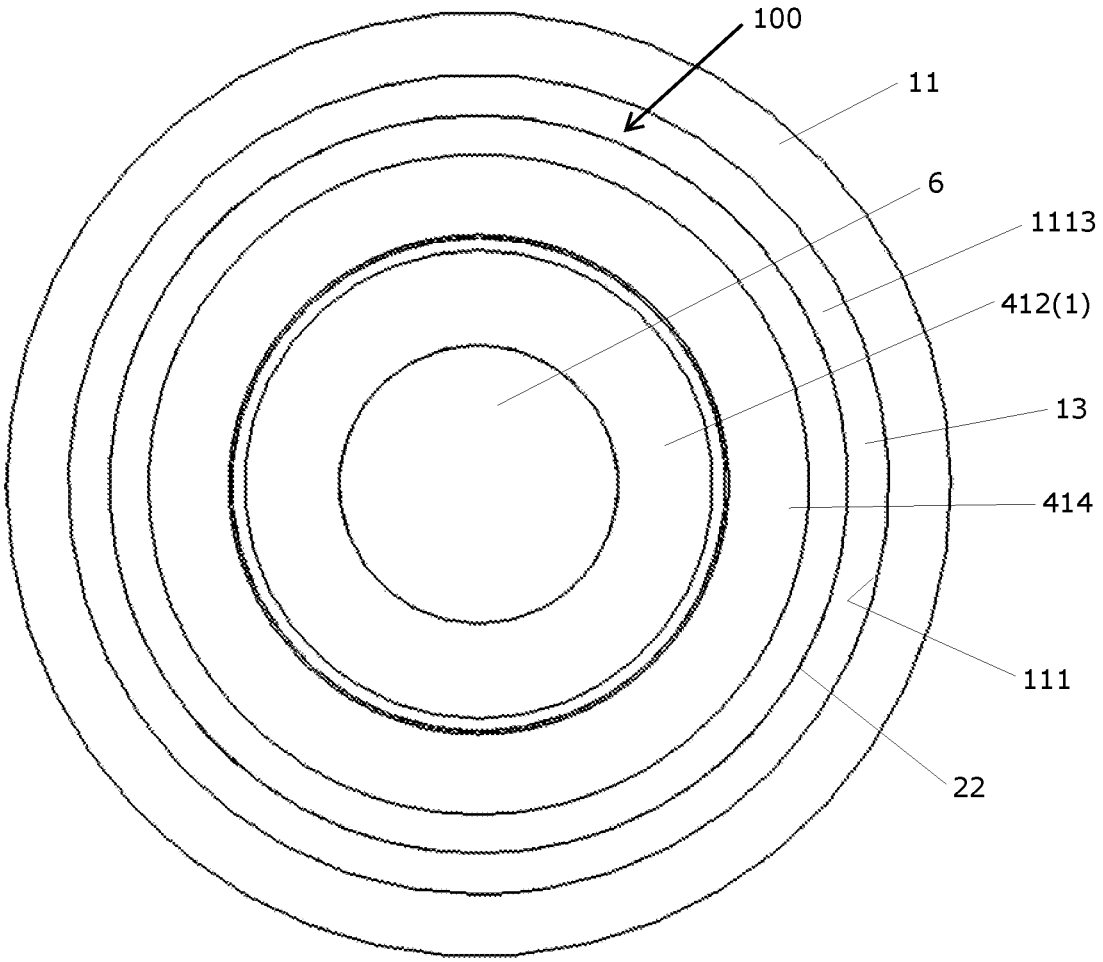
FIG. 46 is a top plan view of the wellbore completion apparatus of FIG. 41 disposed in the initiation state, and within the casing of a wellbore during run-in-hole (RIH)
Figure 47:
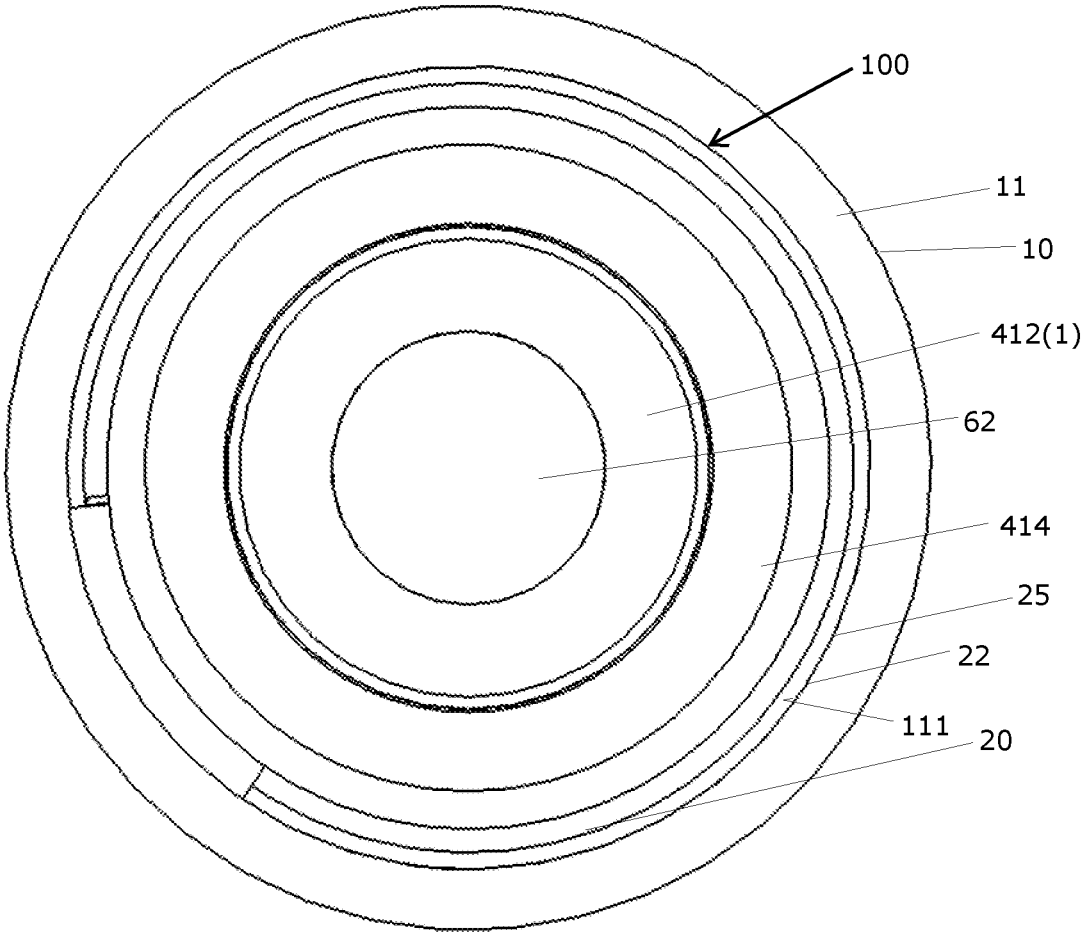
FIG. 47 is a top plan view of the wellbore completion apparatus of FIG. 41, disposed within the casing of a wellbore, in the engagement state.
Figure 48:
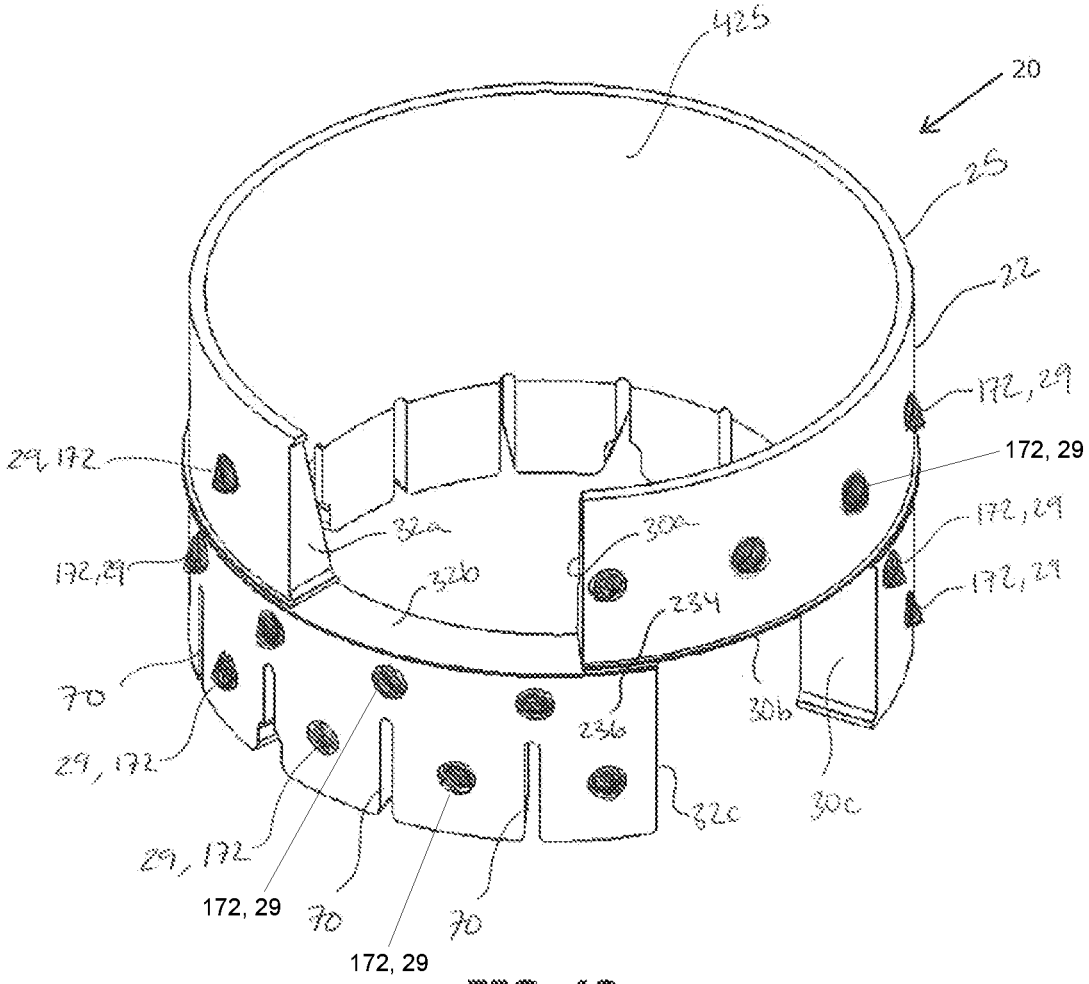
FIG. 48 is a top perspective view of the engager, of the wellbore completion apparatus shown in FIG. 43B, disposed in the engaged state.

In some embodiments, for example, rather that providing a plurality of slits 70 that are disposed at spaced apart intervals along the upper edge surface 75 of the engager 20 and that extend downwardly from the upper edge surface 75 of the engager 20 into the body or the substrate 21 that defines the engager 20, the engager 20 includes a plurality of slots 170 disposed at spaced apart intervals about the engager 20 such that the plurality of slots 170 are disposed between the first free end 30 and the second free end 32 of the engager 20, as shown, for instance, in the example embodiment illustrated in FIG. 45. In some embodiments, for example, the slots 170 define narrow, elongated openings that extend through the body or substrate 21 that defines the engager 20 of the wellbore completion apparatus 100 from the outer, engageable surface 22 to an inner surface of the engager 20 that is disposed opposite to the engageable surface 22. The plurality of slots 170 are configured and co-operatively disposed about the engager 20 for reducing stress concentrations within the substrate 21 that defines the engager 20 during actuation of the apparatus 100 such that deformation of the engager 20, as the wellbore completion apparatus 100 transitions from the engagement-ready state 26 to the engagement state 28 is facilitated or enhanced.

Referring now to FIGS. 16-24, 32-33, 35-39, and FIGS. 41-48, there are shown example embodiments of the wellbore completion apparatus 100 wherein the wellbore completion apparatus 100 includes an actuating assembly 400 that includes a mandrel 412 and an actuator 414. In such example embodiments, the engager 20 and the actuating assembly 400 are co-operatively configured for co-operative disposition in an engagement-ready state 26 and engagement state 28. In some embodiments, for example, the mandrel 412 extends between a first, or upper end 412(1) and a second, or base, end 412(2) that is disposed opposite to the first end 412(1), and defines the flow communicator 6, in the form of a central passageway 166 extending through the mandrel 412 between the first and second free ends 412(1), 412(2). In such example embodiments, the engager 20 and the actuating assembly 400 are co-operatively configured such that the engager 20 is disposed, or mounted, on the mandrel 412 of the actuating assembly 400 such that a first or upper end 412(1) of the mandrel 412 extends through a central opening or passageway 66 defined by the inner surface 64 of the engager 20, while the engager 20 is disposed in the engagement-ready state 26. The actuator 414 is configured for disposition on the mandrel 412 such that the first or upper end 412(1) of the mandrel 412 extends through a central opening 417 that extends through the actuator 414. Accordingly, in such example embodiments, the engager 20 is disposed on the mandrel 412 and the actuator 414 is disposed on the mandrel 412 such that the engager 20 is disposed intermediate the second, or base end 412(2) of the mandrel 412 and the actuator 414. In some embodiments, for example, the second, or base end 412(2) of the mandrel 412 includes an engager displacement impeder 550 that is configured for preventing downward displacement of the engager 20 relative to the mandrel 412. Accordingly, in some embodiments, for example, the engager displacement impeder 550 is configured such that while the engager 20 is disposed on the mandrel 412, the engager 20 is positioned on the mandrel 412 intermediate the engager displacement impeder 550 defined by the second end 412(2) of the mandrel 412 and the actuator 414. In some embodiments, for example, the engager displacement impeder 550 is defined by an outer surface of the second, or base end 412(2) of the mandrel 412, wherein the outer surface is an angled surface that extends downwardly and outwardly away, relative to the central longitudinal axis 19 of the apparatus 100, as shown for instance in the example embodiments illustrated in FIGS. 16-19, 20-22, 23-24, 32-33 and 35-39. In such example embodiments, the engager displacement impeder 550 extends downwardly and outwardly away, relative to the central axis 19 of the apparatus 100 such that the outermost portion of the angled surface, relative to the central axis 19 of the apparatus 100, defines the maximum amount of travel of the engager 20 relative to the mandrel 412 that may be effected in response to application of the actuation force to the actuating assembly, via the setting tool. In some embodiments, for example, the second, base end 412(2) of the mandrel 412 is configured such that the engager displacement impeder 550 is defined by a stop or shoulder surface 552 as illustrated, for example, in the example embodiment of FIGS. 41-44. In such example embodiments, the engager 20 is disposed on the mandrel 412 such that the bottom or lower edge surface 77 of the engager 20 is disposed on the shoulder surface 552 defined by the engager displacement impeder 550.

In some embodiments, for example, the actuating assembly 400 is configured for releasable engagement with the setting tool (not shown) of the conveyance apparatus (not shown). Accordingly, in such example embodiment, while the wellbore completion apparatus 100 is being deployed through the passage 13, via the conveyance apparatus, the wellbore completion apparatus 100 is releasably secured to the setting tool via releasable engagement of the actuating assembly 400 with the setting tool. In such example embodiments, while the wellbore completion apparatus 100 is being deployed through the passage 13, the engager 20 and the actuating assembly 400 are co-operatively disposed in the engagement-ready state 26, and application of the actuation force to the wellbore completion apparatus 100, via the setting tool (not shown), is such that the actuation force is applied to the actuating assembly 400. Application of the actuation force to the actuating assembly 400, via the setting tool, effects actuation of the actuating assembly 400 which, in turn, effects deformation of the engager 20 with effect that the apparatus 100 transitions from the engagement-ready state 26 to the engagement state 28, such that the engager 20 defines the engageable surface defined loop 25 and the wellbore completion apparatus 100 is released from retention by the setting tool and disposed in engagement with the conductor surface-defined loop 123 of the passage-defining conductor surface 111. Once the wellbore completion apparatus 100 is released from retention by the setting tool with the engager 20 defining the engageable surface defined loop 25 and the engageable surface 22 is disposed in engagement with the conductor surface-defined loop 123 of the passage-defining conductor surface 111, the actuating assembly 400 and the engager 20 are co-operatively disposed in the engagement state 28. While the actuating assembly 400 and the engager 20 are co-operatively disposed in the engagement state 28, the actuating assembly 400 maintains application of an outwardly directed engaging force, relative to the central axis 19 of the apparatus 100 (or the central longitudinal axis of the wellbore 18), on the engager 20, such that the engageable surface 22 engages the conductor surface-defined loop 123 of the passage-defining conductor surface 111 of the wellbore 10 with effect that a sealed interface with the conductor surface-defined loop 123 is established and downward displacement of the wellbore completion apparatus 100 relative to the passage-defining conductor surface 111 is resisted.

Figure 16:
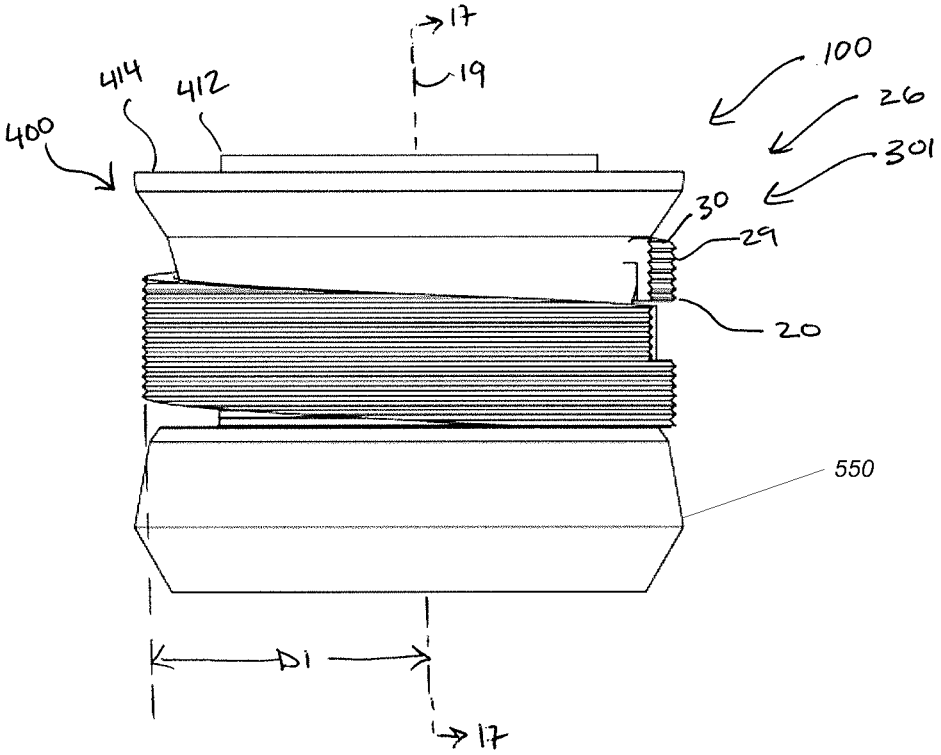
FIG. 16 is a front view of a wellbore completion apparatus according to another example embodiment of the present disclosure disposed in an engagement-ready state.
Figure 17:
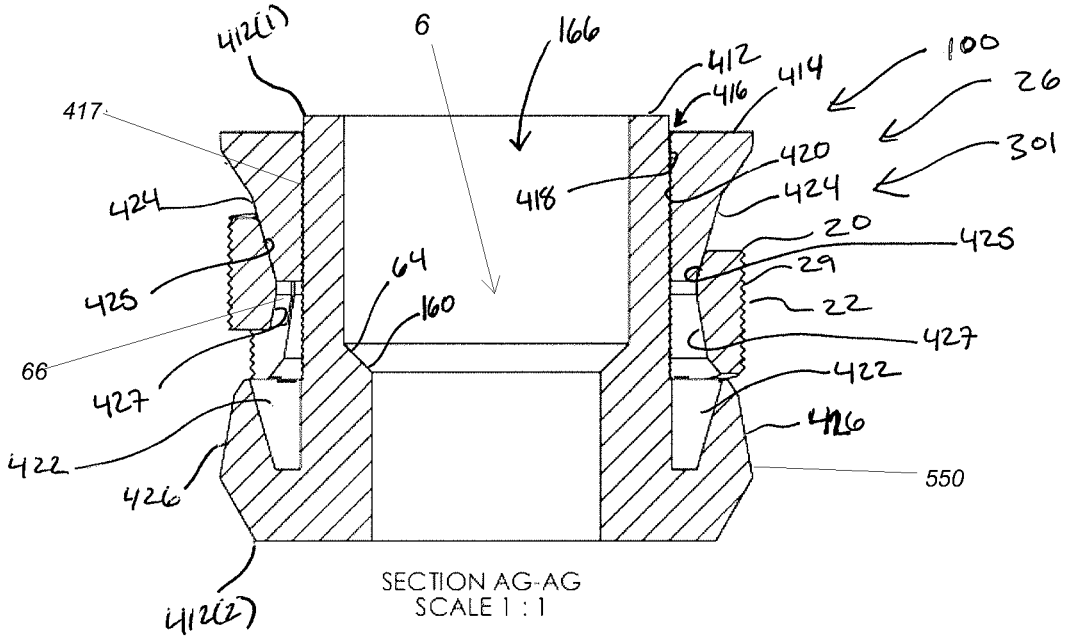
FIG. 17 is a cross-sectional view of the wellbore completion apparatus of FIG. 16 taken along section line 17-17 in FIG. 16.

With reference, in particular, to the example embodiment illustrated in FIGS. 16-19, while the wellbore completion apparatus 100 is disposed in the engagement-ready state 26, as shown in FIGS. 16 and 17, the engager 20 and the actuating assembly 400 are co-operatively disposed in a first configuration 301. In the first configuration 301, the engager 20 is disposed on the mandrel 412 such that the engager 20 extends about the mandrel 412 in a helical configuration 200 such that the first free end 30 of the engager 20 and the second free end 32 of the engager 20 are spaced apart from each other, longitudinally, relative to the central axis 19 of the apparatus 100 such that the first free end 30 and the second free end 32 of the engager 20 are disposed for relative displacement, relative to one another. In some embodiments, for example, while the engager 20 and the actuating assembly 400 are disposed in the first configuration 301 with the engager 20 disposed in a helical configuration 200, the mandrel 412, the engager 20 and the actuator 414 are co-operatively configured such that the engager 20 is mounted on the mandrel 412 such that the first free end 30 of the engager 20 is disposed in contact with the actuator 414 while the second free end 32 of the engager 20 is disposed in contact with the second, or base end 412(2) of the mandrel 412. While the apparatus 100 is disposed in the engagement-ready state 26, the outermost surface of the engageable surface 22, defined by the engager 20, is spaced apart from the central axis 19 of the apparatus 100 by the minimum distance D1 (a distance that is measured along an axis that is perpendicular to the central axis 19).

While the engager 20 and the actuating assembly 400 are co-operatively disposed in the first configuration 301, the actuator 414 is disposed in a first position proximal the first or upper end 412(1) of the mandrel 412. While the actuator 414 is mounted on the mandrel 412 in the first position, proximal the first, or upper end 412(1) of the mandrel 412, the actuating assembly 400 is disposed for receiving the actuation force from the setting tool (not shown). In some embodiments, for example, wellbore completion apparatus 100 is releasably secured to the setting tool via releasable engagement with the actuating assembly 400 such that application of the actuation force to the actuating assembly 400, via the setting tool, is with effect that a portion of the actuation force is applied to the mandrel 412 in a first, or uphole direction while a portion of the actuation force is applied to the actuator 414 in a second, or downhole direction, that is opposite to the first direction for effecting relative displacement between the mandrel 412 and actuator 414. See, for example, the schematic directional arrows included in FIG. 20 which illustrate the application of the actuation force to the actuating assembly 400 via the setting tool. Accordingly, in such example embodiments, application of the actuation force to the actuating assembly 400, in response to application of the actuation force applied to the apparatus 100 by the setting tool (not shown), is with effect that the actuator 414 applies a downhole directed force to the first free end 30 of the engager 20 while the second, or base end 412(2) of the mandrel 412 applies an uphole directed force to the second free end 32 of the engager 20 thereby effecting relative displacement between the first free end 30 and the second free end 32 of the engager 20 as the actuator 414 and mandrel 412 are displaced relative to one another until the engager 20 and the actuating assembly 400 become co-operatively disposed in a second configuration 302, as shown, for example, in FIGS. 18 and 19. In the second configuration 302, the engager 20 and the actuating assembly 400 are co-operatively disposed such that the actuator 414 is disposed in a second position on the mandrel 412, proximal the second or base end 412(2) of the mandrel 412, the engager 20 defines the engageable surface-defining loop 25, and the outermost surface of the engageable surface-defining loop 25 is spaced apart from the central axis 19 of the apparatus 100 by the minimum distance D2 (a distance that is measured along an axis that is perpendicular to the central axis 19), that is greater than the minimum distance D1. Accordingly, while the apparatus 100 is deployed within the wellbore 10 and is disposed in the engagement state 28, such that the engager 20 and the actuating assembly 400 are co-operatively disposed in the second configuration 302 and the apparatus 100 is released from retention by the setting tool, the engageable surface-defining loop 25 is disposed in engagement with the conductor surface-defined loop 123 of the passage-defining conductor surface 111.

In some embodiments, for example, disposition of the apparatus 100 in the engagement state 28, such that the engager 20 and the actuating assembly 400 are disposed in the second configuration 302, is with effect that, the first mating surface 34, defined by the first free end 30, and the second mating surface 36, defined by the second free end 32, are disposed in abutting engagement, with effect that the engageable surface-defining loop 25 is established. Disposition of the first mating surface 34 and the second mating surface 36 in abutting engagement 37 is effected by outward displacement of the engageable surface 22 of the engager 20 relative to the central axis 19 of the apparatus 100, which outward displacement is effected by relative displacement of the mandrel 412 and actuator 414 of the actuating assembly 400 relative to the engager 20 from the first configuration 301 to the second configuration 302.

Figure 18:
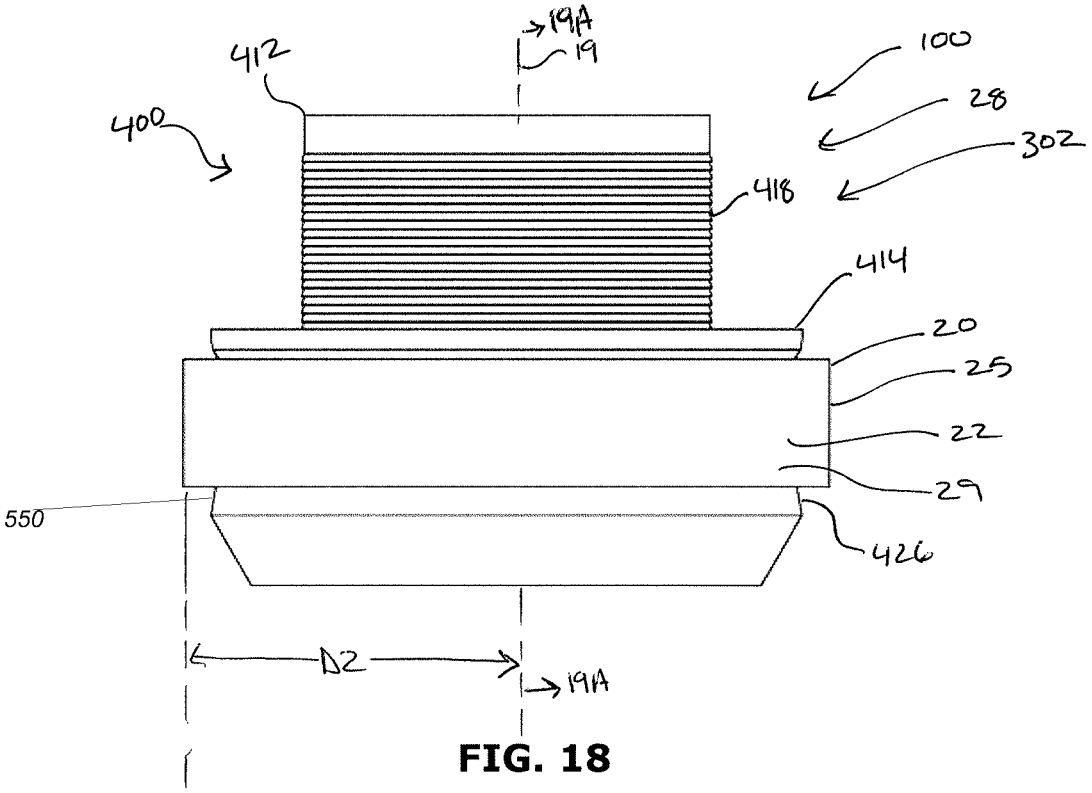
FIG. 18 is a front view of the wellbore completion apparatus of FIG. 16 in the engagement state.
Figure 19:
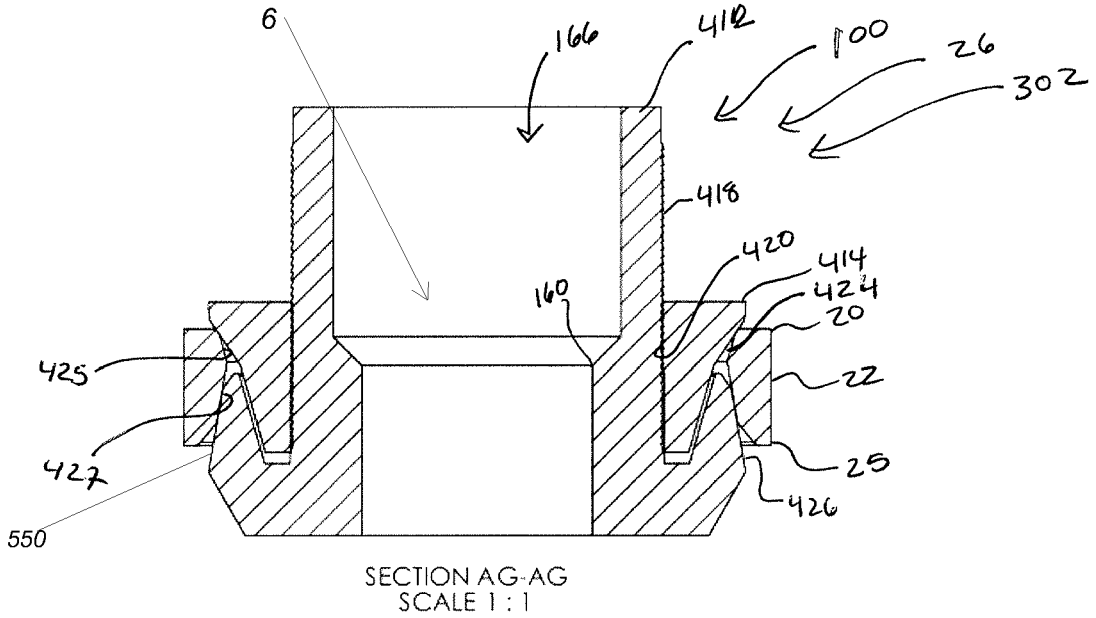
FIG. 19 is a cross-sectional view of the wellbore completion apparatus of FIG. 16 taken along section line 19A-19A shown in FIG. 18.

With reference again to FIGS. 16-19, as described above, in some embodiments, for example, the actuating assembly 400 includes a mandrel 412 and an actuator 414. In some embodiments, the actuator 414 is in the form of an actuator ring. In some embodiments, for example, the actuator 414 is in the form of a C-ring. As shown, the actuator 414 is disposed, or mounted, on the mandrel 412 and configured for displacement relative to the mandrel 412, along the central axis 19 of the apparatus 100. While the apparatus 100 is disposed in the engagement-ready state 26, wherein the engager 20 and the actuating assembly 400 are co-operatively disposed in the first configuration 301, the actuator 414 is disposed on the mandrel 412 in a first position, as illustrated in FIGS. 16 and 17. While the apparatus 100 is disposed in the engagement state 28, such that the engager 20 and the actuating assembly 400 are co-operatively disposed in the second configuration 302, the actuator 414 is disposed on the mandrel 412 in a second position that is downwardly displaced relative to the first position, as illustrated in FIGS. 18 and 19. Relative displacement between the actuator 414 and the mandrel 412, such that the actuator 414 transitions from the first position, proximal the first end 412(1) of the mandrel 412 to the second position, proximal the second end 412(2) of the mandrel 412, is with effect that the apparatus 100 transitions from the engagement-ready state 26 to the engagement state 28. By virtue of this transitioning, the outer surface or engageable surface 22 of the engager 20 is displaced further outwardly relative to the central axis 19 of the apparatus 100, such that the engager 20 is disposed in a configuration that defines the engageable surface-defining loop 25.

In some embodiments, for example, the displacement of the actuator 414 relative to the mandrel 412 from the first position to the second position includes relative displacement of the actuator 414 and mandrel 412 along an axis that is parallel to the central axis 19 of the apparatus 100. In some embodiments, the mandrel 412, the actuator 414 and the engager 20 are co-operatively configured such that displacement of the actuator 414 relative to the mandrel 412 effects wedging of the actuator 414 between an inner surface 64 of the engager 20 and an outer surface of the mandrel 412. The wedging of the actuator 414 between the inner surface 64 of the engager 20 and the outer surface of the mandrel 412 effects outward displacement of the engager 20, relative to the central axis 19 of the apparatus 100, such that the engager 20 transitions from the helical configuration in the engagement-ready state 26 to the configuration defining the engageable surface defined loop 25 in the engagement state 28. In some embodiments, for example, disposition of the apparatus 100 in the engagement state 28 is with effect that the first mating surface 34 of the first free end 30 of the engageble surface-defining portion 20 is disposed in abutting engagement with the second mating surface 36 of the second free end 32 of the engager 20. In some embodiments, for example, actuation of the actuating assembly 400 is with effect that the engager 20 transitions from the helical configuration 200 in the engagement-ready state 26 to a circular configuration in the engagement state 28.

In some embodiments, for example, displacement of the actuator 414 relative to the mandrel 412 includes displacement via meshing of corresponding sets of teeth defined on corresponding surfaces of the mandrel 412 and the actuator 414, as illustrated, for example, in FIGS. 17-19. Accordingly, with reference, in particular to FIG. 17, in some embodiments, for example, the mandrel 412 includes a first set of teeth 418 disposed on an outer surface of the mandrel 412, while the actuator 414 includes a second, corresponding set of teeth 420 defined on a cooperating inner surface of the actuator 414. The actuator 414 is disposed on the mandrel 412 such that the first or upper end 412(1) of the mandrel 412 extends through the central opening 417 defined by the actuator 414 such that the second set of teeth 420 disposed on the inner surface of the actuator 414 is disposed in meshing relationship with the first set of teeth 418 disposed on the outer surface of the mandrel 412.

In some embodiments, for example, the first set of teeth 418 and the second set of teeth 420 are cooperatively configured such that displacement of the actuator 414 relative to the mandrel 412 in a first direction (or downhole direction), relative to the central axis 19 of the apparatus 100 is permitted, while displacement of the actuator 414 relative to the mandrel 414 in a second direction (or uphole direction), relative to the central axis 19 of the apparatus 100 that is opposite to the first direction, is resisted. Accordingly, in some embodiments, for example, relative displacement between the mandrel 412 and the actuator 414 in response to application of the actuation force, via the setting tool, such that the actuator 414 is displaced from the first position relative to the mandrel 412, to the second position, relative to the mandrel 412, is effected via a ratchet mechanism 416.

As described above, in some embodiments, for example, the mandrel 412 extends between a first, or upper end 412(1) and a second, or lower, end 412(2). In some embodiments, for example, the second end 412(2) of the mandrel 412 includes an actuator receiver 422 configured for receiving a portion of the actuator 414 when the actuator 414 is disposed relative to the mandrel 412 in the second position, such that the apparatus 100 is disposed in the engagement state 28, as shown in FIG. 19. While the apparatus 100 is disposed in its engagement-ready state 26, the engager 20, the actuator 414 and the mandrel 412 are co-operatively disposed in their first configuration 301, the actuator 414 is disposed on the mandrel 412 proximal the first end 412(1), as shown in FIG. 17. The actuator receiver 422, defined by the second end 412(2) of the mandrel 412 defines a maximum displacement of the actuator 414 relative to the mandrel 412. Accordingly, the actuator receiver 422 is configured for accommodating a portion of the actuator 414 should the actuator 414 be displaced relative to the mandrel 412 by a distance measured along an axis parallel to the central axis of the apparatus 19 that extends into the actuator receiver 422 as the apparatus 100 transitions into the engagement state 28.

With reference to FIGS. 17 and 19, in some embodiments, for example, displacement of the actuator 414 relative to the mandrel 412, such that the apparatus 100 transitions from the engagement-ready state 26 to the engagement state 28, is with effect that the actuator 414 is disposed within the actuator receiver 422. Disposition of the actuator 414 within the actuator receiver 422 effects outward displacement of the engageable surface 22 of the engager 20, relative to the central axis 19 of the apparatus 100. The outward displacement of the engageable surface 22 of the engager 20 is effected in response to relative sliding displacement between a first actuation surface 424, defined by an outer surface of the actuator 414, and a corresponding first portion 425 the inner surface of the engager 20 as the actuator 414 and mandrel 412 are initially displaced relative to one another in response to application of the actuation force to the actuating assembly 400. The relative sliding displacement between the first actuation surface 424, defined by the actuator 414, and the corresponding first portion 425 of the inner surface of the engager 20 effects outward displacement of the engager 20, relative to the central axis 19 of the apparatus, such that the engageable-surface-defining portion 20 is disposed, relative to the mandrel 412, such that a second portion 427 of the inner surface of the engager 20 is disposed in contact with a second actuation surface 426 defined by an outer surface of the actuator receiver 422. Continued displacement of the actuator 414 and mandrel 412, relative to one another, in response to application of the actuation force applied to the apparatus 100, effects further sliding displacement between the first actuation surface 424 of the actuator 414 and the first portion 425 of inner surface of the engager 20 along with relative sliding between the second portion 427 of the inner surface of the engager 20 over the second actuation surface 426 defined by the exterior of the actuator 414 until the actuator 414 is disposed within the actuator receiver 422 and the apparatus 100 is disposed in the engagement state 28, as shown in FIG. 19. In some embodiments, the first actuation surface 424 and the corresponding first portion 425 of the inner surface of the engager 20 are corresponding angled surfaces, the corresponding angled surfaces co-operating to effect outward displacement of the engager 20 relative to the central axis 19 of the apparatus 100. In such embodiments, for example, relative to an axis that is normal to the central axis 19 of the apparatus 100, the corresponding first actuation surface 424 and the first portion of the inner surface 425 of the engager 20 are corresponding angled surfaces selected within the range between 5 and 60 degrees relative to an axis that is normal to the central axis 19 of the apparatus 100. Similarly, in some embodiments, the second actuation surface 426 and the corresponding second portion of the inner surface 427 of the engager 20 are corresponding angled surfaces selected within the range between 5 and 60 degrees relative to an axis that is normal to the central axis 19 of the apparatus 100.

As described above, the mandrel 412 defines a passage 166 extending therethrough from the first end 412(1) to the second end 412(2). In such example embodiments, the mandrel 412 further defines a seat 160 configured for receiving a wellbore obstruction device 62, wherein the seat 160 extends into the passage 166 defined by the mandrel 412. In some embodiments, the seat 160 is defined by a constriction of the inner diameter of the inner surface of the mandrel 412 that defines the passage 166, as illustrated in FIGS. 17 and 19.

While the wellbore completion apparatus 100 is deployed within the wellbore 10 and is disposed in the engagement state 28, such that the mandrel 412, the actuator 414 and the engager 20 are co-operatively disposed in their second configuration 302, with effect that the engageable surface 22 of the engager 20 defines the engageable surface-defining loop 25 and engages the conductor surface-defined loop 123 of the passage-defining conductor surface 111, displacement of the apparatus 100 in a direction that is perpendicular to an axis that is normal to the engageable surface 22, is resisted.

Once the wellbore completion apparatus 100 is disposed in the engagement state 28, such that the engageable surface 22 of the engager 20 engages the conductor surface-defined loop 123 of the passage-defining conductor surface 111 with effect that the engageable surface 22 of the engager 20 is disposed in gripping engagement with the conductor surface-defined loop 123, deployment of a wellbore obstruction device 62 through the wellbore 10 is with effect that the wellbore obstruction device 62 passes through the passage 166 defined by the mandrel 412 until the wellbore obstruction device 62 becomes seated on the seat 160. In some embodiments, while the wellbore obstruction device 62 is seated on the seat 160, the wellbore obstruction device 62 is disposed in sealing engagement with the seat 160 such that the wellbore obstruction device 62 occludes the passage 166. Accordingly, while the wellbore obstruction device 62 is seated on the seat 160, flow communication across the wellbore completion apparatus 100 is sealed such that, in some embodiments, zonal isolation of the subterranean formation 12 through which the wellbore 10 extends is effected.

Figure 32A:
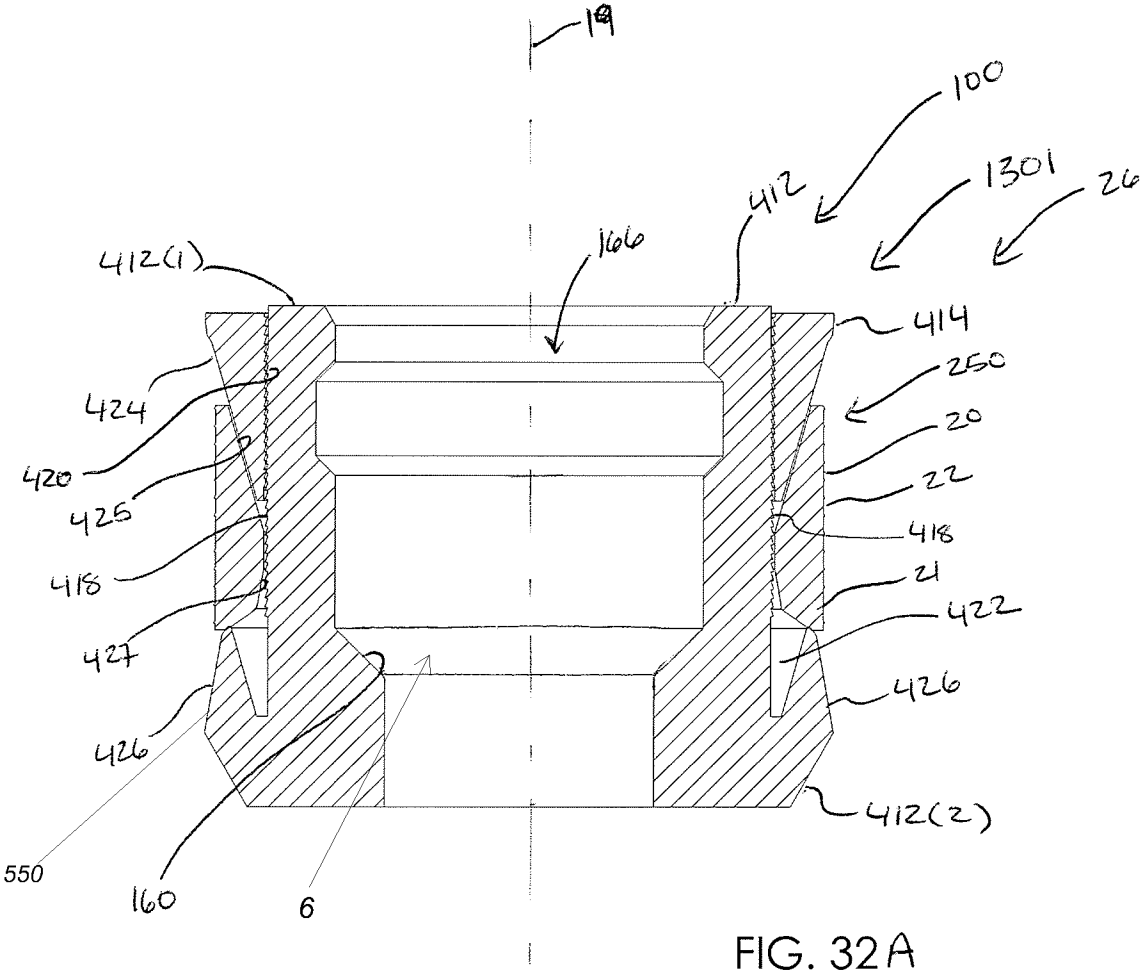
FIG. 32A is a cross-sectional view of the wellbore completion apparatus of FIG. 32 taken along section line 32A-32A shown in FIG. 32.
Figure 33:
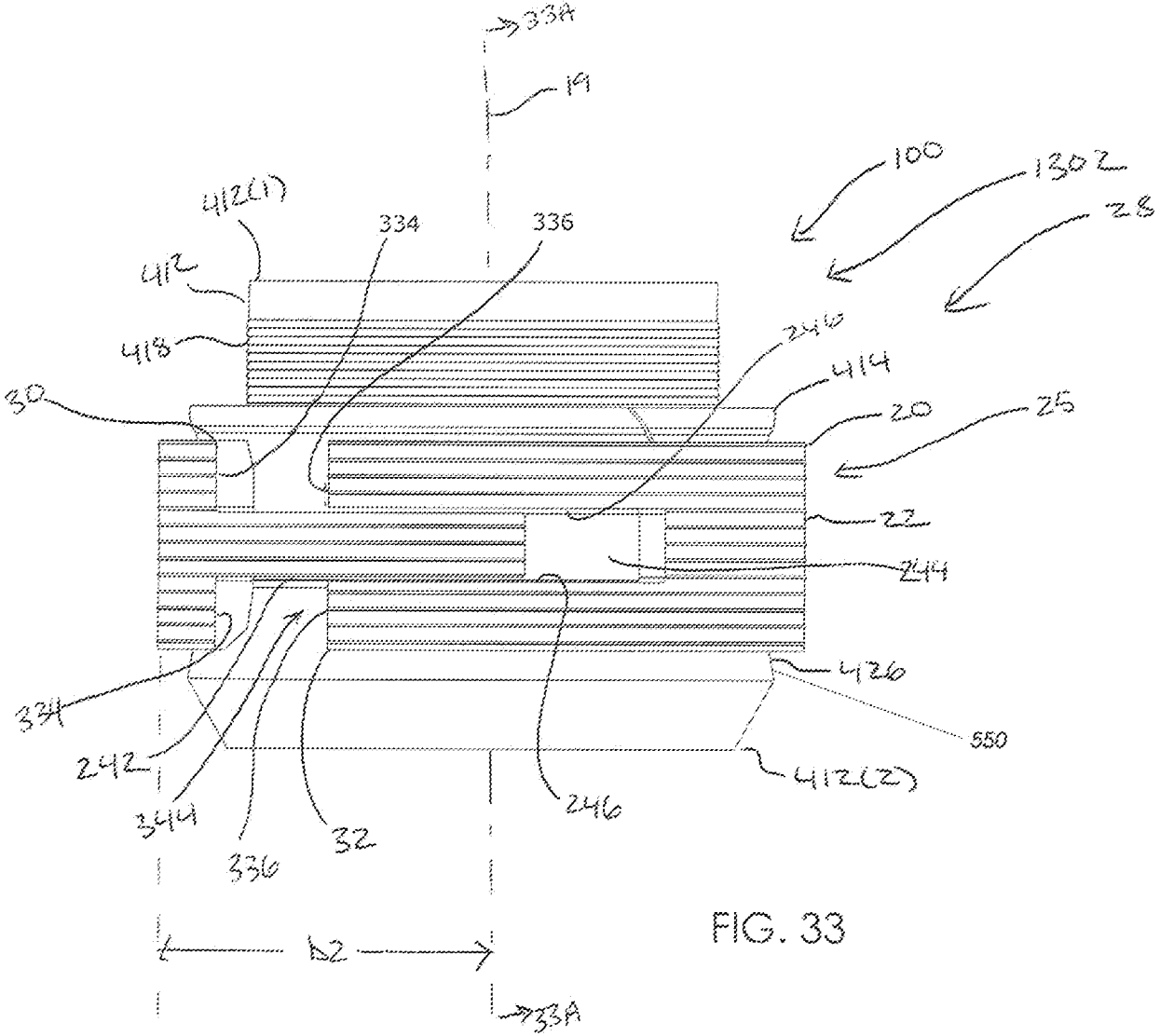
FIG. 33 is a front view of the wellbore completion apparatus of FIG. 32 in the engagement state.

Referring, in particular to FIGS. 32 and 33, there is shown another example embodiment of the wellbore completion apparatus 100 wherein the engager 20 is mounted on an actuating assembly 400 that includes a mandrel 412 and an actuator 414. The mandrel 412 extends between a first end 412(1) and a second end 412(2). The second end 412(2) of the mandrel 412 defines the engager relative displacement impeder 550 and an actuator receiver 422 configured for receiving a portion of the actuator 414 should the actuator 414 be displaced relative to the mandrel 412 to an extent where a portion of the actuator 414 is received with the space defined by the actuator receiver 422 as the apparatus 100 transitions to the engagement state 28. In some instances, the apparatus 100 may become disposed in the engagement state 28 such that the engageable surface 22 of the engager engages the wellbore-surface-defined loop 123 prior to a portion of the actuator 414 becoming disposed within the actuator receiver 422, as shown for instance in FIG. 33A, the relative displacement between the engager 20 and the mandrel 412 being limited by the interference between the engager 20 and the engager relative displacement impeder 550. In the example embodiment illustrated in FIG. 33A, the bottom end 415 of the actuator 414 is disposed at the receiver opening 422' defined by the actuator receiver 422 as the apparatus 100 is disposed in the engagement state 28.

With reference again to the example embodiment of FIGS. 32-33, the actuator 414 is disposed on the mandrel 412 such that the first end 412(1) of the mandrel 412 extends through the central opening 417 defined by the actuator 414, with the actuator 414 being configured for displacement relative to the mandrel 412, from the first position proximal the first end 412(1) of the mandrel 412 to the second position, proximal to the second, base end 412(2) of the mandrel 412 along an axis having a component that extends parallel to the central axis 19 of the apparatus 100. The actuator 414 defines a first actuation surface 424 on the outer surface of the actuator 414, which is co-operatively configured for sliding displacement relative to the inner surface of the engager 20 as the actuator 414 is displaced relative to the mandrel 412 from the first position to the second position such that the actuator 414 is wedged between the outer surface of the mandrel 412 and the inner surface of the engager 20. In the subject example embodiment, while the apparatus 100 is disposed in the engagement-ready state 26, the mandrel 412, the engager 20 and the actuator 414 are co-operatively configured such that the engager 20 is mounted on the mandrel 412, and the actuator 414 is mounted on the mandrel 412, such that the engager 20 is disposed intermediate the actuator 414 and the actuator receiver 422 defined by the mandrel 412.

While the apparatus 100 is disposed in the engagement-ready state 26 (such that the outermost surface of the engageable surface 22 is spaced apart from the central axis 19 of the apparatus 100 by the minimum distance D1 (a distance that is measured along an axis that is perpendicular to the central axis 19)), the mandrel 412, the actuator 414 and the engager 20 are co-operatively disposed in a first configuration. In the first configuration 1301, as shown in FIGS. 32 and 32A, the engager 20 is mounted on the mandrel 412 such that the engager 20 is disposed in an engagement-ready state defined loop configuration 250. While the engager 20 is disposed in the engagement-ready state defined loop configuration 250, the first free end 30 and the second free end 32 of the engager 20 are disposed in a mating relationship as illustrated in FIG. 32. While the engager 20 is disposed in the pre-actuation loop configuration 250 with the first free end 30 and the second free end 32 disposed in their mating relationship, the first free end 30 and the second free end 32 are displaceable relative to one another along an arcuate path. Accordingly, it will be understood that the engagement-ready state defined loop configuration 250, as defined by the engager 20 in the engagement-ready state 26, is an actuatable loop wherein the first free end 30 of the engager 20 and the second free end 32 of the engager 20 are disposed for displacement relative to one another. Relative displacement between the first free end 30 and the second free end 32 of the engager 20 away from each other along an arcuate path is with effect that the outermost surface of the engageable surface 22 of the engager 20 is displaced further outwardly relative to the central axis 19 of the apparatus 100, relative to the disposition of the engageable surface 22 while the engager 20 is disposed in the engagement-ready state defined loop configuration 250. Accordingly, the outward displacement of the outermost surface of the engageable surface 22 of the engageble surface-defining portion 20 is with effect that the outermost surface of the engageable surface 22 is spaced apart from the central axis 19 of the apparatus 100 by the minimum distance D2 (a distance that is measured along an axis that is perpendicular to the central axis 19)), wherein the minimum distance D2 is greater than the minimum distance D1.

In some embodiments, for example, the relative displacement between the first free end 30 and the second free end 32 is guided by a guide 344, defined by the engager 20. In this respect, in some embodiments, for example, the guide 344 guides relative displacement between the first and second free ends 30, 32, with effect that the engager 20 transitions from the engagement-ready state (see FIG. 32), wherein the engager defines the engagement-ready state defined loop configuration 250, to the engagement state 28 (see FIG. 33), wherein the engager 20 defines the engageable surface-defining loop 25.

In the subject example embodiment, the first mating profile 234, defined by the first free end 30 of the engager 20, is defined by a protrusion 242, defined by the engager 20. The protrusion 242 is disposed for guided movement within a receiver 244, also defined by the second free end 32 of the engager 20. The receiver 244 defines the second mating profile 236. While the apparatus 100 is disposed in the engagement-ready state 26, wherein the engager 20 is disposed in the pre-actuation loop configuration 250, the protrusion 242 is disposed within the receiver 244.

As illustrated in FIGS. 32-33, in some embodiments, for example, the receiver 244 is defined by a slot or recess defined within the engager 20. In other embodiments, for example, the receiver 244 may be defined by a recessed channel defined within the engager 20, the protrusion 242 being disposed within and supported by the recessed channel such that the first free end 30 and the second free end 32 are disposed in an overlapping relationship.

While the apparatus 100 is disposed in the engagement-ready state 26 and the engager 20 is disposed in the engagement-ready state defined loop configuration 250, the first free end 30 and the second free end 32 of the engager 20 are disposed in engagement such that the protrusion 242 is disposed within the receiver 244. Relative displacement between the first free end 30 and the second free end 32, such that the engager 20 transitions from the engagement-ready state defined loop configuration 250 to the engageable surface-defining loop 25, is effected by relative sliding displacement between the protrusion 242, defined by the first free end 30, and the corresponding receiver 244, defined by the second free end 32, such that the protrusion 242 begins to withdraw, or retract, from disposition within the receiver 244. The displacement of the protrusion 242 relative to the receiver 244 is guided by sliding of the protrusion 242 along corresponding protrusion-supporting surfaces 246 defined by the receiver 244 as the engageable surface 22 of the engager 20 is outwardly displaced relative to the central axis 19 of the apparatus 100. In some embodiments, for example, the displacement of the protrusion 242 relative to the receiver 244 is along an arcuate path.

Accordingly, actuation of the apparatus 100, such that the apparatus 100 transitions from the engagement-ready state 26 to the engagement state 28, and with effect that the engageable surface 22 is disposed further outwardly relative to the central axis 19 of the apparatus 100 in response to sliding displacement of the protrusion 242 within the receiver 244, defined by the guide 344, is with effect that the diameter of the engageable surface-defining loop 25 associated with the engagement state 28 is greater than the diameter of the engagement-ready state defined loop configuration 250 defined by the engager 20, while disposed in engagement-ready state 26. As the apparatus 100 transitions from the engagement-ready state 26 to the engagement state 28, the mandrel 412, the engager 20 and the actuator 414 are cooperatively configured such that the protrusion 242 remains disposed within the receiver 244 and the protrusion 242 and the receiver 244 remain aligned along a common arcuate path as the relative sliding between the protrusion 242 and the receiver 244 is effected in response to application of the actuation force applied by the setting tool to the actuating assembly 400. As the relative sliding between the protrusion 242 and the receiver 244 is effected, the mating relationship between the protrusion 242 and the receiver 244, such that the protrusion 242 remains disposed within the receiver 244 and the protrusion 242 and the receiver 244 remain aligned along a common arcuate path is further supported by the wedging of the actuator 414 between the inner surface of the engager 20 and the mandrel 412 as the actuator 414 is displaced relative to the mandrel 412.

Figure 33A:
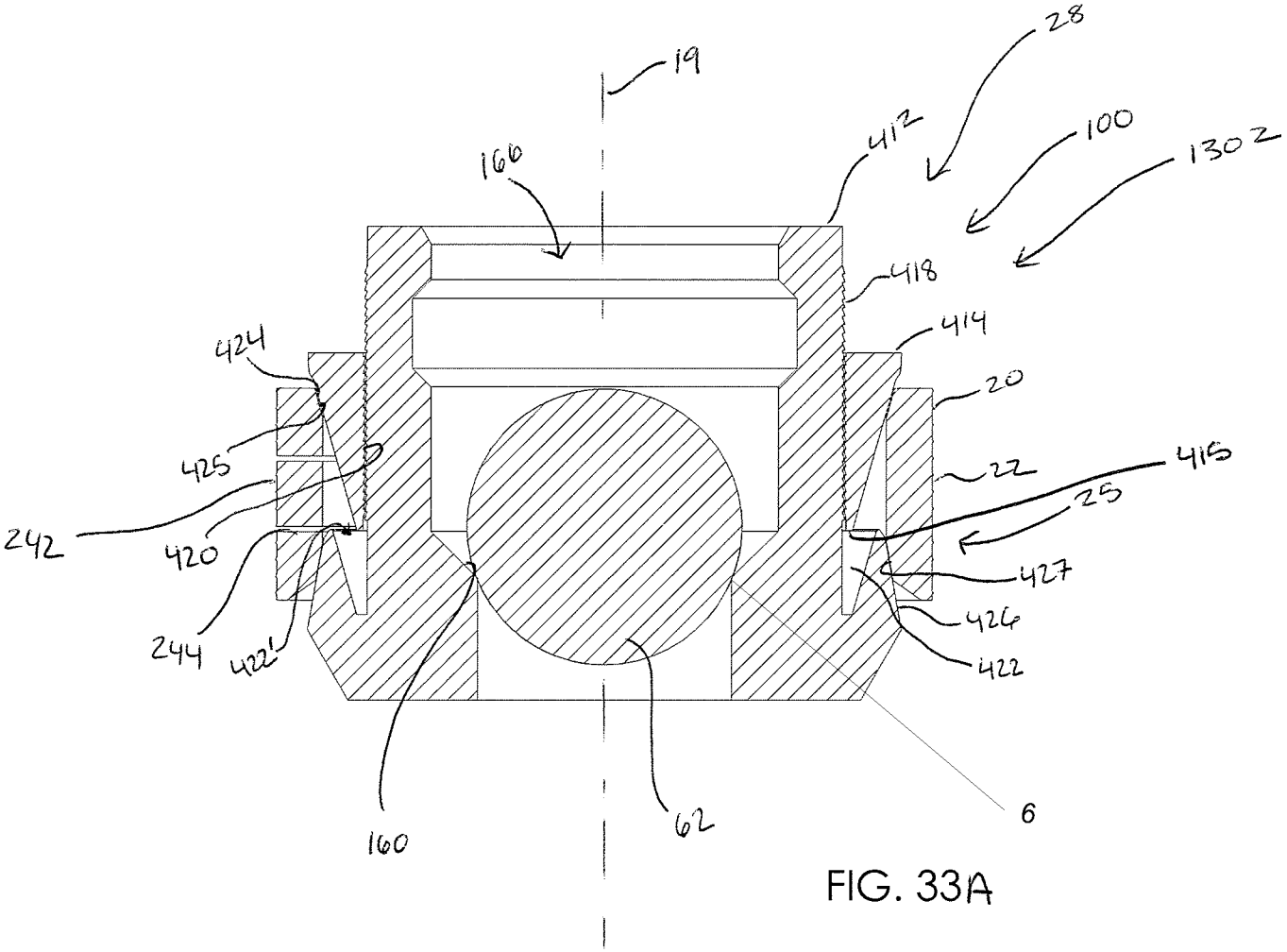
FIG. 33A is a cross-sectional view of the wellbore completion apparatus of FIG. 33 taken along section line 33A-33A shown in FIG. 33.

With reference now to FIGS. 33 and 33A, while the apparatus 100 is disposed in the engagement state 28, the engager 20, the mandrel 412 and the actuator 414 are co-operatively disposed in a second configuration 1302. In the second configuration 1302, the actuator 414 is displaced relative to the mandrel 412 from the first position, proximal the first end 412(1) of the mandrel 412, to a second position proximal the second end 412(2) of the mandrel 412, with effect that the engager 20 transitions from the pre-actuation loop configuration 250 to a configuration wherein the engager 20 defines the engageable surface-defining loop 25. Displacement of the actuator 414 relative to the mandrel 412, from the first position to the second position, such that the engager 20 transitions from the engagement-ready state defined loop configuration 250 to the configuration defining the engageable surface-defining loop 25, is with effect that the engageable surface 22 of the engager 20 is disposed further outwardly, relative to the central axis 19 of the apparatus 100, such that the outermost surface of the engageable surface-defining loop 25 is spaced apart from the central axis 19 of the apparatus 100 by the minimum distance D2 (a distance that is measured along an axis that is perpendicular to the central axis 19), wherein the minimum distance D2 is greater than the minimum distance D1.

Transitioning of the engager 20 from the engagement-ready state defined loop configuration 250, illustrated in FIGS. 32 and 32A, to the engageable surface-defining loop 25 configuration, illustrated in FIGS. 33 and 33A, is effected in response to application of the actuation force to the actuating assembly 400, via the setting tool. Accordingly, the wellbore completion apparatus 100 is releasably retained by the setting tool such that actuation of the setting tool is with effect that an uphole force is applied to the mandrel 412 of the actuating assembly 400 while a downhole force is applied to the actuator 414 such that relative displacement between the mandrel 412 and the actuator 414 is effected. The relative displacement between the mandrel 412 and the actuator 414 that is effected in response to application of the actuation force applied to the actuating assembly 400 by the setting tool is with effect that the actuator 414 is displaced relative to the mandrel 412 from the first position, proximal the first end 412(1) of the mandrel 412, to the second position, proximal the second, or base end 412(2) of the mandrel 414 such that the actuator 414 is wedged between the inner surface of the engager 20 and the outer surface of the mandrel 412. As in the embodiments described in relation to FIGS. 16-19, the relative displacement between the actuator 414 and the mandrel 412 includes displacement effected by meshing of corresponding sets of teeth defined on corresponding surfaces of the mandrel 412 and the actuator 414. In some embodiments, the relative displacement of the actuator 414 relative to the mandrel 412 from the first position to the second position such that the apparatus 100 transitions from the engagement-ready state 26 to the engagement state 28 is effected via a ratchet mechanism such that relative displacement between the mandrel 412 and the actuator 414 is permissible along an axis that includes a component that extends parallel to the central longitudinal axis 19 of the apparatus 100 can be effected in only one direction wherein the actuator 414 is displaced, relative to the mandrel 412 from the first position proximal the first end 412(1) to the second position proximal the second or base end 412(2) of the mandrel 412 such that the actuating assembly 400 remains disposed in the engagement state 28.

Displacement of the actuator 414 from the first position to the second position effects relative displacement between the first free end 30 and the second free end 32 of the engager 20 such that the first free end 30 and the second free end 32 are displaced away from each other along an arcuate path. The relative displacement between the first free end 30 and the second free end 32 is effected in response to relative sliding effected between the first actuation surface 424 of the actuator 414 and the first portion 425 of the inner surface of the engager 20 that is engaged by the first actuation surface 424 defined by the outer surface of the actuator 414 as the actuator 414 is displaced relative to the mandrel 412 from the first position (as shown in FIG. 32A) to the second position (as shown in FIG. 33A). Relative sliding between the first actuation surface 424 of the actuator 414 and the inner surface 425 of the engager 20, as the actuator 414 is displaced relative to the mandrel 412, effects outward displacement of the engager 20, relative to the central axis 19 of the apparatus 100, such that the second portion 427 of the inner surface of the engager 20 is disposed in contact with the second actuation surface 426 defined by the outer surface of the actuator receiver 422 as the mandrel 412 and the actuator 414 are displaced relative to one another. Continued displacement of the actuator 414, relative to the mandrel 412, in response to the application of the uphole force applied to the mandrel 412 and the downhole force applied to the actuator 414 in response to application of the actuation force by the setting tool, effects relative sliding between the second portion 427 of the inner surface of the engager 20 and the second actuation surface 426 which effects further outward displacement of the engager 20 such that the engager 20 transitions from disposition in the engagement-ready state defined loop configuration 250 to the configuration defining the engageable surface-defining loop 25 as shown in FIGS. 33 and 33A. Relative sliding between the second portion 427 of the inner surface of the engager 20 and the second actuation surface 426 defined by the outer surface of the actuator receiver 422 is limited once the second portion 427 of the inner surface of the engager 20 encounters the engager relative displacement impeder 550 as defined by a portion of the second actuation surface 426 defined by the outer surface of the actuator receiver 422 wherein the outer diameter of the actuator receiver 422 exceeds a predetermined maximum inner diameter of the engager 20 while the engager is disposed in the engagement state 28 wherein the engager 20 defines the engageable surface-defining loop 25.

Referring now to FIGS. 35-39, there is shown another example embodiment of a wellbore completion apparatus 100 according to the present disclosure wherein the engager 20 is mounted on an actuating assembly 400 that includes a mandrel 412 and an actuator 414. As in the previously described embodiment, the engager 20 is mounted on the mandrel 412 of the actuating assembly 400 in an engagement-ready state defined loop configuration 250 wherein the first free end 30 and the second free end 32 of the engageble surface-defining portion 20 are disposed in a mating relationship such the engageable surface 22 of the engager 20 is spaced apart from the central axis 19 of the apparatus 100 by the minimum distance D1 (a distance that is measured along an axis that is perpendicular to the central axis 19). Accordingly, the engager 20 is mounted on the mandrel 412 such that the first end 412(1) extends through the central opening defined by the engagement-ready state defined loop configuration 250 defined by the engager 20. The actuator 414 is disposed on the mandrel 412 such that the engager 20 is disposed intermediate the second, base end 412(2) of the mandrel 412 and the actuator 414.

Figure 36:
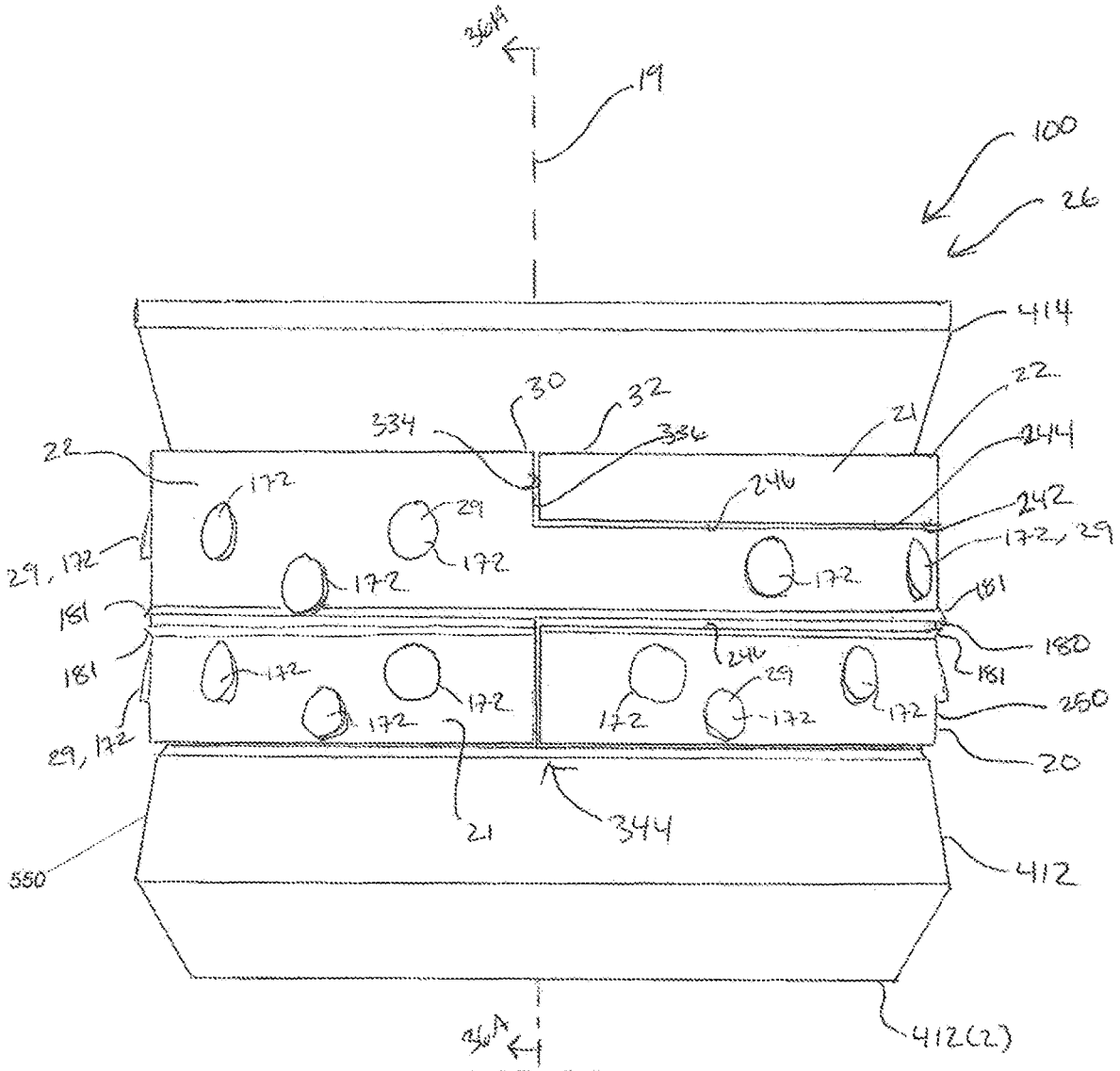
FIG. 36 is a front view of the wellbore completion apparatus according of FIG. 35 in the engagement-ready state.
Figure 36A:
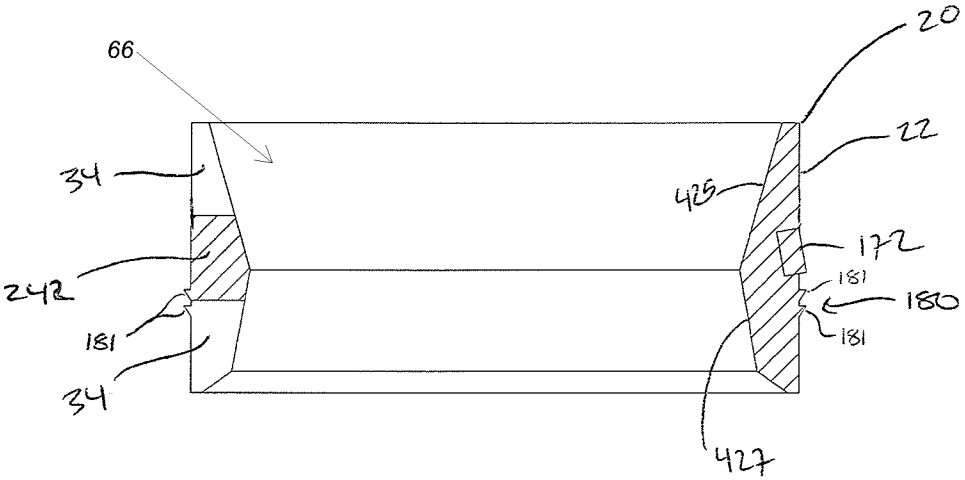
FIG. 36A is a cross-sectional view of the engager of the wellbore completion apparatus of FIG. 36 taken along section line 36A-36A shown in the FIG. 36.

With reference now to FIG. 36, while the apparatus 100 is disposed in the engagement-ready state 26 and the engager 20 is disposed in the engagement-ready state defined loop configuration 250, the first free end 30 and the second free end 32 of the engager 20 are disposed relative to one another in their first configuration such that the first mating surface 334 is disposed in abutting engagement with the second mating surface 236, the first and second free end 30, 32 being displaceable relative to one another along an arcuate path. Accordingly, it will be understood that the engagement-ready state defined loop 250, defined by the engager 20 in the engagement-ready state 26, is an actuatable loop.

Actuation of the apparatus 100 such that the apparatus 100 transitions from the engagement-ready state 26 to the engagement state 28 effects relative displacement between the first free end 30 and the second free end 32 of the engager 20, with effect that the engager 20 defines the engageable surface-defining loop 25. In response to the transitioning, the engageable surface 22 becomes outwardly displaced with respect to the central axis 19 of the apparatus 100, as shown in FIG. 37.

As illustrated in FIGS. 36-37 and 38-39, in the subject example embodiment, the relative displacement between the first free end 30 and the second free end 32, as the apparatus 100 transitions from the engagement-ready state 26 to the engagement state 28, is guided by the guide 344, defined by the engager 20. Accordingly, as in the previously described embodiment, the guide 344 guides relative displacement between the first and second free ends 30, 32, with effect that the engager 20 transitions from the engagement-ready state (see FIG. 36), wherein the engager defines the engagement-ready state defined loop configuration 250, to the engagement state 28 (see FIG. 37), wherein the engager 20 defines the engageable surface-defining loop 25.

In the subject example embodiment, the first mating profile 234, defined by the first free end 30 of the engager 20, is defined by a protrusion 242, defined by the engager 20. The protrusion 242 is disposed for guided movement within a receiver 244, also defined by the second free end 32 of the engager 20. The receiver 244 defines the second mating profile 236. While the apparatus 100 is disposed in the engagement-ready state 26, wherein the engager 20 is disposed in the pre-actuation loop configuration 250, the protrusion 242 is disposed within the receiver 244.

Figure 37:
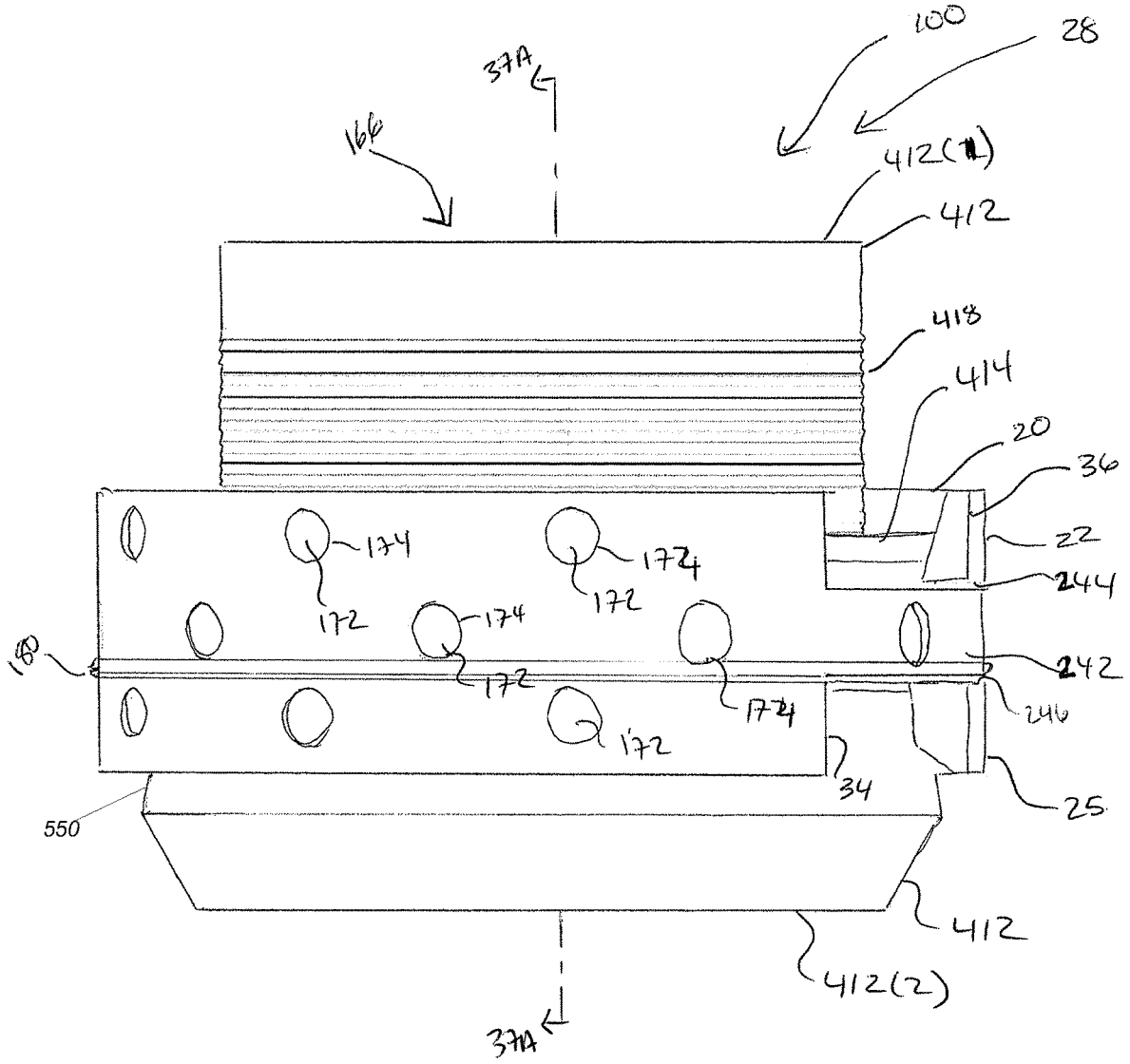
FIG. 37 is a side view of the wellbore completion apparatus according of FIG. 36 in the engagement state.

As illustrated in FIGS. 36 and 37, in some embodiments, for example, the receiver 244 is defined by a slot or recess defined within the engager 20. In other embodiments, for example, the receiver 244 may be defined by a recessed channel defined within the engager 20, the protrusion 242 being disposed within and supported by the recessed channel such that the first free end 30 and the second free end 32 are disposed in an overlapping relationship.

While the apparatus 100 is disposed in the engagement-ready state 26 and the engager 20 is disposed in the engagement-ready state defined loop configuration 250, the first free end 30 and the second free end 32 of the engager 20 are disposed in engagement such that the protrusion 242 is disposed within the receiver 244. Relative displacement between the first free end 30 and the second free end 32, such that the engager 20 transitions from the engagement-ready state defined loop configuration 250 to the engageable surface-defining loop 25, is effected by relative sliding displacement between the protrusion 242, defined by the first free end 30, and the corresponding receiver 244, defined by the second free end 32, such that the protrusion 242 begins to withdraw, or retract, from disposition within the receiver 244. The displacement of the protrusion 242 relative to the receiver 244 is guided by sliding of the protrusion 242 along corresponding protrusion-supporting surfaces 246 defined by the receiver 244 as the engageable surface 22 of the engager 20 is outwardly displaced relative to the central axis 19 of the apparatus 100. In some embodiments, for example, the displacement of the protrusion 242 relative to the receiver 244 is along an arcuate path.

Transitioning of the engager 20 from the engagement-ready state defined loop 250 to the engageable surface-defining loop 25 configuration is effected in response to application of the actuation force to the actuating assembly 400, via the setting tool. Application of the actuation force to the actuating assembly 400 is with effect that the actuator 414 is displaced relative to the mandrel 412 from the first position to the second position such that the actuator 414 is wedged between the mandrel 412 and the engageable surface-defining portion 20. Displacement of the actuator 414 from the first position to the second position effects relative displacement between the first free end 30 and the second free end 32 of the engager 20 such that the first free end 30 and the second free end 32 are displaced away from each other along an arcuate path in response to relative sliding between the first actuation surface 424 of the actuator 414 and the first portion 425 of the inner surface of the engager 20. Relative sliding between the first actuation surface 424 and the inner surface 425 of the engager 20, as the actuator 414 is displaced relative to the mandrel 412, effects outward displacement of the engager 20, relative to the central axis 19 of the apparatus 100, such that the second portion 427 of the inner surface of the engager 20 is disposed in contact with the second actuation surface 426 defined by the outer surface of the actuator receiver 422. Continued displacement of the actuator 414, relative to the mandrel 412, in response to application of the actuation force, effects relative sliding between the second portion 427 of the inner surface of the engager 20 and the second actuation surface 426 which effects further outward displacement of the engager 20 such that the engager 20 transitions from disposition in the engagement-ready state defined loop configuration 250 to the configuration defining the engageable surface-defining loop 25.

Figure 35:
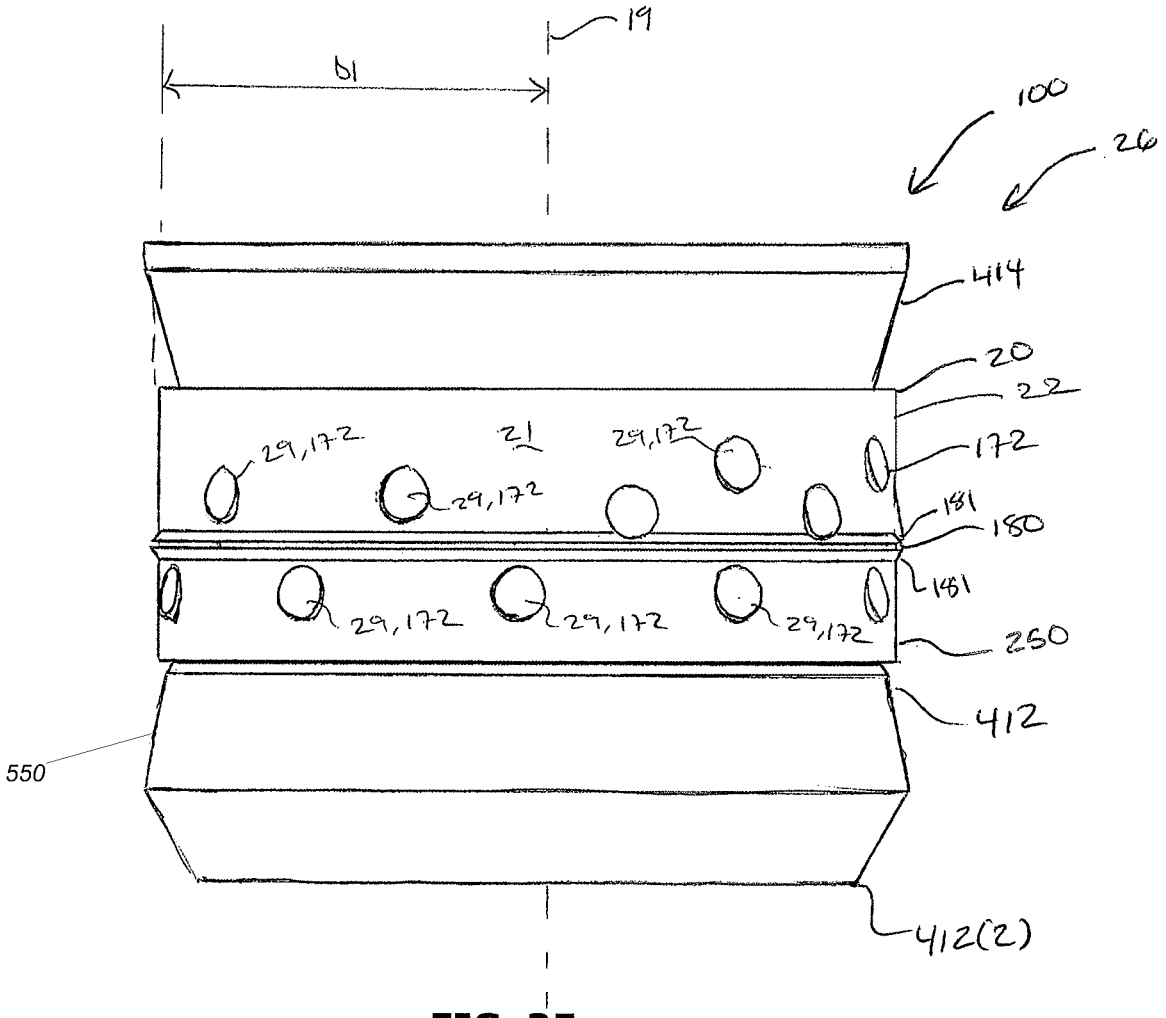
FIG. 35 is a rear view of a wellbore completion apparatus according to another example embodiment of the present disclosure disposed in an engagement-ready state.
Figure 38:
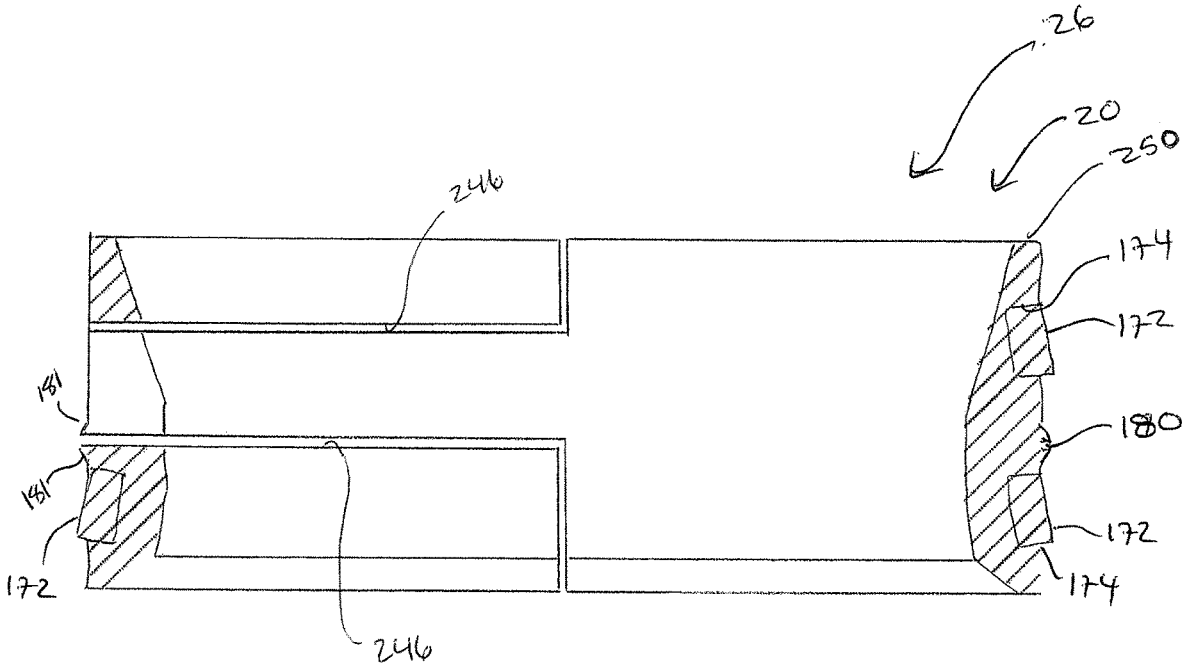
FIG. 38 is a cross-sectional view of the engager of the wellbore completion apparatus of FIG. 35, disposed in the engagement-ready state.
Figure 39:
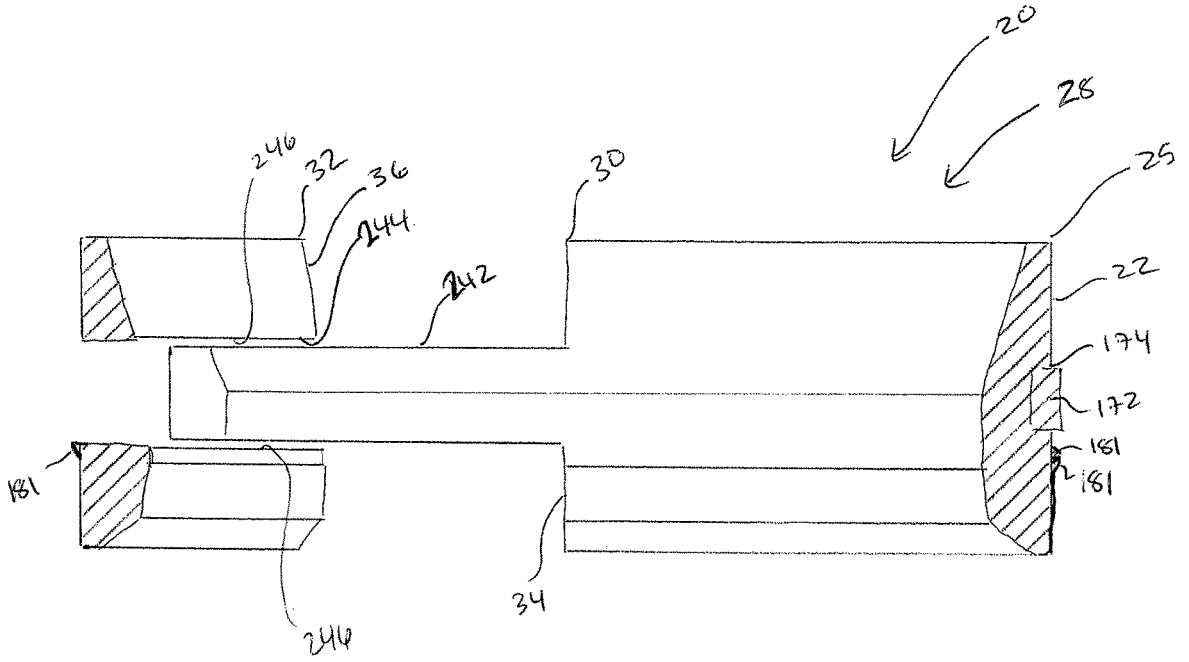
FIG. 39 is a cross-sectional view of the engager of FIG. 38, disposed in the engagement state.

With reference now to FIGS. 35, 36 and 38, in the subject example embodiment, the substrate 21 that defines the engager 20 includes a rib 180 that extends outwardly from the outer surface of the engager 20 and extends about the perimeter of the engager 20. In the subject example embodiment, the rib 180 protrudes outwardly from and extends about the middle of the engager 20. In the subject embodiment, the rib 180 includes a pair of outwardly flared surfaces 181 that extend from the outer surface of the substrate that defines the engager 20.

While the apparatus 100 is deployed in the wellbore 10 and transitions from the engagement-ready state 26 to the engagement state 28, such that the engageable surface 22 is disposed in engagement with the conductor surface-defined loop 123, the rib 180 is compressed against the conductor surface-defined loop 123 as the engageable surface 22 is disposed in gripping engagement with the conductor surface-defined loop 123. As the rib 180 is compressed against the conductor surface-defined loop 123, the outwardly flared surfaces 181 of the rib 180 tend to flatten against the conductor surface-defined loop 123 and tend to fill any voids or gaps that may be present in the portion of the passage defining-conductor surface 111 that defines the conductor surface-defined loop 123. In some embodiments, therefore, the rib 180 contributes to the sealing engagement between the engageable surface 22 of the engageable surface-defining loop 25 and the conductor surface-defined loop 123. Therefore, in some embodiments, while the apparatus 100 is deployed within the wellbore 10 and is disposed in the engagement state 128 such that the engageable surface 22 of the engager 20 engages the conductor surface-defined loop 123 of the passage-defining conductor surface 111, the rib 180 provides an additional sealing effect at the interface between the engageable surface-defining loop 25 and the conductor surface-defined loop 123.

As shown in FIGS. 35-39, in the subject example embodiment, the engager 20 includes grippers 172 that are embedded within the outer surface of the substrate that defines the engager 20. The grippers 172 are in the form of disk-shaped buttons that are disposed within recessed openings 174 disposed at spaced apart intervals about the outer surface of the engager 20. As the apparatus 100 transitions from the engagement-ready state 26 to the engagement state 128 such that the engager 20 transitions from the engagement-ready state defined loop configuration 250 to the configuration defining the engageable surface-defining loop 25 which brings the engageable surface 22 of the engager 20 into engagement with the conductor surface-defined loop 123, the sharp edges of the grippers 172 dig into and embed themselves within the conductor surface-defined loop 123 thereby effecting gripping engagement between the apparatus 100 and the conductor surface-defined loop 123 of the passage-defining conductor surface 111.

Figure 37A:
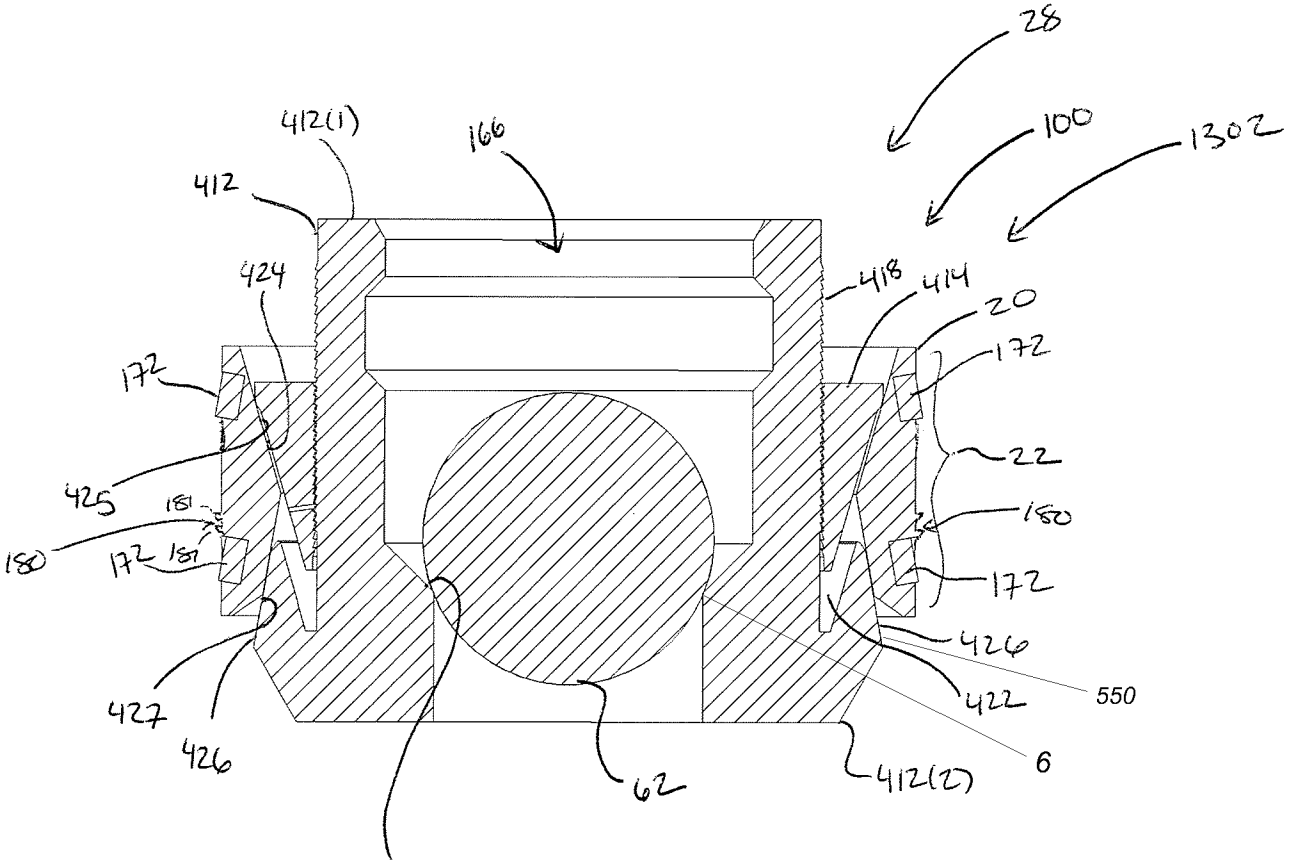
FIG. 37A is a cross-sectional view of the wellbore completion apparatus of FIG. 37 taken along section line 37A-37A shown in FIG. 37 with a wellbore obstruction device seated within the wellbore completion apparatus.
Figure 37A:
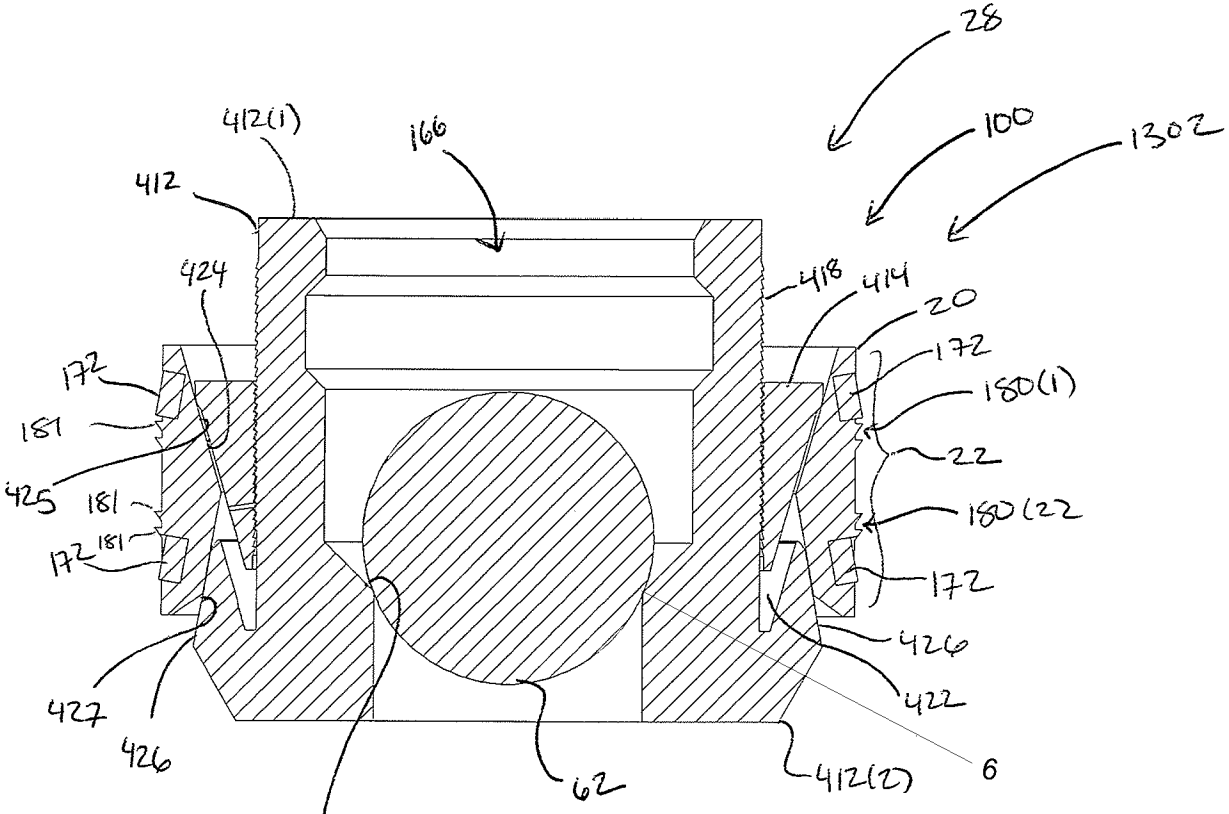
Figure 37A:
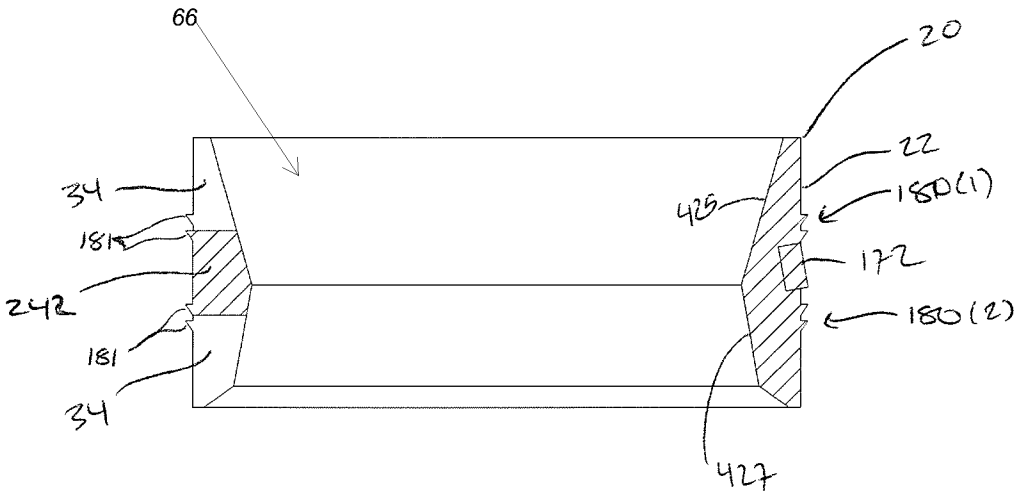

Referring now to FIGS. 37AA and 37AB, there is shown an alternate example embodiment of an engager 20 for used in a wellbore completion apparatus 100 as shown in FIGS. 35-39. In the subject example embodiment, the engager includes a pair of ribs 180 that extend outwardly from the outer surface of the engager 20 and extend about the perimeter of the engager 20, the pair of ribs 180 being spaced apart from each other relative to an axis having a component that extends parallel to the central axis 19 of the apparatus 100. Accordingly, in the subject example embodiment, a first rib 180(1) protrudes outwardly from an upper portion of the engager 20 while a second rib 180(2) protrudes outwardly from a lower portion of the engager 20. As in the previously described embodiments, each rib 180(1), 180(2) includes a pair of outwardly flared surfaces 181 that extend from the outer surface of the substrate 21 that defines the engager 20.

Referring now to FIGS. 41-48 there is shown another example embodiment of the wellbore completion apparatus 100 according to the present disclosure, wherein the engager 20 is mounted on an actuating assembly 400 that includes a mandrel 412 and an actuator 414. In the subject example embodiment, the mandrel 412, the engager 20 and the actuator 414 are co-operatively configured such that the apparatus 100 is configurable in an initiation state 26' prior to becoming disposed in the engagement-ready state 26. While the apparatus 100 is disposed in the initiation state 26', the engager 20 is defined by an initiation state defined loop 1250 wherein the first end portion 238 of the engager 20 and the second end portion 240 of the engager 20 are joined by one or more frangible portions 540. In some embodiments, for example, the frangible portion 540 is defined by a plurality of individual frangible portions 540 established at spaced apart intervals along the interface defined between the first end portion 238 and the second end portion 240. While the engager 20 is defined by the initiation state defined loop 1250, the engager 20 is configured such that there is an absence of the first free end 30 and the second free end 32.

As in the previously described embodiments, the apparatus 100 is configured to co-operate with an applied stimulus, which is applied to the apparatus 100 via the setting tool. In response to receiving the applied stimulus, the apparatus 100 transitions from the initiation state 26', as shown for example in FIG. 41, to the engagement-ready state 26, as illustrated schematically, for example in FIG. 42A. In response to the transitioning, the frangible portions 540, joining the first end portion 238 to the second end portion 240, are fractured, thereby establishing the first free end 30 and the second free end 32 of the engager 20. Once the first free end 30 and the second free end 32 are established (upon fracturing of the one or more frangible portions that interconnect the first end portion 238 and the second end portion 240), the engager 20 is defined by the engagement-ready state defined loop 2250.

Referring again to FIG. 41, the engager 20 includes a first elongated slot 542(1) that extends through the engager 20 from the outer engageable surface 22 to the inner surface of the engager 20 that is disposed opposite to the engageable surface 22. The first elongated slot 542(1) is configured such that an upper end 544 of the slot 542 does not extend to the upper edge 75 of the engager 20 while the lower end 545 of the slot 542 does not extend through to the corresponding mating surface 30*b* that defines a portion of the first mating profile 234 of the engager 20. The engager 20 includes a second elongated slot 542(2) that extends through the engager 20 from the outer engageable surface 22 to the inner surface of the engager 20 that is disposed opposite to the engageable surface 22. The second elongated slot 542(2) is configured such that an upper end 544 of the slot 542 does not extend through the upper edge of the corresponding mating surface 32*b* that defines a portion of the second mating profile 236 of the engager 20, while the lower end 545 of the slot 542(2) does not extend through the lower or bottom edge surface 77 of the engager 20. Disposition of the upper end 544 and the lower end 545 of the first elongated slot 542(1), and the upper end 544 and lower end 454 of the second elongated slot 542(2), away from the respective edge surfaces defined by the engager 20 defines the plurality of individual frangible portions 540 that serve to interconnect the first mating profile 234 to the second mating profile 236 such that there is an absence of a first free end 30 of the engager 20 and a second free end 32 of the engager 20 while the apparatus 100 is disposed in the initiation state 26'. In response to application of an applied stimulus, or an actuation force, that exceeds the predetermined threshold amount, as illustrated by the schematic directional arrows 810 acting on the actuator 414 and the schematic directional arrow 800 acting on the mandrel 412 illustrated in FIG. 42A, the individual frangible portions 540 fracture with effect that the joining of, or the interconnection between, the first end portion 238 and the second end portion 240 of the engager 20 is defeated thereby establishing the first free end 30 of the engager 20 and the second free end 32 of the engager 20. In the subject example embodiment, fracturing of the frangible portions 540 and establishment of the first free end 30 and the second free end 32 is such that the first free end 30 is defined by a plurality of surfaces 30*a*, 30*b*, 30*c*, and that the second free end 32 is defined by a plurality of surfaces 32*a*, 32*b*, 32*c* (see, for instance, FIGS. 42A and 43A). The first free end 30 of the engager 20 (once the apparatus 100 is in the engagement ready state 26) defines the first mating profile 234. Similarly, the second free end 32 of the engager 20 (once the apparatus 100 is in the engagement ready state 26) defines the second mating profile 236. Once the first free end 30 and the second free end 32 of the engager 20 are established and the apparatus 100 is disposed in the engagement-ready state 26, the first free end 30 and the second free end 32 of the engager 20 disposed for displacement relative to one another.

In some embodiments, for example, the engager 20 includes additional slots 170 disposed within the substrate 21 that defines the engager 20 in order to reduce stress concentrations that may develop as the engager 20 transitions from the initiation state-defined loop 1250, to the engagement-ready state-defined loop 2250 and to the engageable surface-defining loop 25. The slots 170 extend through the substrate 21 from the outer, engageable surface 22 of the engager 20 through the inner surface of the engager 20 and are disposed at spaced apart intervals about the engager 20 between the first mating profile 234, as defined by the first free end 30 of the engager 20 and the second mating profile 236 as defined by the second free end of the engager 20, as shown for instance in the example embodiment illustrated in FIG. 45. As shown, the stress-reducing slots 170 each have a length that is less than the length defined by the first elongated slot 542(1) and the length defined by the second elongated slot 542(2) and do not extend proximal an edge surface of the engager 20 and, therefore, do not define frangible portions as in the case of the first and second elongated slots 542(1), 542(2).

As in the previously described embodiments that include an actuating assembly 400 including a mandrel 412 and an actuator 414, the mandrel 412 extends between a first, upper end 412(1) and a second, lower or base end 412(2) and defines a passage 166 extending therethrough from the first end 412(1) to the second end 412(2). The engager 20 is disposed on the mandrel 412 while the engager 20 is disposed in the initiation state-defined loop 1250. Accordingly, the engager 20 is disposed on the mandrel 412 such that the first end 412(1) of the mandrel 412 extends through the central opening defined by the initiation state-defined loop 1250 defined by the engager 20. The second end or base end 412(2) of the mandrel 412 defines a stop surface or shoulder surface 552 which serves as the engager relative displacement impeder 550. Accordingly, the engager 20 is disposed on the mandrel 412 such that at least a portion of the bottom edge surface 77 of the engager 20 is disposed in abutting contact with the shoulder surface 552 that defines the engager relative displacement impeder 550. Accordingly, in some embodiments, for example, disposition of the engager 20, while disposed in the initiation state-defined loop 1250, on the mandrel 412 such that at least a portion of the bottom edge surface 77 of the engager 20 is disposed in abutting contact with the shoulder surface 552 of the engager relative displacement impeder 550, positions the engager 20 relative to the mandrel 412. The actuator 414 is disposed on the mandrel 412 such that the first or upper end 412(1) of the mandrel 412 extends through the central opening 417 that extends through the actuator 414. Accordingly, as in the previously described embodiments, the mandrel 412, the engager 20 and the actuator 414 are co-operatively configured such that the engager 20 is disposed on the mandrel 412 intermediate the second, or base end 412(2) of the mandrel 412 and the actuator 414.

Figure 41:
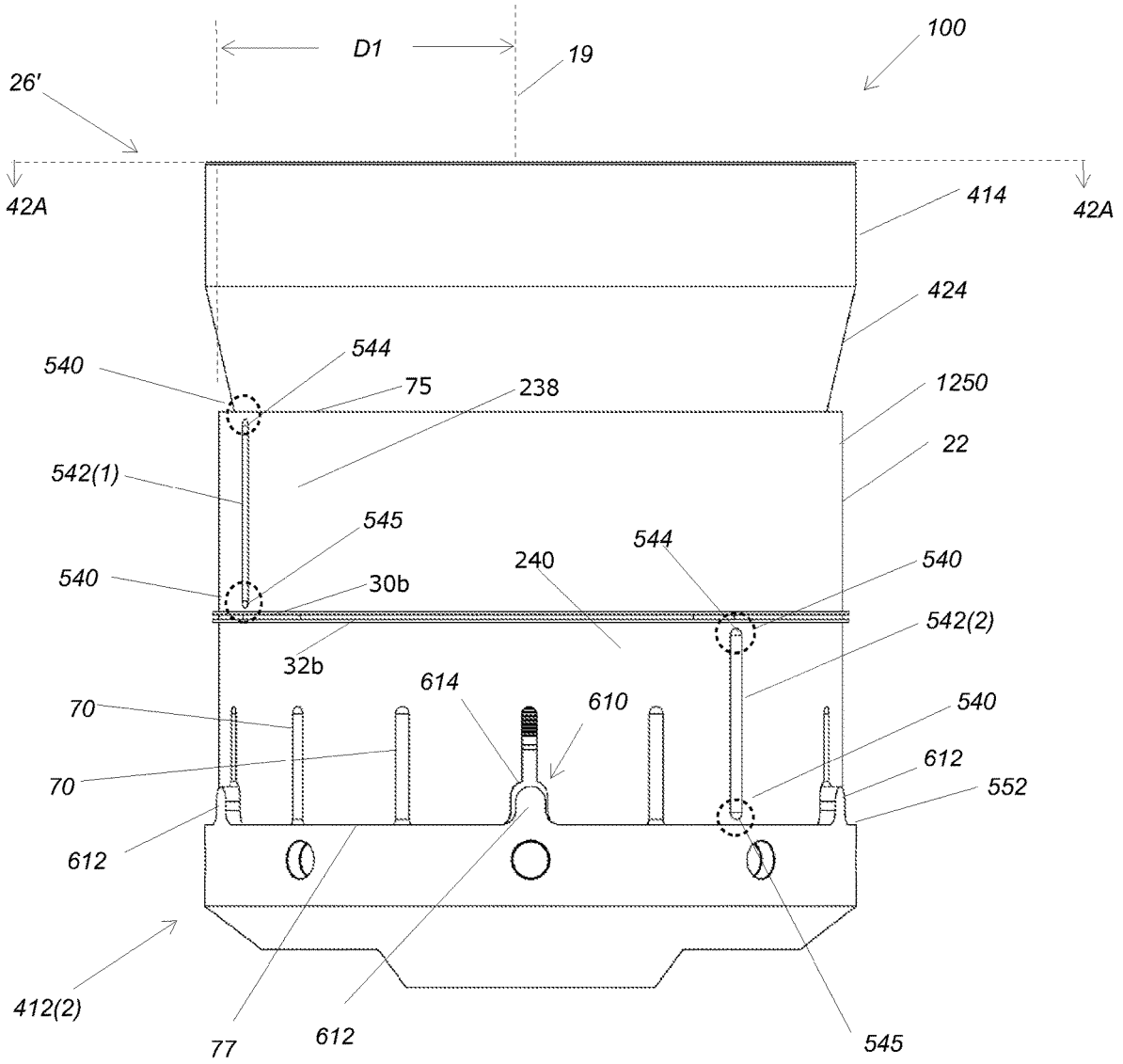
FIG. 41 is a front view of a wellbore completion apparatus according to another example embodiment of the present disclosure disposed in an initiation state.
Figure 42A:
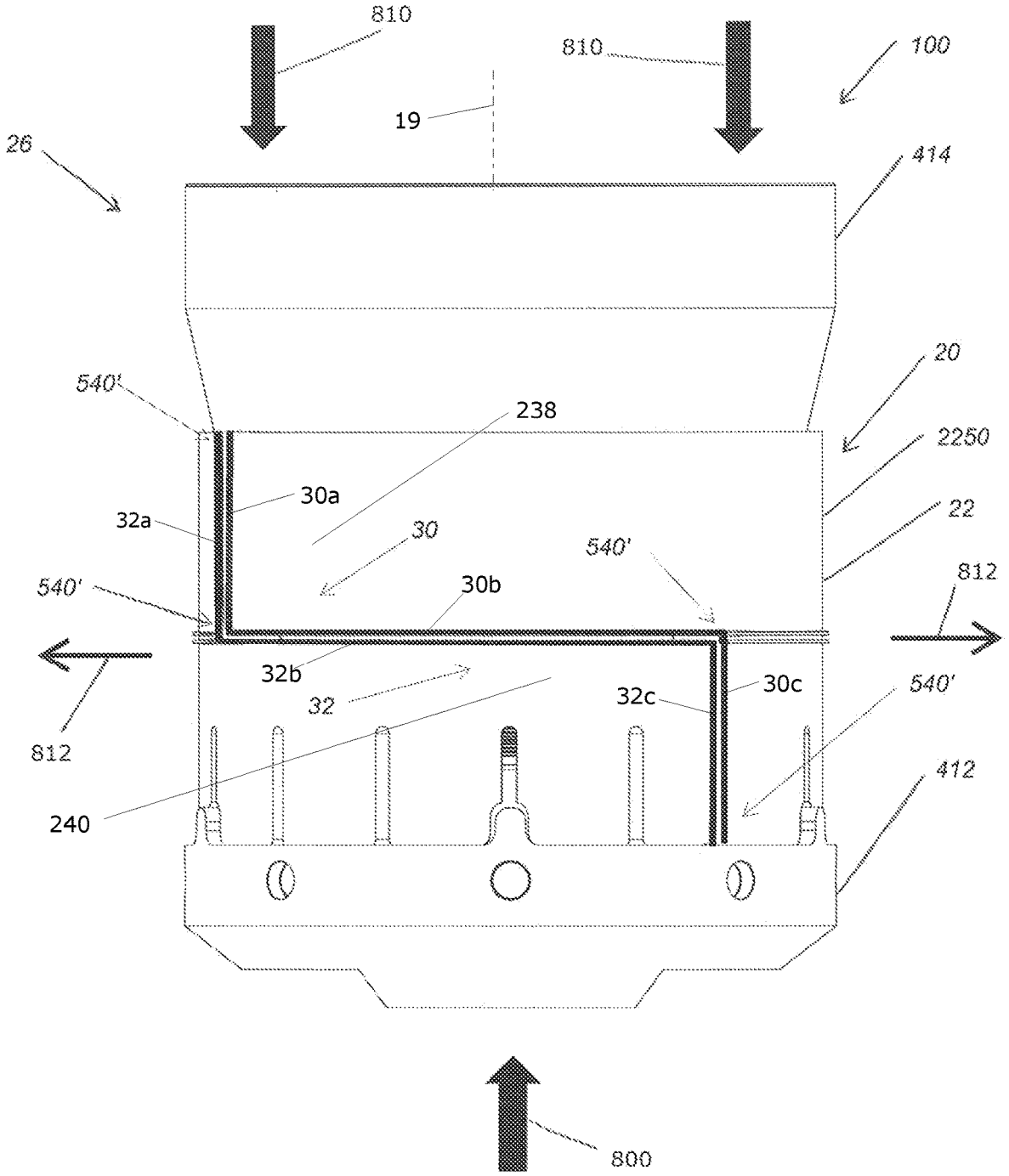
FIG. 42A is schematic illustration of the wellbore completion apparatus of FIG. 41 transitioning from the initiation state to an engagement-ready state.
Figure 43:
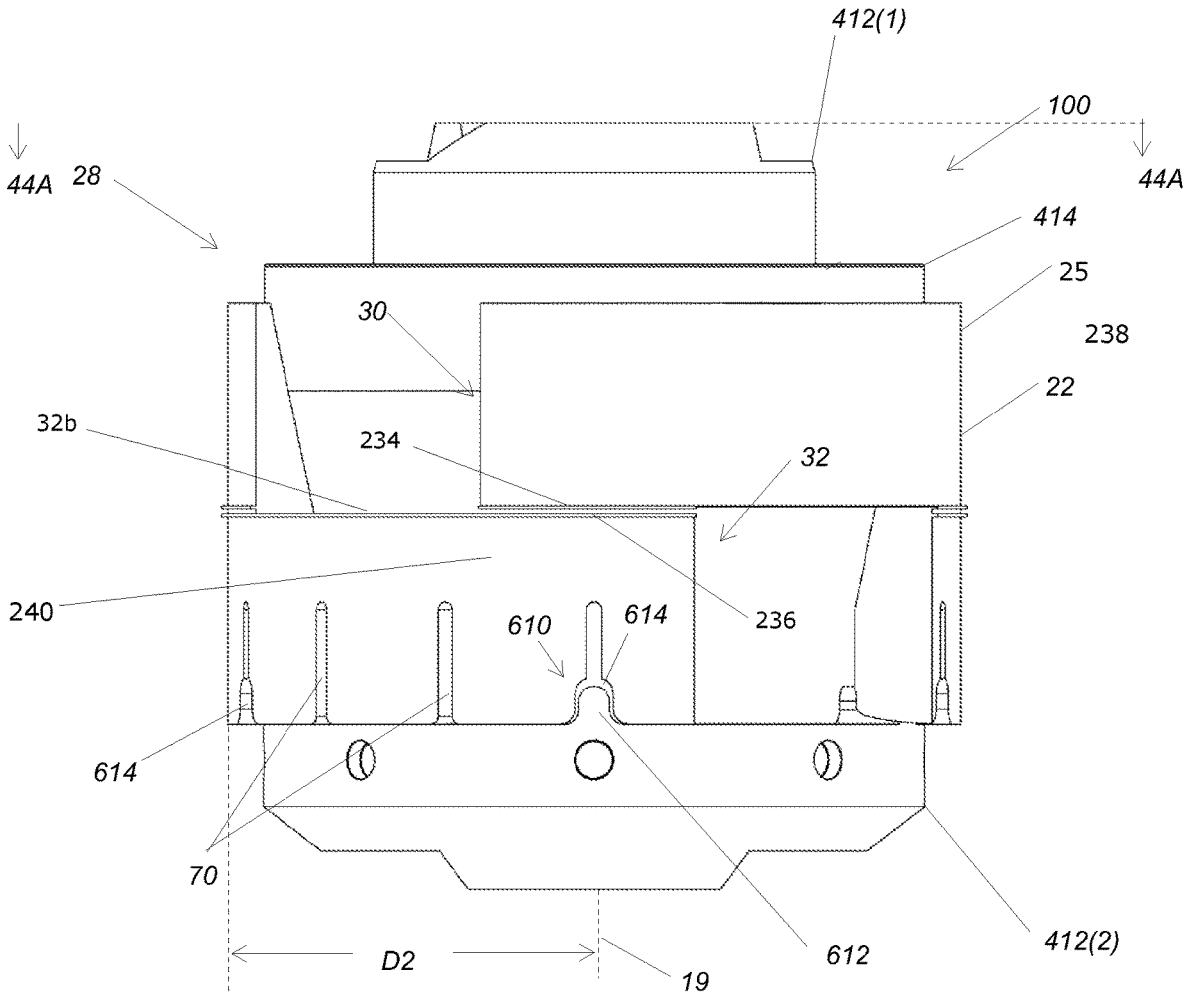
FIG. 43 is a front view of a wellbore completion apparatus of FIG. 41 disposed in an engagement state showing the first and second free ends of the engager.

While the wellbore completion apparatus 100 is disposed in the initiation state 26', the engager 20 is defined by the initiation state-defined loop 1250, the first end portion 238 and the second end portion 240 are interconnected by the one or more frangible portions 540, and the frangible portions are configured to be defeated or fracture, in response to application of a pre-determined threshold force, along an interface between the In order to effect transitioning of the apparatus 100 illustrated in FIG. 41 from the initiation state 26' (as shown in FIG. 41) into the engagement state 28 (as shown in FIG. 43), the apparatus 100 must first transition from the initiation state 26' to the engagement-ready state 26. The engagement-ready state 26 is illustrated schematically in FIG. 42A. Transitioning of the apparatus 100 from the initiation state 26' to the engagement-ready state 26 is effected in response to application of a force (or in response to an applied stimulus) that exceeds the predetermined threshold force, applied by the setting tool such that the one or more frangible portions 540 are fractured, or defeated, thereby defeating the interconnection between the first end portion 238 and the second end portion 240 such that the first free end 30 of the engager 20 and the second free end 32 of the engager 20 are established and disposed for relative displacement to one another. In some embodiments, for example, application of the applied force (or applied stimulus), as applied by the setting tool, is such that an uphole force, as illustrated by directional arrow 800 in FIG. 42A, is applied to the mandrel 412 concurrently with application of a downhole force, as illustrated by directional arrows 810 in FIG. 42A, applied to the actuator 414. Once the applied force (or applied stimulus), as illustrated by directional arrows 800, 810 exceeds the predetermined threshold amount, the applied force (or applied stimulus) is effective to defeat or fracture the frangible portions 540 with effect that the first free end 30 and the second free end 32 of the engager 20 are established and disposed for displacement relative to one another. The defeating or fracturing of frangible portions 540, as the apparatus 100 transitions from the initiation state 26' to the engagement-ready state 26, is such that the first end portion 238 and the second end portion 240 are no longer connected, or attached together, at the areas 540' previously defined or occupied by frangible portions 540. Once the one or more frangible portions 540 defined by the engager 20 are defeated, or fractured, the apparatus 100 is disposed in the engagement-ready state 26 (as illustrated schematically in FIG. 42A) wherein the engager 20 is defined by the engagement ready state defined loop 2250. Continued application of an actuation force (or applied stimulus), as applied to the actuating assembly 400 via the setting tool, by continued application of the uphole force 800 applied to the mandrel 412 and the downwards force 810 applied to the actuator 414, effects relative displacement between the first free end 30 and the second free end 32 of the engager 20 such that the first free end 30 and the second free end 32 are displaced away from each other along an arcuate path. The relative displacement between the first free end 30 and the second free end 32 in response to the application of the actuation force (or applied stimulus) along directional arrows 800, 810 is with effect that there is outwards displacement of the engager 20, relative to the central axis of the apparatus 19, as illustrated by directional arrows 812 in FIG. 42A. The outwards displacement of the engager 20 relative to the central axis 19 of the apparatus 100 as the apparatus 100 transitions to the engagement-ready state 26 to the engagement state 28 is such that the engager 20 transitions from the configuration wherein the engager 20 defines the engagement-ready state defined loop 2250 (shown in FIG. 42A) to the configuration wherein the engager 20 defines the engageable surface-defining loop 25 with effect that the engageable surface 22 of the engageable surface-defining loop 25 is disposed in engagement with the passage defining conductor surface 111 and the apparatus 100 is released from retention by the setting tool.

Figure 42:
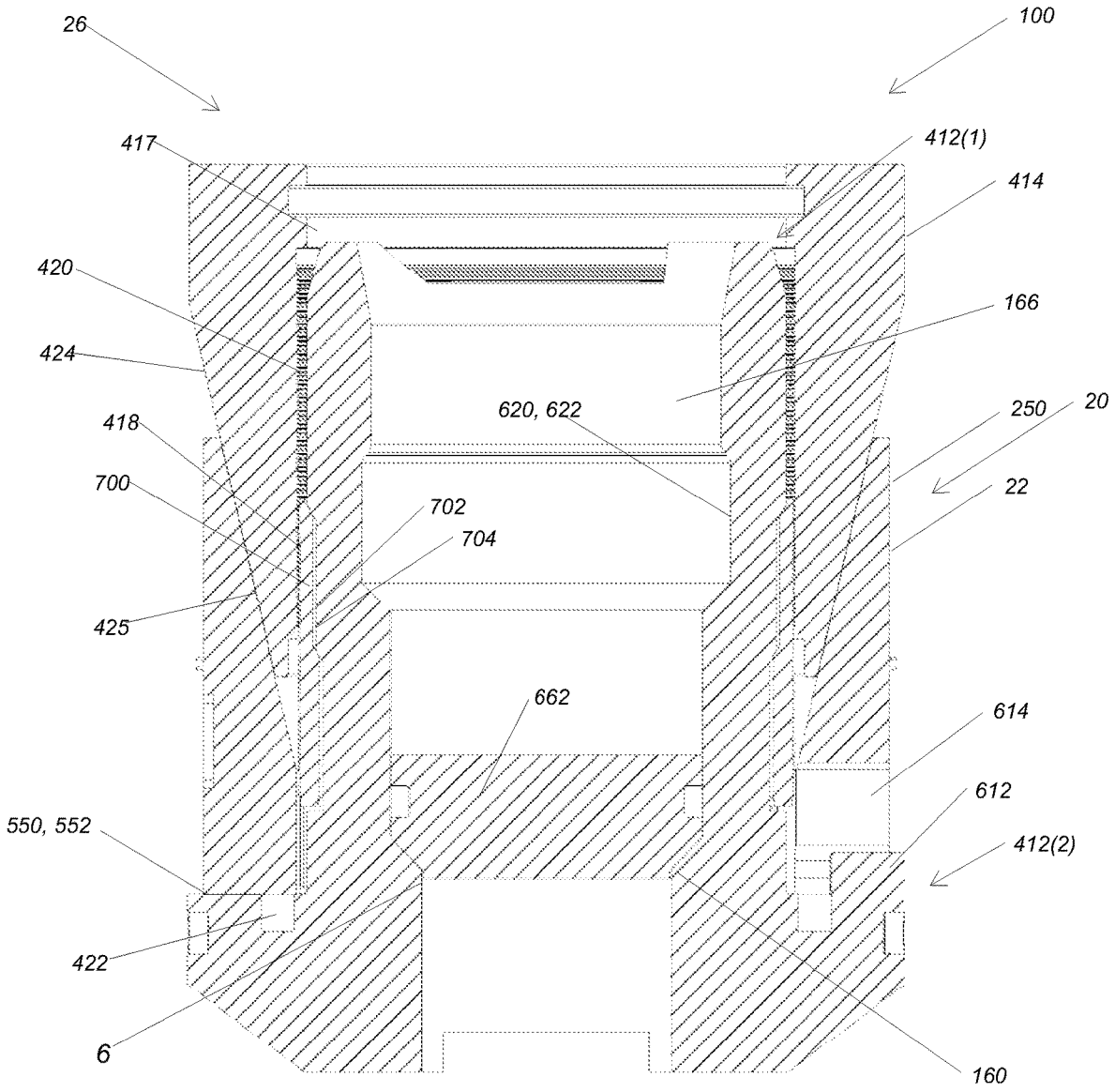
FIG. 42 is a cross-sectional view of the wellbore completion apparatus of FIG. 41 taken along section line 42A-42A, as shown in FIG. 41.

With reference now FIG. 42, the inner surface of the engager 20 has a first portion 425 that defines an angled surface that slopes downwardly and inwardly relative to the central longitudinal axis 19 of the apparatus 100. While the apparatus 100 is disposed in the initiation state 26' and the engager 20 is defined by the initiation state-defined loop 1250, the engager 20 and the actuator 414 are cooperatively configured such that the first portion 425 of the inner surface of the engager 20 is disposed for engagement with and relative sliding along the first actuation surface 424 defined by the corresponding outer surface of the actuator 414. Accordingly, while the apparatus 100 is disposed in the initiation state 26', the mandrel 412, the engager 20 and the actuator 414 are co-operatively configured such that the engager 20 is disposed on the mandrel 412 such that at least a portion of the bottom edge surface 77 is disposed in abutting contact with the shoulder surface 552 that defines the engager relative displacement impeder 550 defined by the second end 412(2) of the mandrel 414 and the first actuation surface 424 defined by the outer surface of the actuator 414 is disposed in contact engagement with at least a portion of the first portion 425 of the inner surface of the engager 20. In response to the applied stimulus, or actuation force, that exceeds the predetermined threshold force, as applied to the actuating assembly, via the setting tool, the actuating assembly 400 begins to actuate which effects relative displacement between the mandrel 412 and actuator 414 such that the actuator 414 begins to displace, relative to the mandrel 412, from the first position proximal the first end 412(1) of the mandrel 412 towards the second position proximal the second end 412(2) of the mandrel 412. Initial displacement of the actuator 414 relative to the mandrel 412, in response to the applied stimulus, or actuation force, that exceeds the predetermined threshold force, is with effect that the actuator 414 begins to wedge between the inner surface of the engager 20 and the outer surface of the mandrel 412. Wedging of the actuator 414 between the inner surface of the engager 20 and the outer surface of the mandrel 412 exerts an initial outwardly directed force on the engager 20 that is sufficient to defeat or fracture the frangible portions 540 such that the apparatus 100 transitions from the initiation state 26' to the engagement-ready state 26 with effect that the engager 20 transitions from the initiation state defined loop 1250 (shown, for example, in FIG. 42) to the engagement-ready state defined loop 2250 (shown, for example, in FIG. 42A). Continued application of the actuation force, as applied to the actuating assembly 400, effects further displacement of the actuator 414 relative to the mandrel 412 such that the actuator 414 becomes further wedged between the mandrel 412 and the inner surface of the engager 20. As relative displacement between the engager 20 and the mandrel 412 is limited or prevented by the shoulder surface 552, defined by the engager displacement impeder 550 defined by the second, base end 412(2) of the mandrel 412, downward displacement of the actuator 414 relative to the mandrel 412, such that the actuator 414 becomes further wedged between the mandrel 412 and the engager 20, is with effect that the first actuation surface 424 acts against the first portion 425 of the inner surface of the engager 20 exerting an outwardly directed force against the inner surface of the engager 20 such that the first free end 30 and the second free end 32 of the engager 20 are displaced away from each other along the arcuate path. Displacement of the first free end 30 and the second free end 32 of the engager 20 away from each other along the arcuate path is with effect that the engager 20 is outwardly displaced, relative to the central axis 19 of the apparatus 100, and the engager 20 transitions from the engagement-ready state defined loop 1250 to the engageable surface-defining loop 25, such that the outermost surface of the engageable surface 22 of the engager 20 is outwardly displaced relative to the central axis 19 of the apparatus 100 by the minimum distance D2 (a distance that is measured along an axis that is perpendicular to the central axis 19), relative to the disposition of the outermost surface of the engageable surface 22 of the engager 20, relative to the central axis 19, while the engager 20 is disposed in the initiation state-defined loop 1250 defined by the initiation state 26' such that the apparatus 100 becomes disposed in engagement state 28.

Figure 43A:
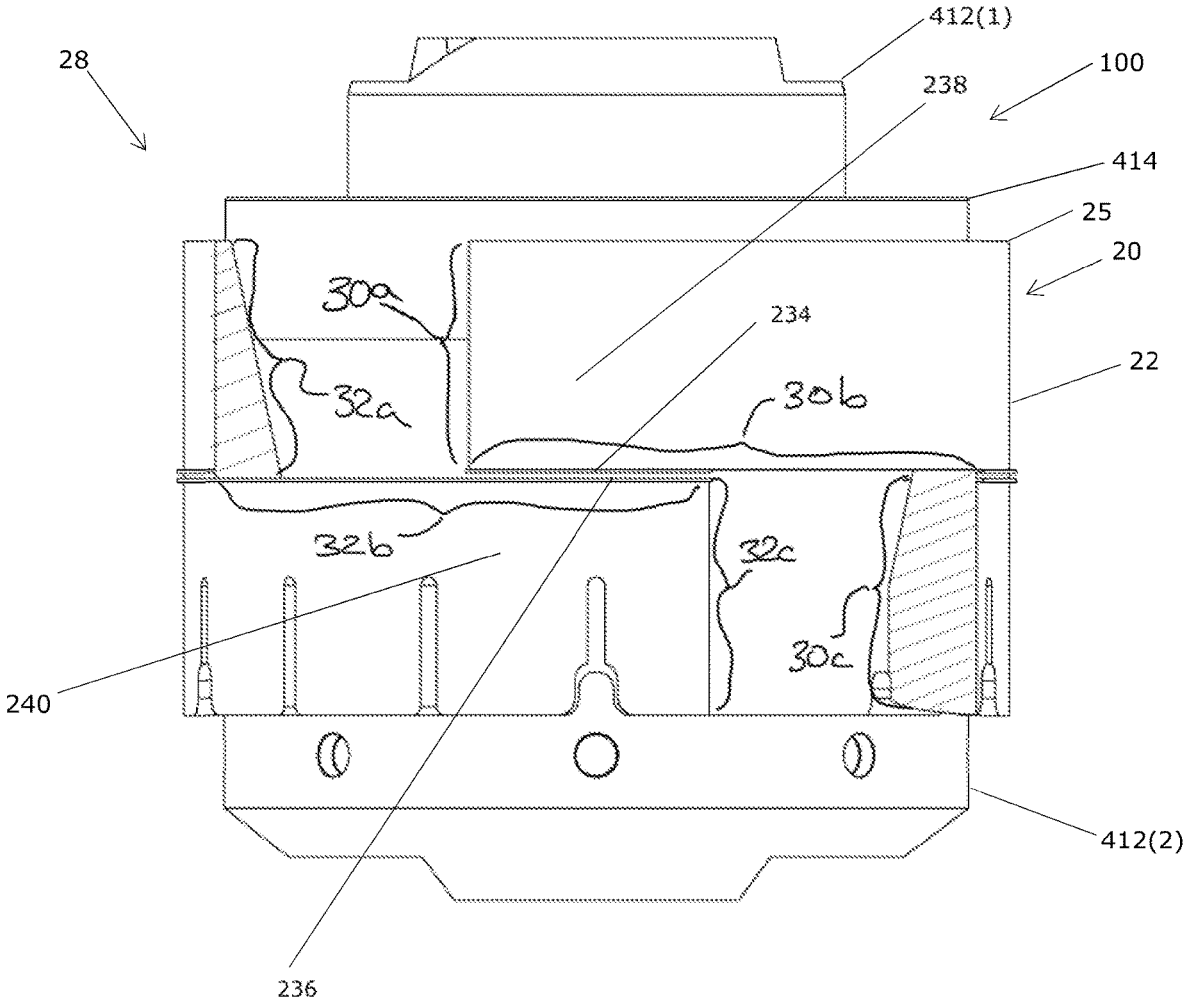
FIG. 43A is a front view of the wellbore completion apparatus as shown in FIG. 43 highlighting the surfaces that define each of the first and second free ends of the engager.

In the subject example embodiment, once the apparatus 100 transitions from the initiation state 26' to the engagement-ready state 26, via fracturing of the frangible portions 540 in response to application of the applied stimulus or an actuation force that exceeds the predetermined threshold force, such that the first free end 30 of the engager 20 and the second free end 32 of the engager 32 are defined and disposed for displacement relative to one another, the relative displacement between the first free end 30 and the second free end 32 of the engager 20 is guided by relative sliding between surface 30(*b*) (e.g. lower edge surface) of the first end portion 238 and the corresponding surface 32*b* (e.g. upper edge surface) of the second end portion 240. The first end portion 238 and the second end portion 240 are disposed for displacement relative to one another from a first configuration defined by the engagement-ready state 26, wherein the engager 20 is disposed in the engagement-ready state defined loop 2250, to a second configuration, as defined by the engagement state 28, wherein the first free end 30 and the second free end 32 are displaced away from each other such that only a portion of surface 30*b* of the first end portion 236 remains in abutting contact or contact engagement with a portion of surface 32*b* of the second end portion 240, with effect that the engager 20 defines the engageable surface-defining loop 25. Transitioning of the apparatus 100 into the engagement state 28, such that the engager 20 transitions from the engagement-ready state defined loop 2250 to the engageable surface-defining loop 25, is effected by relative sliding displacement between the corresponding surfaces 30*b*, 32*b* of first end portion 238 and the second end portion 240, with effect that the first end portion 238 and the second end portion 240 transition from a first configuration, associated with the engagement-ready state 26, wherein the each of the surfaces 30*a*, 30*b*, 30*c* are disposed in abutting contact with the corresponding surfaces 32*a*, 32*b*, 32*c*, to a second configuration, relative to one another, associated with the engagement state 28 (see for instance FIG. 43), such that end surfaces 30*a*, 30*c* become spaced apart from corresponding end surfaces 32*a*, 32*c*, as shown in FIGS. 43 and 43A.

In some embodiments, for example, the relative displacement between the first free end 30 and the second free end 32 is along an arcuate path, and is guided by the sliding contact between end surfaces 30*a*, 30*c*. In some embodiments, such relative displacement is further supported by the actuator 414, as the actuator 414 is displaced relative to the mandrel 412 and becomes wedged further between the mandrel 412 and the inner surface of the engager 20. In this respect, the actuator 414 maintains displacement of the first free end 30 relative to the second free end 32 along the arcuate path. With reference, in particular to FIG. 42, in some embodiments, for example, the actuating assembly 400 includes a C-ring 700 that is disposed on the mandrel 412 such that the C-ring 700 is disposed intermediate the outer surface of the mandrel 412 and a portion of the inner surface of the actuator 414. The outer surface of the C-ring 700 defines the first set of teeth 418 that are configured for meshing with the second set of teeth 420 defined on the corresponding inner surface of the actuator 414. The inner surface 702 of the C-ring 700 is configured for mating engagement within a corresponding recess 04 defined on the outer surface of the mandrel 412. While the apparatus 100 is disposed in the engagement-ready state 26, the C-ring is disposed on the mandrel 412 relative to the actuator 414 such that a portion of the first set of teeth 418 defined by the outer surface of the C-ring 700 is disposed in engagement with the a portion of the second set of teeth 420 defined by the inner surface of the actuator 414. Accordingly, in such example embodiment, application of the actuation force to the actuating assembly 400 is such that the uphole force applied to the mandrel 412 (see, for example, directional arrow 800 shown in FIG. 42A) and the downhole force applied to the actuator 414 (see, for example, directional arrow 810 shown in FIG. 42A), via the setting tool (not shown), is with effect that the actuator 414 and C-ring 700 initially translate together, relative to the mandrel 412, until the C-ring 700 becomes aligned with and engaged with the recess 704 defined on the outer surface of the mandrel 412. Once the C-ring 700 becomes disposed within the recess 704, the C-ring 700 is fixed relative to the mandrel 412 such that continued relative displacement between the mandrel 412 and the actuator 414, is with effect that the actuator 414 is displaced relative to the mandrel 412, and C-ring 700, with the displacement effected via the meshing of the first set of teeth 418 defined on the outer surface of the C-ring 700, which is effectively fixed relative to the mandrel 412, and the corresponding second set of teeth 420 defined on the inner surface of the actuator 414. In some embodiments, for example, the C-ring 700 is a body lock ring (BLR).

As described above, the mandrel 412 defines a passage 166 that includes a seat 160 defined by a constriction along the inner surface of the mandrel 412 that is configured for co-operating with a wellbore obstruction device 62 for occluding the passage 166 once the wellbore completion apparatus 100 is deployed within the passage 13 and disposed in the engagement state 28. With reference to the example embodiment illustrated in FIGS. 40-43, the wellbore obstruction device 62 is a disk 662 that is disposed within the passage 166 defined by the mandrel 412 and engages the seat 160 such that the disk 662 occludes the passage 166 between the first end 412(1) of the mandrel 412 and the second end 412(2) of the mandrel 412. In some embodiments, the disk 662 is disposed in engagement with the seat 160 while the wellbore completion apparatus 100 is being deployed through the passage 13, such that once the wellbore completion apparatus 100 is disposed in the engagement state 28 with effect that the engageable surface 22 is disposed in engagement with the passage defining conductor surface 111, the disk 662 prevents flow of fluid in the downhole direction past the disk 662, the disk 662 and wellbore completion apparatus 100, thereby isolating a downhole wellbore zone disposed downhole relative to the wellbore completion apparatus 100 from an uphole wellbore zone disposed uphole relation to the wellbore completion apparatus 100.

With reference again to the example embodiment illustrated in FIGS. 41-48, in some embodiments, for example, the mandrel 412 includes engager rotation impeders 610 that are configured for engaging with the engager 20 while the engager 20 is mounted on the mandrel 412. Accordingly, in some embodiments, the engager 20 and the engager rotation impeders 610 are cooperatively configured for preventing relative rotation between the mandrel 412 and the engager 20 via interference between the engager 20 and the engager rotation impeders 610. In some embodiments, for example, the engager rotation impeders 610 include projections 612 that extend upwardly from the shoulder surface that defines the engager relative displacement impeder at spaced apart intervals around the second or base end 412(2) of the mandrel 412. The projections 612 are configured for disposition with corresponding recesses 614 that are defined at corresponding spaced apart intervals about the bottom edge surface 77 of the engager 20 that extend upwardly into the substrate 21 of the engager 20. Accordingly, disposition of the engager 20 on the mandrel 412 such that the bottom edge surface 77 of the engager 20 is disposed in abutting contact with the shoulder surface defined by the engager relative displacement impeder is with effect that each of the projections 612, independently, is disposed within a corresponding recess 614 defined by the engager 20. The projections 612 and the corresponding recesses 614 are co-operatively configured such that projections 612 remain disposed within the corresponding recessed 614 defined by the engager 20 as the apparatus 100 transitions from the engagement-ready state 26 to the engagement state 28. Accordingly, once the wellbore completion apparatus 100 is deployed within the wellbore passage 13 and is disposed in the engagement state 28 such that the engageable surface 22 of the engager 20 is disposed in engagement with the passage defining conductor surface 111 and is released from the setting tool, and the corresponding wellbore operation associated with the wellbore completion apparatus 100 is complete, removal of the wellbore completion apparatus 100 from engagement with the passage-defining conductor surface 111 is often required. In some embodiments, for example, removal of the wellbore completion apparatus 100 from within the passage 13 is effected via milling-out procedures, as is known in the art. The engager rotation impeders 600 are effective at preventing unwanted rotation between the mandrel 412 and the engager 20 that may be induced in response to milling-out procedures where the wellbore completion apparatus 100 is engaged by a drill bit to effectively drill-out the wellbore completion apparatus 100 from the passage 13 as relative rotation between any of the components of the wellbore completion apparatus 100 may adversely affect the mill-out procedures or render the mill-out procedure ineffective.

Figure 43B:
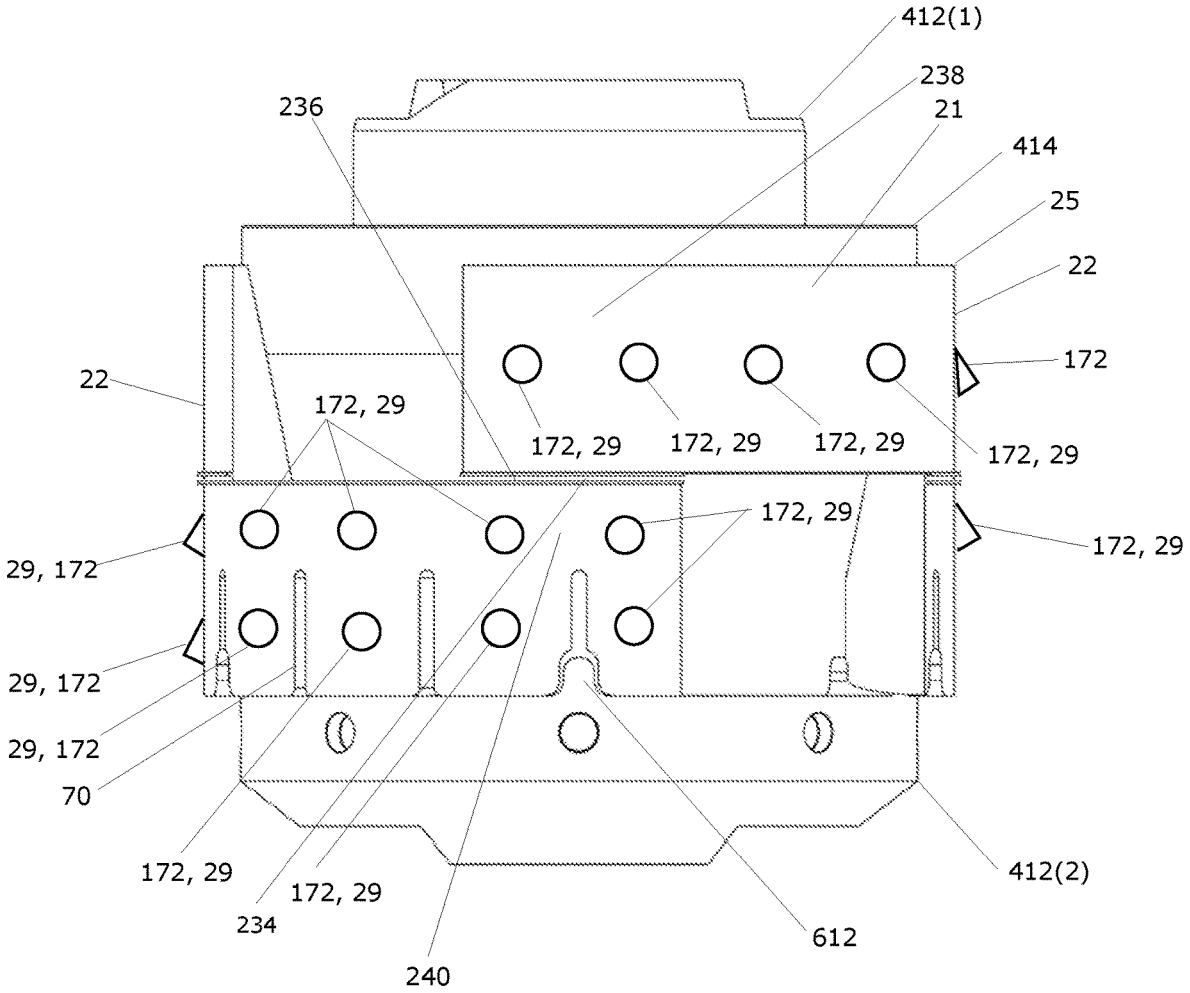
FIG. 43B is a front view of an alternate embodiment of the wellbore completion apparatus, disposed in an engagement state, and identical to the embodiment of FIG. 41, with the exception that the engager of this embodiment includes grippers.
Figure 44:
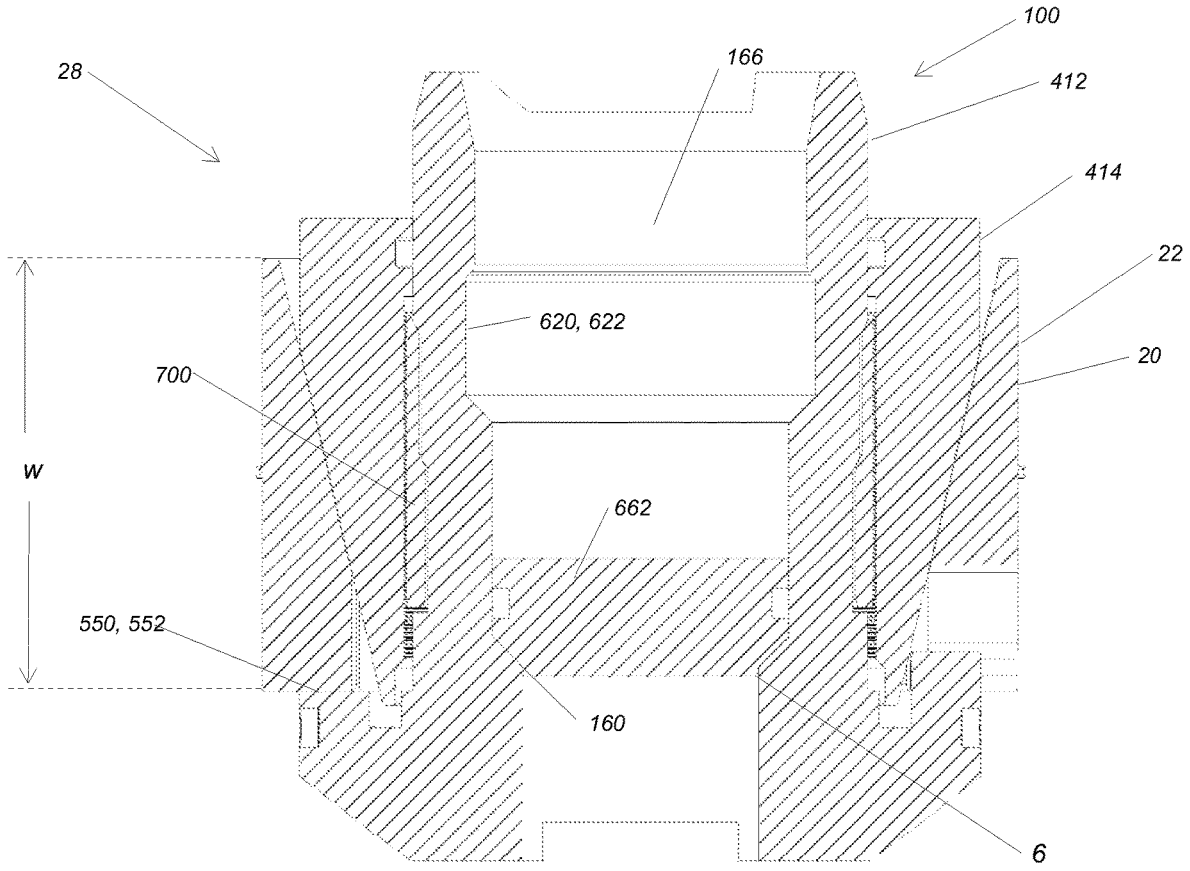
FIG. 44 is a cross-sectional view of the wellbore completion apparatus of FIG. 43 taken along section line 44A-44A, as shown in FIG. 43.

With reference now to FIG. 43B, as described above in connection with the example embodiment of FIGS. 35-39, in some embodiments, for example, the wellbore completion apparatus 100 as shown in FIGS. 41-48 includes one or more surface enhancement features 29 in the form of gripping components which define at least a portion of the engageable surface 22. Accordingly, in some embodiments, for example, the engager 20 includes grippers 172 in the form of disk-shaped buttons (or slip buttons) that are disposed within and distributed about the outer surface of the substrate 21 that defines the engager 20. In some embodiments, for example, the grippers 172 are disposed about the outer surface of the substrate 21 that defines the engager 20 such that a single row, or ring, 172(1) of grippers 172 is disposed about an upper portion 20*a* of the engager 20 with one or more rows, or rings, 172(2), 172(3) disposed about a lower portion 20*b* of the engager 20. In some embodiments, for example, the plurality of rows or rings 172(1), 172(2), 172(3), . . . , 172(*n*) of grippers 172 are staggered relative to one another while in other embodiments, for example, the individual grippers 172 disposed in each of the plurality of rows or rings 172(1), 172(2), 172(3), . . . , 172(*n*) of grippers 172 are aligned relative to one another along the outer surface of the substrate 21. The grippers 172 are each, independently, disposed within the substrate 21 such that the grippers 172 are each, independently, disposed at an angle relative to an axis that extends normal to the substrate 21 such that sharp edges of the grippers 172 protrude relative to the outer surface of the substrate 21. The disposition of the grippers 172 at an angle relative to an axis that extends normal to the substrate 21, in some embodiments, facilitates and/or enhances the gripping engagement effected between the engageable surface 22 and the corresponding passage-defining conductor surface 111 of the wellbore as the apparatus 100 transitions from the engagement-ready state 26 to the engagement state 28. Transitioning of the apparatus 100 into the engagement state 28 brings the engageable surface 22 of the engager 20 into engagement with the passage-defining conductor surface 111 with effect that the sharp edges of the grippers 172 dig into and embed themselves within the passage-defining conductor surface 111 of the conductor surface-defined loop 123, which provides a further gripping effect between the apparatus 100 and the passage-defining conductor surface 111.

As described above, the wellbore completion apparatus 100 is configured for engagement with the setting tool of a conveyance apparatus such that while the wellbore completion apparatus 100 is being deployed within the wellbore 10 via the conveyance apparatus, the wellbore completion apparatus 100 is releasably secured to the setting tool (not shown). With reference, in particular, to the example embodiment illustrated in FIGS. 41-48, wherein the engager 20 is disposed on an actuating assembly 400 that includes a mandrel 412 and an actuator 414, in some embodiments, for example, the mandrel 412 includes a setting tool engager 620 that is configured for releasable engagement with a co-operating portion of the setting tool. In some embodiments, the co-operating portion of the setting tool includes a cooperating portion of an adapter that is configured for engagement with the setting tool. In the subject example embodiment, the setting tool engager 620 is a recess 622 disposed within the inner surface of the mandrel 412 that defines the passage 166 that is configured for receiving a corresponding engaging device defined by the setting tool or setting tool adapter. Accordingly, while the wellbore completion apparatus 100 is releasably secured to the setting tool in the engagement-ready state 26, the engaging device defined by the setting tool (or setting tool adapter) is disposed in engagement with the setting tool engager 620 such that the wellbore completion apparatus 100 is releasably retained by the setting tool. Once the wellbore completion apparatus 100 is deployed to the desired location within the passage 13, the setting tool is actuated which transmits an actuation force to the actuating assembly 400. Transmission of the actuation force to the actuating assembly 400 is with effect that an uphole force is transmitted to the mandrel 412 via the engagement between the engaging device defined by the setting tool and the setting tool engager 620 (as illustrated by directional arrow X in FIG. 42A) while a downhole force is transmitted to the actuator 414 (as illustrated via directional arrow Y in FIG. 42A) via an outer sleeve member of the setting tool. Transmission of the actuation force to the mandrel 412, via the engaging device of the setting tool, and to the actuator 414, via the outer sleeve of the setting tool, effects actuation of the actuating assembly 400 such that the actuator 414 is displaced relative to the mandrel 414 with effect that the engageable surface 22 of the engager 20 is displaced further outwardly relative to the central axis 19 of the apparatus 100 and engages the passage defining conductor surface 111. Continued application of the actuation force effects further deformation of the engager 20 such that the engageable surface 22 is disposed in gripping engagement with the passage defining conductor surface 11 such that the apparatus 100 is disposed in the engagement state 28. Disposition of the apparatus 100 in the engagement state 28 is with effect that the apparatus 100 is released from engagement with the setting tool. Accordingly, in some embodiments, release of the apparatus 100 from engagement with the setting tool is effected by retraction of the setting tool relative to the mandrel 412 such that the setting tool engaging device is dislodged from engagement within setting tool engager 620. In some embodiments, retraction of the engaging device relative to the mandrel 412 is effected in response to shearing of shear pins that form part of the setting tool and otherwise limit relative displacement of the setting tool engaging device relative to the outer sleeve portion of the setting tool.

Figure 20:
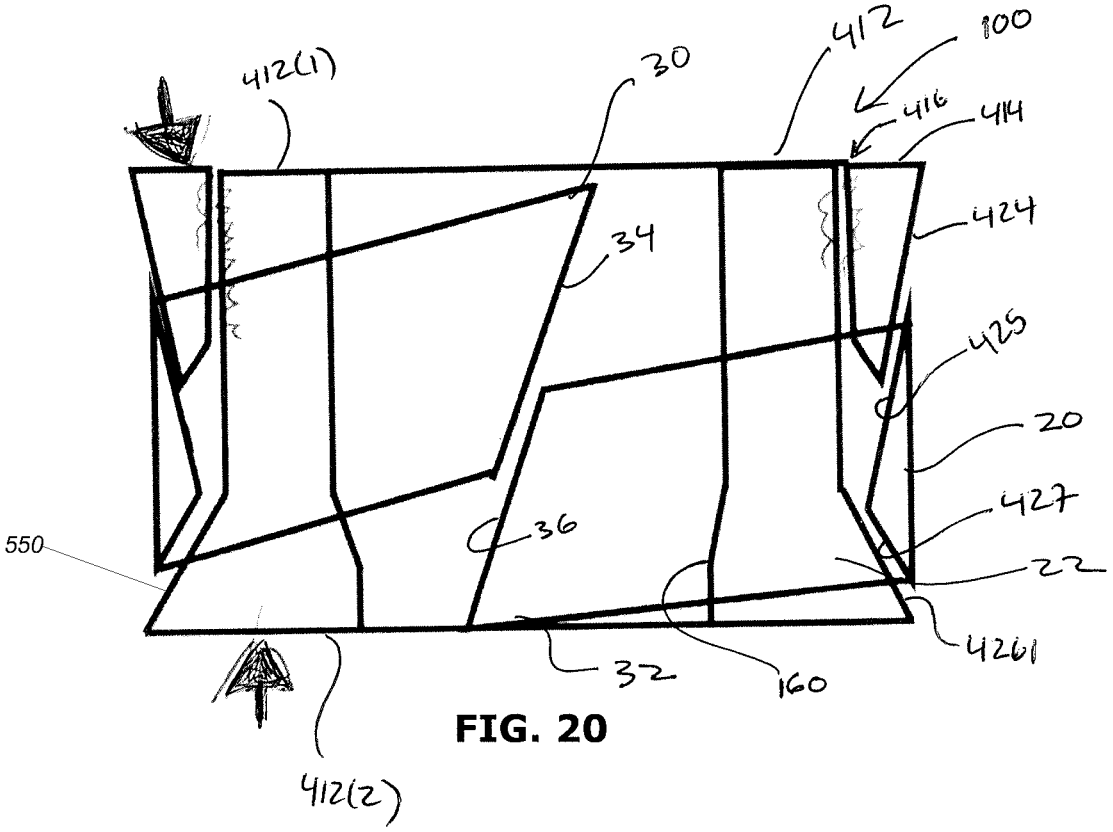
FIG. 20 is a schematic illustration of a front view of the wellbore completion apparatus of FIG. 16 illustrating the actuation forces transmitted to the apparatus.
Figure 21:
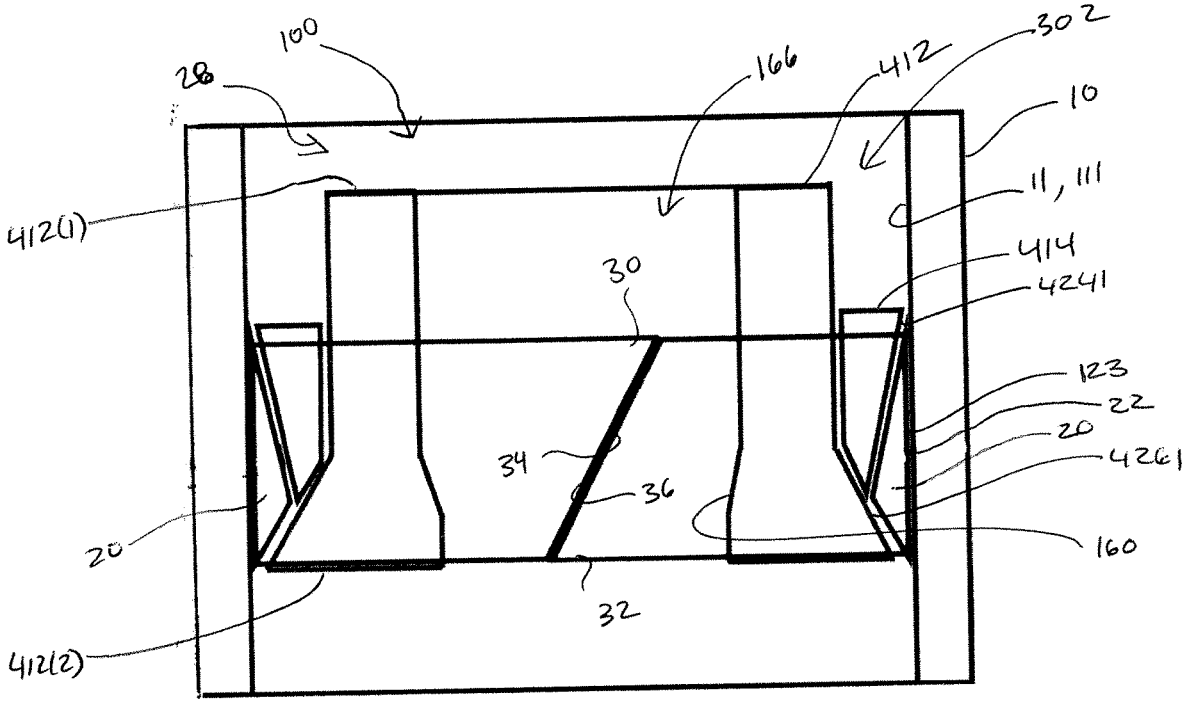
FIG. 21 is a schematic illustration of the wellbore completion apparatus of FIG. 20 having transitioned from the engagement-ready state to the engagement state.
Figure 22:
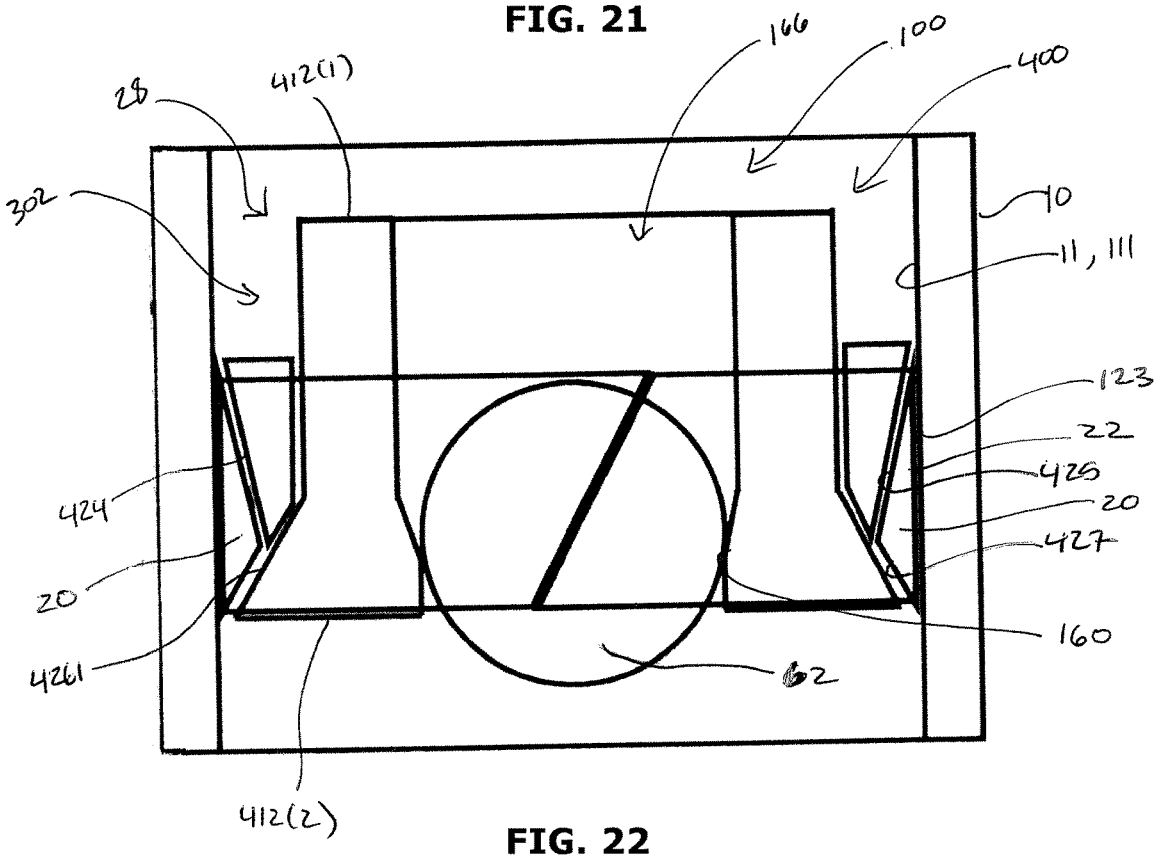
FIG. 22 is a schematic illustration of a wellbore obstruction device seated within the wellbore completion apparatus of FIG. 21.

Referring now to FIGS. 20-22, there is shown another example embodiment of the wellbore completion apparatus 100 according to the present disclosure wherein the engager 20 is mounted on an actuating assembly 400 that includes a mandrel 412 and an actuator 414.

With reference to FIG. 20, the apparatus 100 is disposed in the engagement-ready state 26 wherein engager 20 and the actuating assembly 400 are co-operatively disposed in a first configuration 301. While disposed in the engagement-ready state 26, the engager 20 is disposed about the actuating assembly 400 in a helical configuration 200 such that the first free end 30 and the second free end 32 of the engager 20 are spaced apart from each other by a minimum distance having a component that extends along an axis that is parallel to the central axis 19 of the apparatus 100. As described above in connection with the previous embodiments, while the apparatus 100 is disposed in the engagement-ready state 26, the engageable surface 22 defined by the engager 20 is spaced apart from the central axis 19 of the apparatus 100 by the minimum distance D1 (a distance that is measured along an axis that is perpendicular to the central axis 19). While the engager 20 and the actuating assembly 400 are co-operatively disposed in the first configuration 301, the actuating assembly 400 is disposed for receiving an actuation force from the setting tool, as illustrated by the schematic directional arrows included in FIG. 20 illustrating the application of the actuation force via the setting tool.

Actuation of the actuating assembly 400, in response to application of the actuation force applied to the apparatus 100 by the setting tool is with effect that the engager 20 and the actuating assembly 400 become co-operatively disposed in a second configuration 302, as illustrated in FIGS. 21 and 22. In the second configuration 302, the engager 20 and the actuating assembly 400 are co-operatively disposed such that the engager 20 defines the engageable surface-defining loop 25, wherein the engageable surface 22 of the engageable surface-defining loop 25 is disposed further outwardly relative to the central axis 19 of the apparatus 100 relative to the disposition of the engageable surface 22 of the engager 20 while disposed in the engagement-ready state 26. Actuation of the apparatus 100 such that the engager 200 transitions from the helical configuration 200 associated with the engagement-ready state 26 to the configuration defining the engageable surface-defining loop 25 associated with the engagement state 28 is effected by displacement of the actuator 414 relative to the mandrel 412, from a first position proximal the first end 412(1) of the mandrel 412 to a second position proximal the second end 412(2) of the mandrel 412. Displacement of the actuator 414 relative to the mandrel 412 from the first position to the second position effects wedging of the actuator 414 between an inner surface 64 of the engager 20 and an outer surface of the mandrel 412. The wedging of the actuator 414 between the inner surface 64 of the engager 20 and the outer surface of the mandrel 412 effects outward displacement of the engager 20, relative to the central axis 19 of the apparatus 100, such that the engager 20 transitions from the helical configuration in the engagement-ready state 26 to the configuration defining the engageable surface defined loop 25 in the engagement state 28.

As in the previously described embodiments, displacement of the actuator 414 relative to the mandrel 412 includes displacement via meshing of corresponding sets of teeth defined on corresponding surfaces of the mandrel 412 and the actuator 414. In some embodiments, displacement of the actuator 414 relative to the mandrel 412 from the first position to the second position is effected via a ratchet mechanism.

In the subject example embodiment, the outward displacement of the engageable surface 22 of the engager 20 that is effected in response to displacement of the actuator 414 relative to the mandrel 412 from the first position (illustrated in FIG. 20) to the second position (illustrated in FIGS. 21 and 22), is effected in response to relative sliding displacement between a first actuation surface 424, defined by an outer surface of the actuator 414, and a corresponding first portion 425 the inner surface of the engager 20 as the actuator 414 is displaced relative to the mandrel 412 and is wedged between the mandrel 412 and the engager 20. The relative sliding displacement between the first actuation surface 424, defined by the actuator 414, and the corresponding first portion 425 of the inner surface of the engager 20 effects outward displacement of the engager 20, relative to the central axis 19 of the apparatus. The relative sliding between the first actuation 424 of the actuator 414 and the first portion 425 of the inner surface of the engageable-surface-defining portion 20 is with effect that the engageable-surface-defining portion 20 is disposed further outwardly, relative to the mandrel 412, such that a second portion 427 of the inner surface of the engager 20 is disposed in contact with a second actuation surface 4261 defined by an outer surface of the mandrel 412. In the subject example embodiment, rather than the actuator 414 being disposed within an actuator receiver defined by the second end 412(2) of the mandrel 412, the outwardly flared second actuation surface 4261 defined by the mandrel 412 serves to support the actuator 414 and engager 20 while the apparatus 100 is disposed in the engagement state 28.

Figure 23:
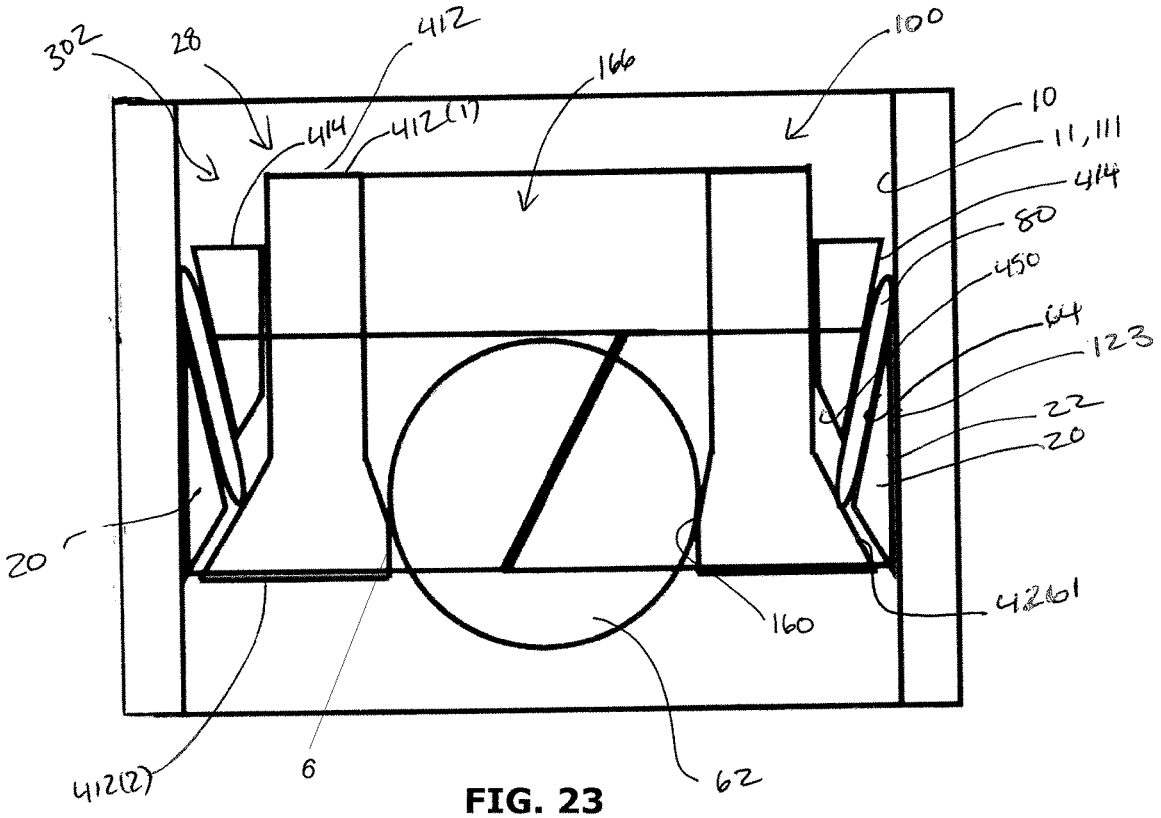
FIG. 23 is a schematic illustration of a wellbore completion apparatus according to another example embodiment of the present disclosure deployed in an engagement state wherein the wellbore completion apparatus includes an elastomeric sealing element.
Figure 24:
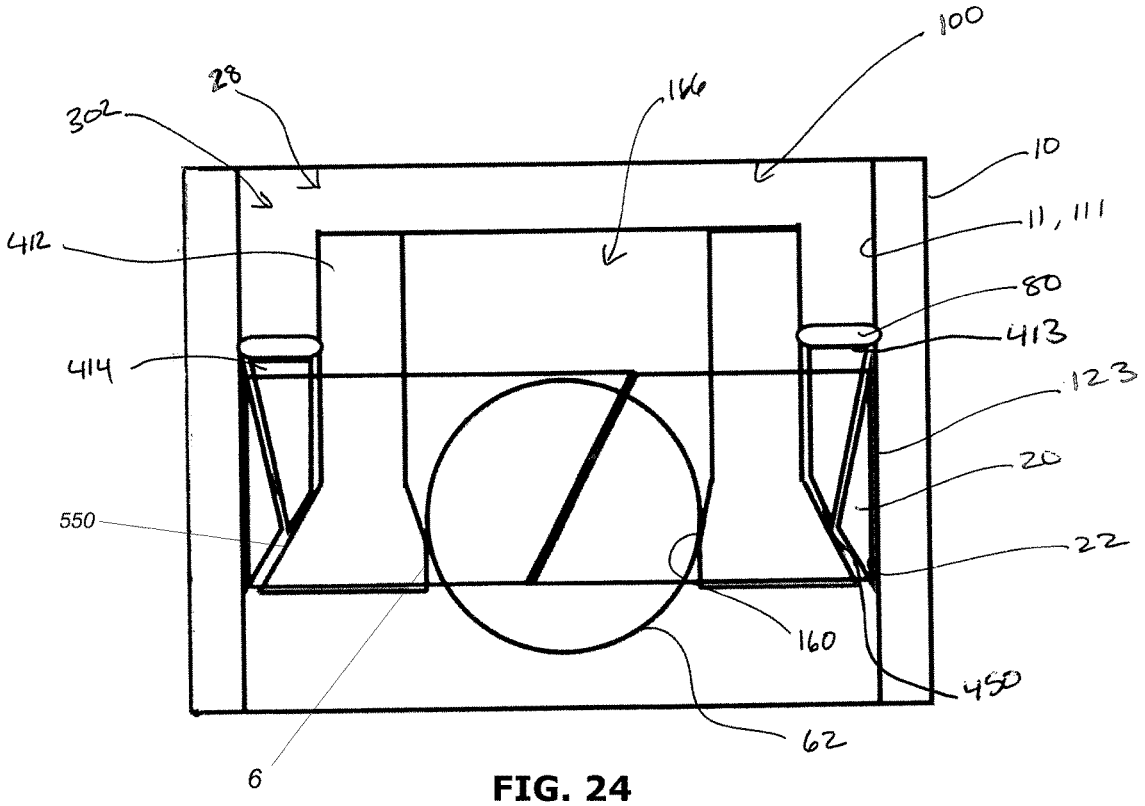
FIG. 24 is a schematic illustration of an alternate embodiment of the wellbore completion apparatus of FIG. 23 in the engagement state wherein the wellbore completion apparatus includes an elastomeric sealing element disposed in an alternate position.

Referring now to FIGS. 23-24, there is shown another example embodiment of the wellbore completion apparatus 100 according to the present disclosure. As illustrated, in some example embodiments, the wellbore completion apparatus 100 further includes a sealing member 80, such as an elastomeric sealing member 80 which, in some instances, contributes to the sealing effect provided across the wellbore completion apparatus 100 while the wellbore completion apparatus 100 is deployed within the wellbore 10 and disposed in the engagement state 28. In some embodiments, for example, the sealing member 80 includes an O-ring.

Referring now, in particular, to FIG. 23, the wellbore completion apparatus 100 includes a sealing member 80 that is disposed between the engager 20 and the actuator 414 of the actuating assembly 400. The sealing member 80 is disposed between the engager 20 and the actuator 414 such that as the apparatus 100 transitions from the engagement-ready state 26 to the engagement state 28 (shown in FIG. 23), the sealing member 80 is compressed between the first actuation surface 424 defined by the actuator 414 and the first portion 425 of the inner surface of the engager 20 as the actuator 414 is displaced relative to the mandrel 412. The compression of the sealing member 80 between the actuator 414 and the inner surface of the engager 20 is with effect that a portion of the sealing member 80 extrudes outwardly from between the engager 20 and the actuator 414, relative to the central axis 19 of the apparatus 100 and is disposed in contact with the passage-defining conductor surface 111 such that a sealed interface 83 is effected between the sealing member 80 and the corresponding portion of the passage-defining conductor surface 111. The sealed interface 83 that is effected between the portion of the sealing member 80 that is extruded from between the engager 20 and the actuator 414, as the apparatus 100 transitions to the engagement state 28, provides a further sealing effect at the interface between the apparatus 100 and the passage-defining conductor surface 111.

As described above in connection with the previously described embodiments, the mandrel 412 defines a passage 166 extending therethrough, from the first end 412(1) to the second end 412(2). The mandrel 412 further defines a seat 160 configured for receiving a wellbore obstruction device 62, the seat 160 extending into the passage 166 defined by the mandrel 412. In some embodiments, the seat 160 is defined by a constriction of the inner diameter of the passage 166 defined by the mandrel 412, as illustrated in FIGS. 23 and 24. Accordingly, while the apparatus 100 is deployed in the wellbore 10 and is disposed in the engagement state 28 and a plug 62 is seated on the seat 160, flow communication across the apparatus 100 is sealed thereby isolating the portion of the passage 13 that extends downhole of the apparatus 100 from the portion of the passage 13 that extends uphole from the apparatus 100.

Referring now to FIG. 24, there is shown an alternate example embodiment of a wellbore completion apparatus 100 including an elastomeric sealing member 80. In such example embodiment, rather than having the sealing member 80 positioned between or sandwiched between the engager 20 and the actuator 414 of the actuating assembly 400, the sealing member 80 is disposed on and supported by an upper surface 413 of the actuator 414. In the subject example embodiment, the sealing member 80 is mounted on the actuator 414 such the sealing member 80 translates together with the actuator 414 as the actuator 414 is displaced relative to the mandrel 412 from the first position, proximal the first end 412(1) to the second position proximal the second end 412(2). As the apparatus 100 transitions from the engagement-ready state 26 to the engagement state 28, the actuator 414 is displaced relative to the mandrel 412 and is outwardly displaced relative to the central axis 19 of the apparatus 100 in response to relative sliding between a lower portion 450 of the actuator 414 and the second actuation surface 4261 defined by the mandrel 412 as the actuator 414 is disposed in the second position proximal the second end 412(2) of the mandrel 412. is of the mandrel 412 includes an outwardly sloping actuation surface 450 which serves to urge the actuator 414 outwardly, relative to the central axis 19 of the apparatus 100 as it is downwardly displaced relative to the mandrel 412. The urging of the actuator 414 over the outwardly sloping second actuation surface 4261, in turn, urges the outward displacement of the engager 20 relative to the central axis of the apparatus 1100 as the actuator 414 wedges further between the inner surface of the engager 20 and the mandrel 412. The outward displacement of the actuator 414 as it moves or slides over the outwardly sloping second actuation surface 4261 brings the sealing member 80 into sealing contact with the passage-defining conductor surface 111.

Figure 25:
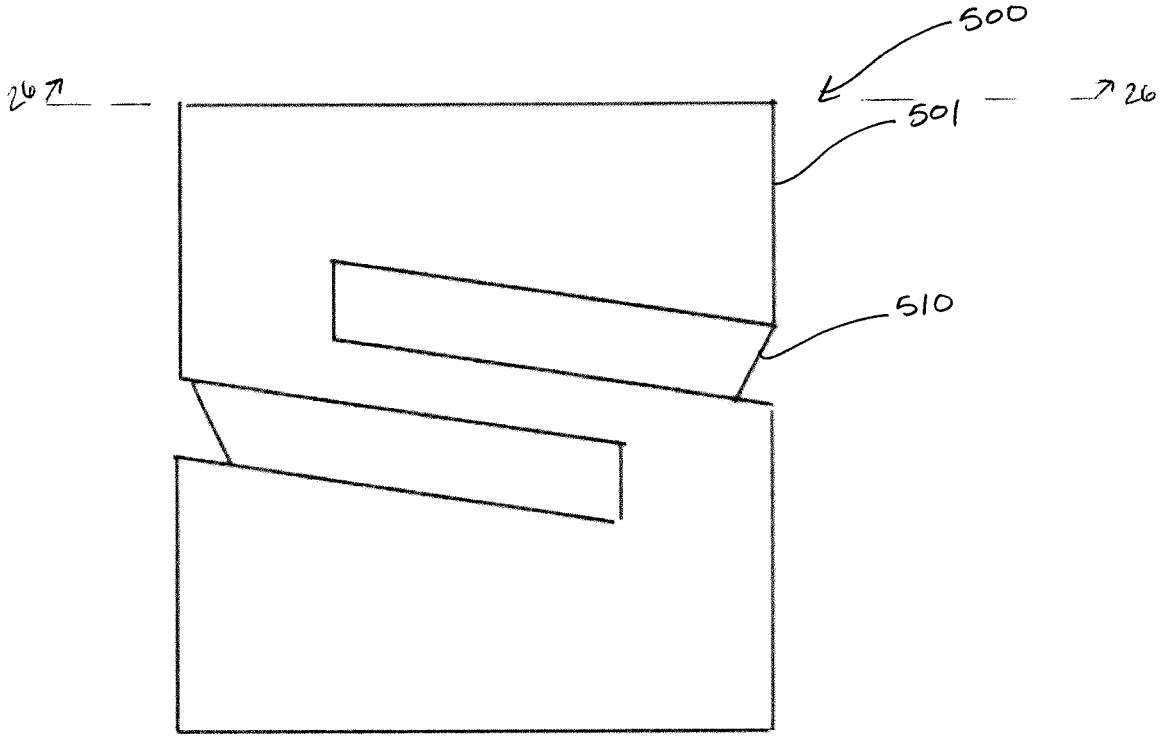
FIG. 25 is a front view of an actuator of a wellbore completion apparatus according to another example embodiment of the present disclosure.
Figure 26:
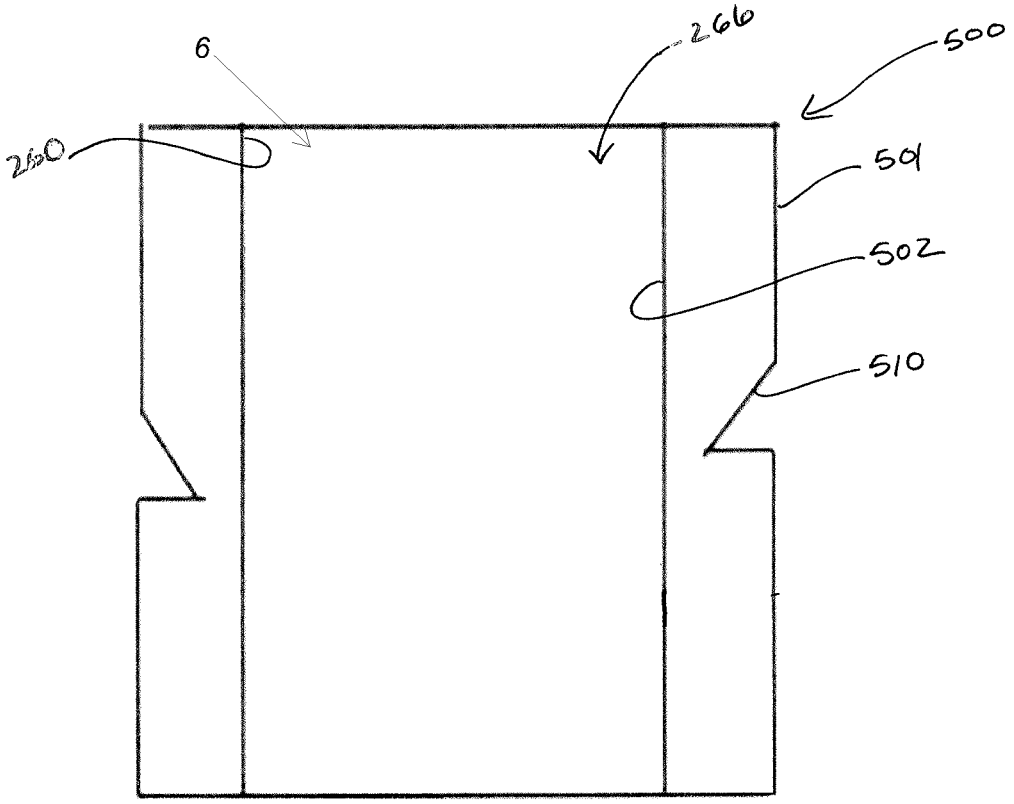
FIG. 26 is a cross-sectional view of the actuator of FIG. 25 taken along section line 26-26 in FIG. 25.
Figure 27:
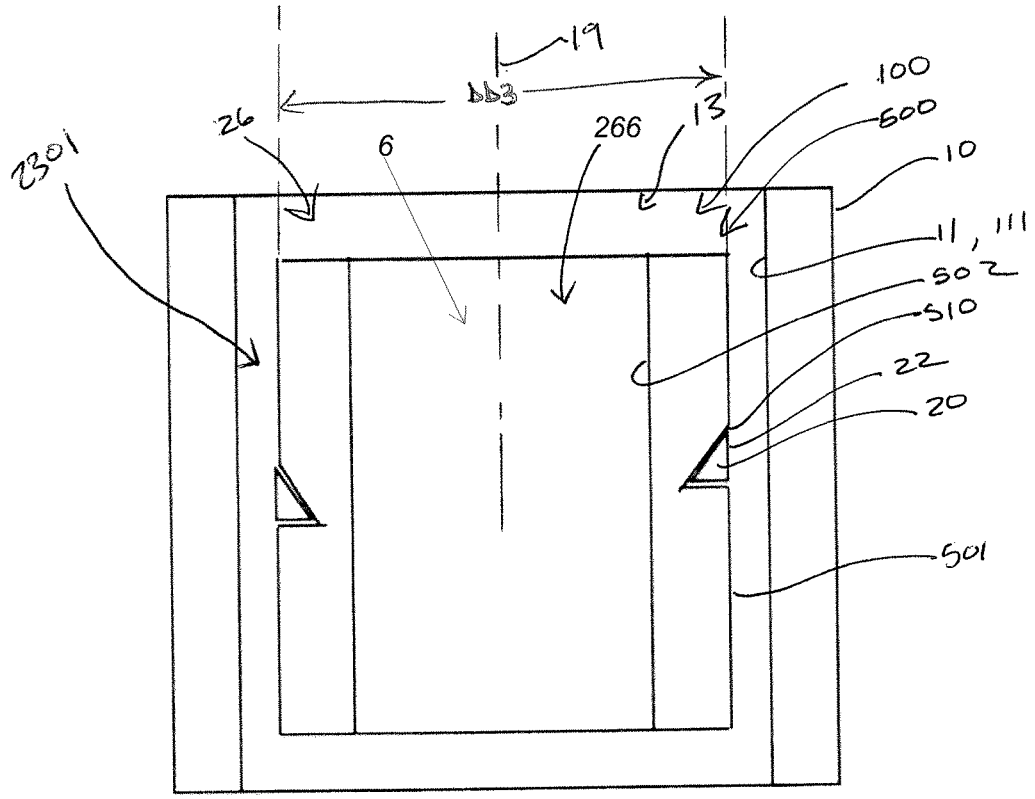
FIG. 27 is a schematic illustration of a cross-sectional view of the wellbore completion apparatus employing the actuator of FIG. 25, disposed within the wellbore in the engagement-ready state.
Figure 28:
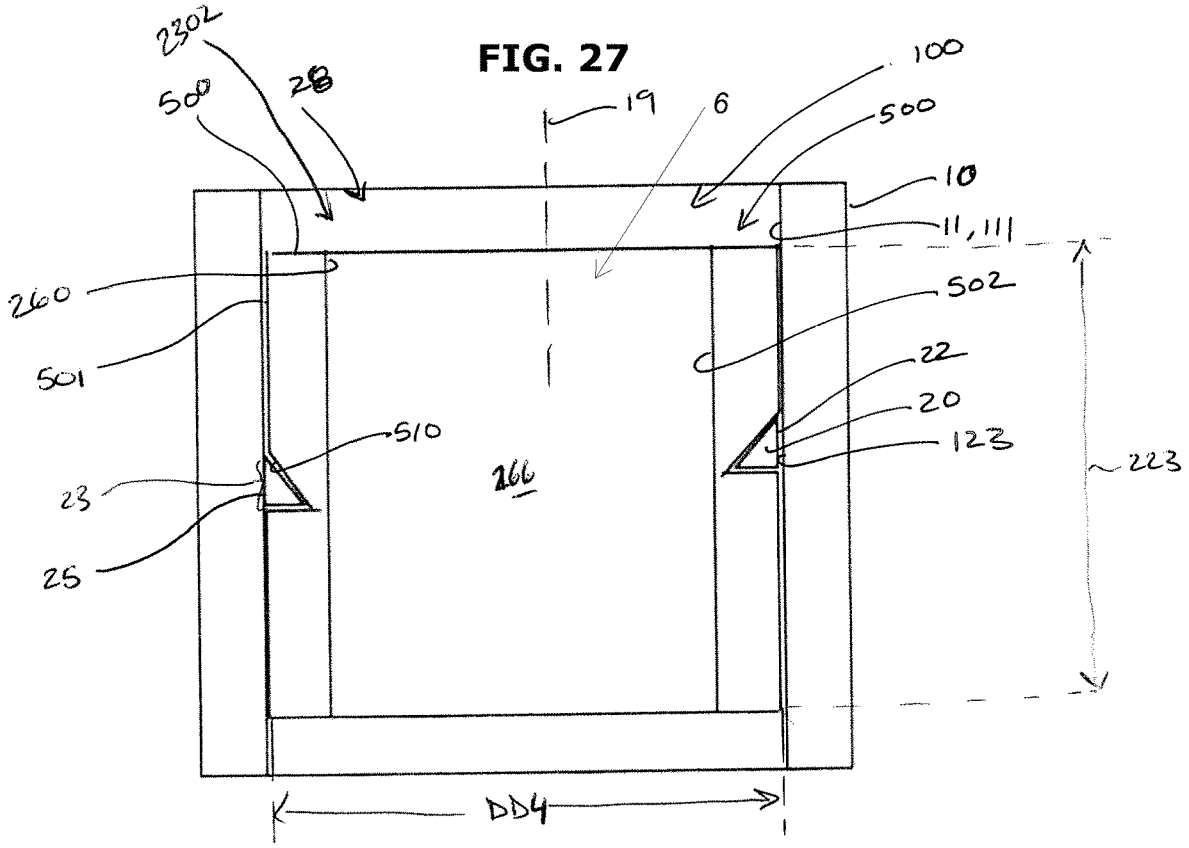
FIG. 28 is a schematic illustration of a cross-sectional view of the wellbore completion apparatus of FIG. 27 in the engagement state.

Referring now to FIGS. 25-29, there is shown another example embodiment of the wellbore completion apparatus 100 according to the present disclosure. In the subject example embodiment, the wellbore completion apparatus 100 includes an actuating assembly in the form of an actuator body 500, as illustrated in FIGS. 25 and 26. The engager 20 is mounted on the actuator body 500 such that, while the apparatus 100 is disposed in the engagement-ready state 26, the engager 20 and the actuator body 500 are co-operatively configured in a first configuration 2301, as illustrated in FIG. 27. While the apparatus 100 is disposed in the engagement state 28, the engager 20 and the actuator body 500 are co-operatively configured in a second configuration 2302, as illustrated in FIG. 28. Transitioning of the apparatus 100 from the engagement-ready state 26 to the engagement state 28, such that the engager 20 and the actuator body 500 transitions from the first configuration 2301 to the second configuration 2302, is with effect that the engageable surface 22 of the engager 20 is displaced further outwardly relative to the central axis 19 of the apparatus 100, relative to the disposition of the engageable surface 22 of the engager 20 while the apparatus 100 is disposed in the engagement-ready state 26.

In the subject example embodiment, the actuator body 500 includes an engager-receiving groove 510, as illustrated in FIGS. 25 and 26. The engager 20 is mounted on actuator body 500 such that the engager 20 is disposed within the engager-receiving groove 510, as illustrated in FIGS. 27 and 28. In some embodiments, the engager-receiving groove 510 is a helical groove disposed within the outer surface of the actuator body 500, and disposition of the engager 20 within the engager-receiving groove 510 is with effect that, while the apparatus 100 is disposed in the engagement-ready state 26, the engager 20 is mounted on the actuator body 500 in a helical configuration. In some embodiments, for example, the engager 20 is secured within the engager-receiving groove 510 by glue or any other suitable adhesive material or adhesive substance. In some embodiments, for example, the engager 20 is secured within the engager-receiving groove 510 using bolts or any other suitable fasteners or fastening device. Accordingly, the engager 20 is secured within the engager-receiving groove 510 such that: (i) the engager 20 remains disposed within the engager-receiving groove 510 during deployment of the apparatus 100 within the wellbore 10, and (ii) the engager 20 translates with the actuator body 500 and remains disposed within the engager-receiving groove 510 as the apparatus 100 transitions from the engagement-ready state 26 to the engagement state 28.

In the subject example embodiment, the actuator body 500 is in the form of an expandable or swellable body. Accordingly, in some embodiments, the actuator body 500 includes elastomers that swell on contact with certain wellbore fluids. Swelling of the actuator body 500 is with effect that the outer surface 501 of the actuator body 500 is disposed further outwardly relative to the central axis of the apparatus 19 (or outwardly relative to the central longitudinal axis of the wellbore 10 while the apparatus 100 is deployed within the wellbore 10). Accordingly, actuation of the apparatus 100 such that it transitions from the engagement-ready state 26 to the engagement state 28 is effected by expansion of the actuator body 500 as the actuator body 500 swells in response to contact with certain wellbore fluids. Therefore, while the apparatus 100 is disposed within the wellbore 10 and is deployed to the desired location, delivery of a predetermined wellbore fluid through the wellbore 10 such that the predetermined wellbore fluid comes into contact with the apparatus 100, effects expansion of the actuator body 500 such that the engageable surface 22, of the engager 20 is disposed in engagement with the conductor surface-defined loop 123 with effect that the apparatus 100 is disposed in the engagement state 28, as illustrated in FIG. 28. The expansion of the actuator body 501 is such that the engager 20 remains disposed within the engager-receiving groove 510 and secured to the actuator body 500. As in the previously described embodiments, the engagement between the engageable surface 22 of the engager 20 and the conductor surface-defined loop 123 includes gripping engagement. In some embodiments, the engagement between the engageable surface 22 of the engager 20 and the conductor surface-defined loop 123 includes sealing engagement such that a sealed interface is effected between the engageable surface 22 and the conductor surface-defined loop 123.

In the subject example embodiment, actuation of the apparatus 100 such that the apparatus 100 transitions from the engagement-ready state 26 (illustrated in FIG. 27) to the engagement state 28 (illustrated in FIG. 28), such that the engager 20 is disposed further outwardly relative to the central axis 19 of the apparatus 100, is effected by outward displacement of the engageable surface 22 of the engager 20 relative to the central axis 19 along a helical path. The outward displacement of the engager 20 along the helical path that is effected by expansion of the actuator body 500. The expansion of the actuator body 500 effects deformation of the engager 20 such that the engager 20 transitions from the helical configuration illustrated in FIG. 27, wherein the first free end 30 and the second free end 32 are spaced apart from each other by a distance having a component that extends along an axis parallel to the central axis 19 of the apparatus 100 to a configuration wherein the first free end 30 and second free end 32 of the engager 20 are disposed proximal to each other along an axis that extends parallel to the central axis 19 of the apparatus 100 such that the outermost surface of the engageable surface 22 of the engager 20 is displaced further outwardly relative to the central axis 19 of the apparatus 100. Accordingly, in the subject example embodiment, given that the engager 20 is mounted within the engager receiving groove 510, the first and second free ends 30, 32 do not meet in abutting engagement as the apparatus 100 transitions to the engagement-ready state 28. Accordingly, in the subject example embodiment, the engageable surface-defining loop 25 that defines the interface with the conductor surface-defined loop 123 is established by the engageable surface 22 of the engager 20 and at least a portion of the outer surface 501 of the actuator body 500. Therefore, in the subject example embodiment, while the apparatus 100 is disposed in the engagement-ready state 26, the engager 20 is disposed in a first helical configuration and while the apparatus 100 is disposed in the engagement state 28, the engager 20 is disposed in a second helical configuration, as illustrated schematically in FIG. 28A. While the engager 20 is disposed in the second helical configuration associated with the engagement state 28, the engagement between the engageable surface 22 of the engager 20 and the conductor surface-defined loop 123 still provides a gripping engagement with the conductor surface-defined loop 123 such that displacement of the wellbore completion apparatus 100 in a direction perpendicular to an axis that is normal to the passage-defining conductor surface 111 is resisted.

Figure 28A:
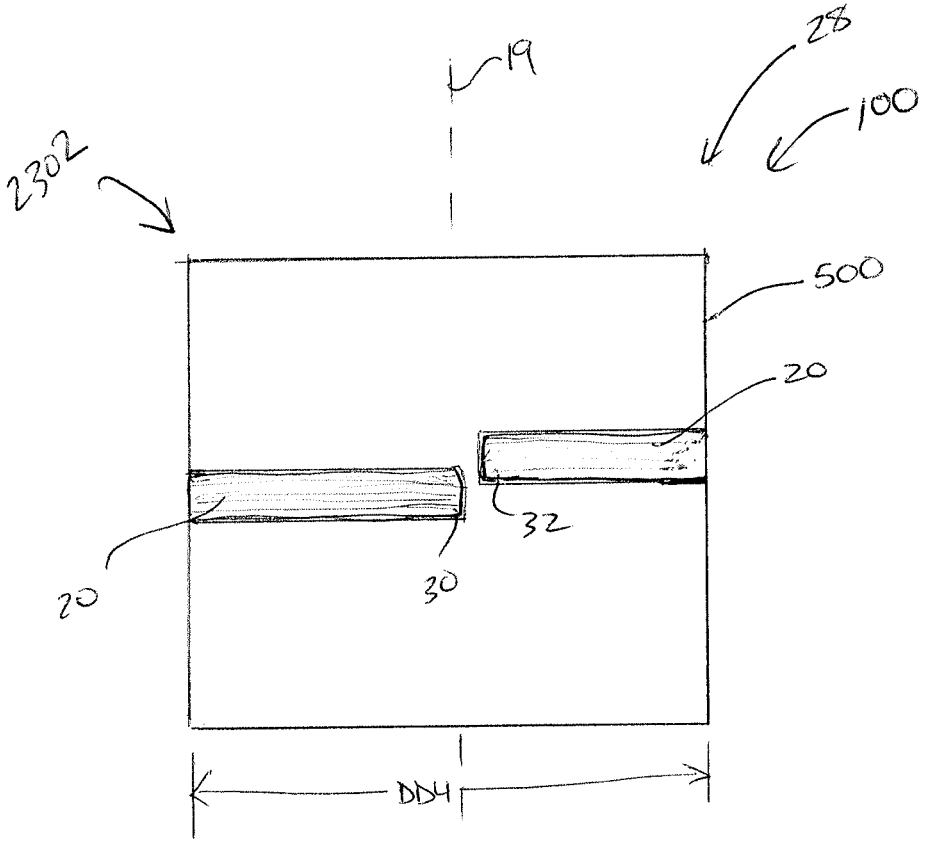
FIG. 28A is a schematic illustration of a front view of the wellbore completion apparatus of FIG. 28 in the engagement state.
Figure 29:
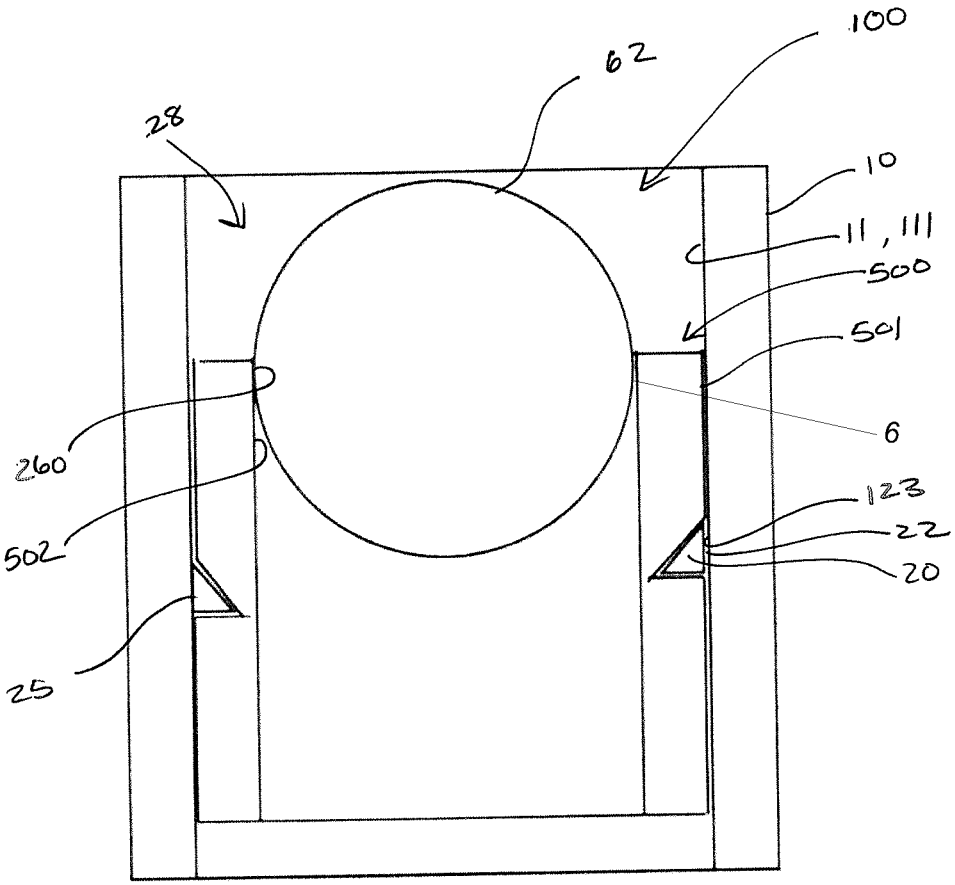
FIG. 29 is a schematic illustration of wellbore obstruction device seated on the wellbore completion apparatus of FIG. 28.

In the subject example embodiment, while disposed in the engagement-ready state 26, the engager 20 is mounted within the engager-receiving groove 510 on the actuator body 500 in a helical configuration 200 such that first free end 30 and the second free end 32 of the engager 20 are spaced apart from each other along an axis having a component that is parallel to the central axis 19 of the apparatus 100. See, for instance, FIG. 26 which illustrates the configuration of the corresponding first end 30' and the corresponding second end 32' of the engager-receiving groove 510 while the actuator body 500 is disposed in the engagement-ready state 26 which corresponds to the configuration of the first and second free ends 30, 32 of the engager 20 while the engager 20 is disposed within the receiving groove 510. Expansion of the actuator body 500, via swelling, is with effect that that the engager 20 is deformed from the first helical configuration to the second helical configuration. Accordingly, the deformation of the engager 20 that occurs as the apparatus 100 transitions from the engagement-ready state 26 to the engagement state 28 is effected as the actuator body 500 expands from a first, reduced diameter state illustrated in FIG. 27 to a second, expanded state, via swelling, as illustrated in FIGS. 28 and 28A. Accordingly, while the engager 20 and the actuator body 500 are cooperatively disposed in their first configuration 2301, the actuator body 500, together with the engager 20, defines an outer diameter, DD3. In the engagement state 28, the actuator body 500, together with the engager 20, defines an outer diameter, DD4, that is greater than the outer diameter, DD3, defined in the engagement-ready state 26. Actuation of the apparatus 100 such that it transitions from the engagement-ready state 26 to the engagement state 28, is effected by expansion of the actuator 500 such that the actuator body 500 transitions from the outer diameter, DD3, defined by the engagement-ready state 26, to the expanded, outer diameter, DD4, defined by the engagement state 28. Accordingly, expansion of the actuator 500 is with effect that the engageable surface 22 of the engager 20 is disposed further outwardly, relative to the central axis 19 of the apparatus 100.

The flow communicator 6 is defined by the actuator body 500 and is in the form of a passage 266 that extends through the actuator body 500. The passage 266 is defined by an inner surface 502 of the actuator body 500. The passage 266 defined by the inner surface 502 of the actuator body 500 is of a reduced diameter relative to the diameter of the passage 13 defined by the passage-defining conductor surface 111 through which the apparatus 100 is deployed. The reduced diameter passage 266 defined by the inner surface 502 of the actuator body 500, therefore, defines a seat 260 configured for receiving a wellbore obstruction device 62. Accordingly, while the apparatus 100 is deployed within the wellbore 10 and disposed in the engagement state 28 such that the engageable surface 22 of the engager 20 that defines the engageable surface-defining loop 25 is disposed in gripping engagement with the conductor surface-defining loop 123, deployment of the wellbore obstruction device 62 through the wellbore 10 is with effect that the wellbore obstruction device 62 becomes seated on the seat 260 such that the wellbore obstruction device 62 occludes the passage 266 defined by the actuator body 500 such that flow communication across the wellbore completion apparatus 100 is sealed.

In the subject example embodiment, actuation of the apparatus 100 into the engagement state 28 is with effect that the outer surface 501 of the actuator body 500 also comes into contact with the passage defining-conductor surface 111 as the actuator body 500 expands, or swells, in response to contact with certain wellbore fluids. Accordingly, in the subject example embodiment, actuation of the apparatus 100 such that the apparatus 100 is disposed in the engagement state 28 is with effect that the outer surface 501 of the actuator body 500 is also disposed in sealing engagement with the passage defining-conductor surface 111 in addition to the gripping engagement and sealing engagement provided by the engagement between the engageable surface 22 of the engageable surface-defining loop 25 and the conductor surface-defined loop 123. Therefore, in the subject example embodiment, a sealed interface 223 is effected between the outer surface 501 of the actuator body 500 and the passage-defining conductor surface 111, the sealed interface 223 including the engaged interface 23 defined between the engageable surface 22 and the conductor surface-defined loop 123 while the apparatus 100 is disposed in the engagement state 28.

Figure 40:
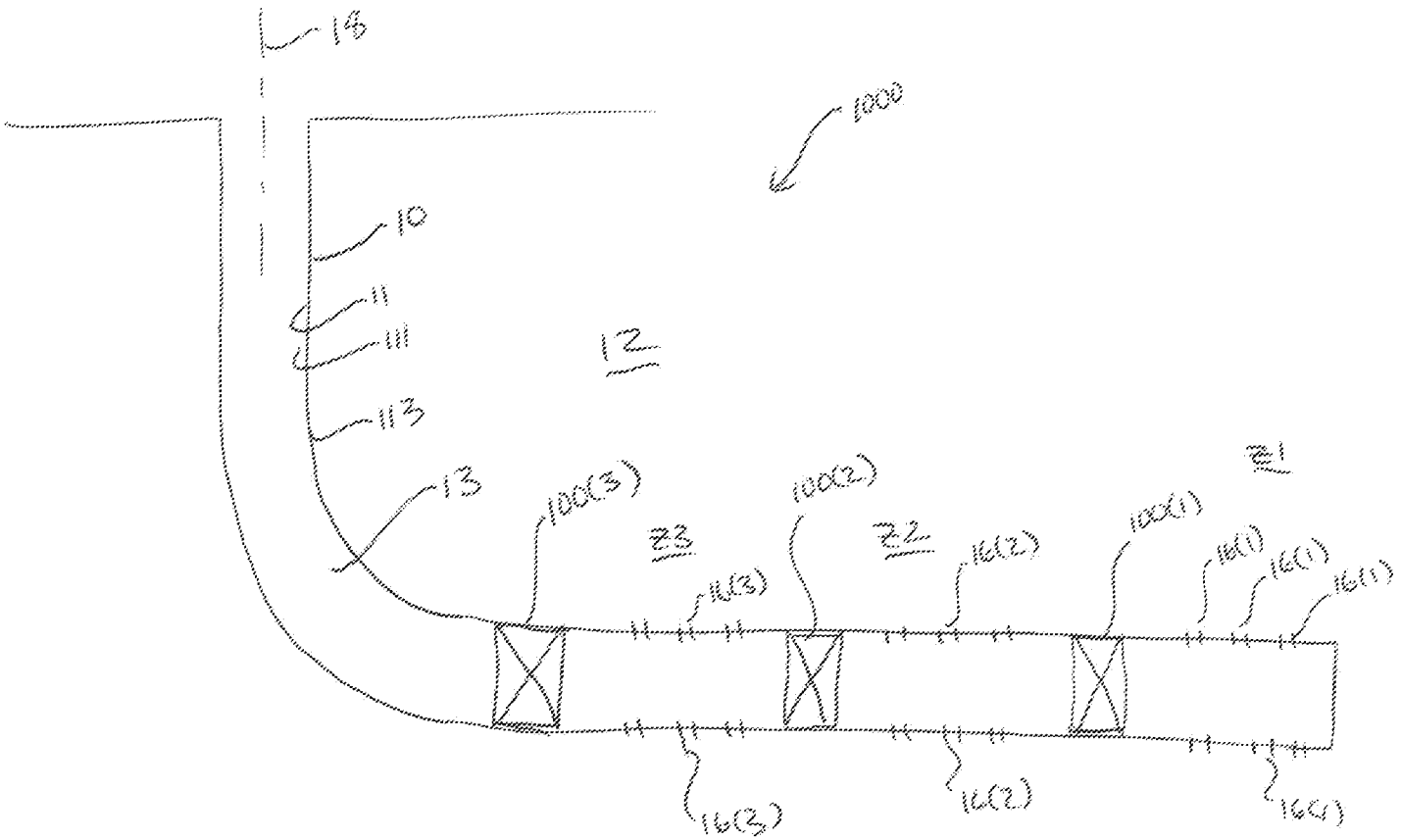
FIG. 40 is a schematic illustration of a system for effecting zonal isolation between the surface and a subterranean formation via a wellbore incorporating the wellbore completion apparatus of the present disclosure.

In some embodiments, for example, the wellbore completion apparatus 100 according to any one of the above-described embodiments includes a frac plug. With reference to FIGS. 34 and 40, an exemplary process for effecting zonal isolation within the wellbore 10 for supplying treatment fluid to specific zones of the subterranean formation 12 through the passage-defining conductor surface 111 disposed within the wellbore 10, incorporating any one of the above-described embodiments of the wellbore completion apparatus 100 will now be described.

A fracturing operation typically begins with stimulation of the subterranean formation 12 at the most downhole region of the wellbore 10. A perforating gun, or any other suitable tool, is deployed to the most downhole region of the wellbore 10 and activated in order to perforate the passage-defining conductor surface 111 to effect flow communication between the passage 13 and the subterranean formation 12 through flow communicators 16. In some embodiments, for example, multiple perforating operations may be effected in series in order to achieve clusters or sets of perforations within a region of the wellbore 10. Once flow communication is established via the flow communicators 16, pressurized fluid is directed, via the passage 13, through the flow communicators 16 (or ports) into the subterranean formation 12 to complete the first stage of the fracturing operation.

Once the first stage of the fracturing operation is complete, a first wellbore completion apparatus 100(1) (or first frac plug), according to any one of the above-described embodiments, is deployed downhole through the passage 13 defined by the passage-defining conductor surface 111 of the wellbore 10 via the conveyance apparatus (not shown) to a region that is uphole of the first set of perforations or flow communicators 16(1) that were used for the first stage of the operation in order to isolate the region associated with the first stage of the operation from the rest of the wellbore 10. The conveyance apparatus includes a setting tool for actuating the wellbore completion apparatus 100(1), and in some instances, may also include the perforating gun. In some instances, the setting tool and the perforating gun are part of a bottomhole assembly (BHA) of the conveyance apparatus. While the wellbore completion apparatus 100(1) is deployed through the passage 13, the wellbore completion apparatus 100(1) is in the engagement-ready state 26. An example embodiment of a wellbore completion apparatus 100 being run-in-hole (RIH) or deployed through the passage 13 defined by the passage-defining conductor surface 111, is illustrated, for example, in top plan view in FIG. 46 with the setting tool and conveyance apparatus removed for ease of illustration. As shown, while the wellbore completion apparatus 100 is being run-in-hole, there is an annular space, or annular gap, 1113 between the wellbore completion apparatus 100 and the passage-defining conductor surface 111 of the casing 11, the annular space 1113 forming part of the passage 13.

Once the first wellbore completion apparatus 100(1) is deployed to the desired location within the wellbore 10, which for the first wellbore completion apparatus 100(1) is a region uphole of the first set of perforations or flow communicators 16(1), the setting tool is activated which effects actuation of the wellbore completion apparatus 100 (1) such that the wellbore completion apparatus 100(1) transitions from the engagement-ready state 26 to the engagement state 28. Transitioning of the wellbore completion apparatus 100(1) from the engagement-ready state 26 to the engagement state 28 is with effect that the engager 20 is outwardly displaced, relative to the central axis 19 of the apparatus 100(1) (and relative to the central longitudinal axis 18 of the wellbore 10) such that the engageable surface 22 is disposed in engagement with the wellbore-surface defined loop 123 of the passage-defining conductor surface 111 with effect that a sealed interface is created between the engageable surface 22 of the engageable surface-defining loop 25 and the wellbore-surface defined loop 123. An example embodiment of the wellbore completion apparatus 100 disposed in the wellbore 10 in the engagement state 28 wherein the engageable surface 22 is disposed in engagement with the passage-defining conductor surface 111 such that the wellbore completion apparatus 100 is self-supported relative to the casing 11 is illustrated, for example, in top plan view in FIG. 47. As shown, the annular space 1113 between the wellbore completion apparatus 100 and the passage-defining conductor surface 111 is no longer present due to the outward expansion of the engager 20 of the wellbore completion apparatus 100, relative to the central axis 19 of the apparatus 100 (and relative to the central axis 18 of the wellbore 10).

Once the wellbore completion apparatus 100(1) is set in position within the wellbore 10, the perforating gun is activated in order to perforate the passage-defining conductor surface 111 in a region that is uphole of the location of where the first wellbore completion apparatus 100(1) has been set. Once the passage-defining conductor surface 111 is perforated, fluid communication between the region of the subterranean formation 12 that is proximal the second set of flow communicators 16(2), or second zone, z2, of the subterranean formation 12, and the passage 13 is established.

Once the first wellbore completion apparatus 100(1) is set in position and the passage-defining conductor surface 111 is perforated, a wellbore obstruction device 62, such as a plug, dart or drop ball, is deployed within the wellbore 10 and will land on the seat 60 defined by the first wellbore completion apparatus 100(1). Once the wellbore obstruction device 62 is seated on the seat 60 defined by the first wellbore completion apparatus 100(1), thereby occluding the flow communicator 6 defined by the wellbore completion apparatus 100 (as shown, for example, in FIG. 47), flow communication across the wellbore completion apparatus 100(1) is sealed, effectively isolating the first set of flow communicators 16(1) from the second set of flow communicators 16(2). Accordingly, once the wellbore obstruction device 62 is seated on the seat 60 defined by the first wellbore completion apparatus 100(1), the first wellbore completion apparatus 100(1) serves to isolate the wellbore 10 into two sections, namely a first section located below or downhole of the wellbore completion apparatus 100(1), and second uphole section located above the first wellbore completion apparatus 100(1).

Once the first zone z1 is effectively isolated by the first wellbore completion apparatus 100(1) and the wellbore obstruction device 62, the second stage of the fracturing operation can begin wherein pressurized fluid is pumped downhole and is directed into the subterranean formation 12 through only the second set of flow communicators 16(2). During the fracturing operation, high pressure is exerted on the uphole side of the wellbore completion apparatus 100(1). The engagement between the engageable surface 22 of the engager 20 of the apparatus 100(1) and the conductor surface-defined loop 132 of the passage-defining conductor surface 111 is such that displacement of the wellbore completion apparatus 100(1), relative to the passage-defining conductor surface 111 or the passage-defining conductor surface 111, in a direction that is perpendicular to an axis that is normal to the engageable surface 22, while stimulation of the subterranean formation via the fracturing operation is underway, is resisted. Accordingly, the engagement between the engageable surface 22 of the engager 20 of the apparatus 100(1) and the conductor surface-defined loop 123 of the passage-defining conductor surface 111 is such that displacement of the wellbore completion apparatus 100(1), relative to the passage-defining conductor surface 111 or the passage-defining conductor surface 111, in a direction parallel to the central longitudinal axis 18 of the wellbore 10, while stimulation of the subterranean formation 12 via the fracturing operation is underway, is resisted.

Once the fracturing operation for the second zone, z2, associated with the first wellbore completion apparatus 100(1) is complete, a second wellbore completion apparatus 100(2) is deployed to the desired location within the wellbore 10, which for the second wellbore completion apparatus 100(2) is a location that is uphole of the perforations or flow communicators 16(2) that were associated with the second stage or second zone, z2, of the fracturing operation. Once deployed to the desired location, the setting tool is activated, which actuates the second wellbore completion apparatus 100(2) causing it to transition from the engagement-ready state 26 to the engagement state 28 such that the second wellbore completion apparatus 100(2) is set relative to the passage-defining conductor surface 111 of the wellbore 10.

Once the second wellbore completion apparatus 100(2) is set in position within the wellbore 10, the perforating gun is activated in order to perforate the passage-defining conductor surface 111 in a region that is uphole of the location of where the second wellbore completion apparatus 100(2) has been set. Once the passage-defining conductor surface 111 is perforated and fluid communication between the region of the subterranean formation 12 that is proximal the third set of flow communicators 16(3), or third zone, z3, of the subterranean formation 12, and the passage 13 is established and the conveyance apparatus with the setting tool and perforating gun removed, a wellbore obstruction device 62 is deployed within the wellbore 10 and will land on the seat 60 defined by the second wellbore completion apparatus 100(2). Once the wellbore obstruction device 62 is seated on the seat 60 of the second wellbore completion apparatus 100(2) and flow communication across the wellbore completion apparatus 100(2) is sealed thereby isolating the second set of flow communicators 16(2) from the third set of flow communicators 16(3), the third stage of the fracturing operation can begin.

This process is repeated until all of the desired zones of the subterranean formation 12 have been stimulated via the fracturing operation. After the subterranean formation 12 has been sufficiently treated in each of the zones, production of the reservoir fluid from the subterranean formation 12 to the surface 14 can begin.

In order to begin production through the wellbore, flowback through the plurality of wellbore completion apparatuses 100 is permissible given that each of the wellbore obstruction devices 62 (e.g. drop balls) can unseat from the corresponding wellbore completion apparatus 100(*n*) and be pushed uphole as downhole pressure increases with the flow of production fluid via the flow communicator 6, thereby enabling production of production fluid to the surface.

In order to achieve a full production diameter through the wellbore 10, however, the wellbore completion apparatuses 100(*n*) can be removed from their set positions within the wellbore 10. In some example embodiments, the wellbore completion apparatuses 100(*n*) are made of dissolvable material and will eventually dissolve within the wellbore 10 upon contact with certain wellbore fluids so that a full production diameter through the wellbore 10 or passage 13 is achieved. In some example embodiments, the wellbore completion apparatuses 100(*n*) are milled out by way of a milling tool that is deployed through the wellbore 10. Given that the engagement interface 23 defined by the engageable surface 22 of the wellbore completion apparatus 100, according to the example embodiments of the present disclosure, which spans a minimum distance, measured along an axis that is parallel to the central axis of the apparatus 100, that is reduced, as compared to traditional frac plugs, milling out procedures may be facilitated. In instances where the wellbore completion apparatuses 100(*n*) include dissolvable materials, the time for the wellbore completion apparatus 100(*n*) to dissolve may also be reduced as compared to know dissolvable frac plugs.

Accordingly, in some embodiments, the present disclosure relates to a system comprising the wellbore completion apparatus 100 disposed within the wellbore 10.

In some embodiments, the system 1000 includes the wellbore completion apparatus 100 disposed in the engagement state 28 wherein the engageable surface 22 is engaging the passage-defining conductor surface 111 of the wellbore 10. In some embodiments, for example, the system 1000 is such that the engagement of the engageable surface 22 to the passage-defining conductor surface 111 includes a sealing engagement. In some embodiments, the system 1000 is such that the engagement of the engageable surface 22 to the passage-defining conductor surface 111 includes a gripping engagement with effect that displacement of the wellbore completion apparatus 100, relative to the passage-defining conductor surface 111 or conductor surface-defined loop 123, in a direction perpendicular to an axis that is normal to the engageable surface 22, is resisted.

In some embodiments, for example, the system 1000 further comprises a plug or wellbore obstruction device 62. In such embodiments, while the plug or wellbore obstruction device 62 is seated on the seat 60, defined by the wellbore completion apparatus 100 while disposed in the engagement state 28, the system 1000 provides a sealed effect across the apparatus 100 such that flow communication through the passage 13 defined by the wellbore 10, across the apparatus 100, is sealed. Accordingly, in instances where the wellbore completion apparatus 100 is in use as a frac plug, once the wellbore obstruction device 62 is seated on the seat 160, wellbore operations to perforate the casing 11 to effect fluid communication between the wellbore 10 and the subterranean formation 12 and delivery of pressurized fluid to the subterranean formation 12, from the surface 14, via the wellbore 10, for stimulating the subterranean formation 12 may be effected.

Figure 30:
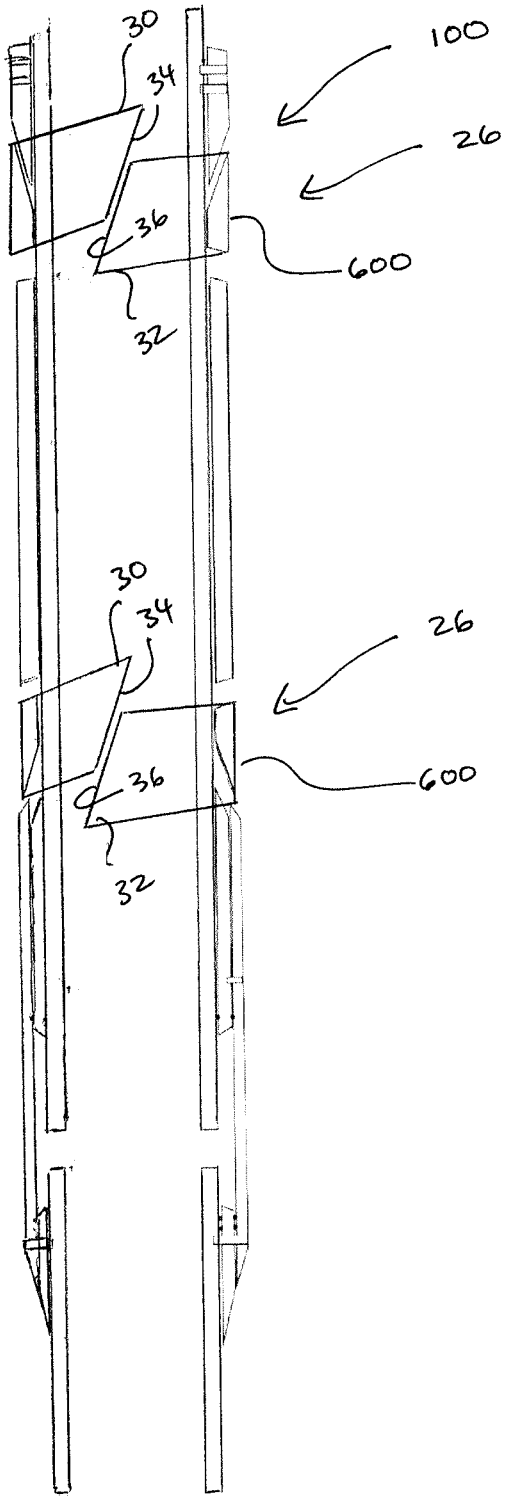
FIG. 30 is a schematic illustration of a wellbore completion apparatus according to another example embodiment of the present disclosure in use as a back-up ring, in an engagement-ready state.
Figure 31:
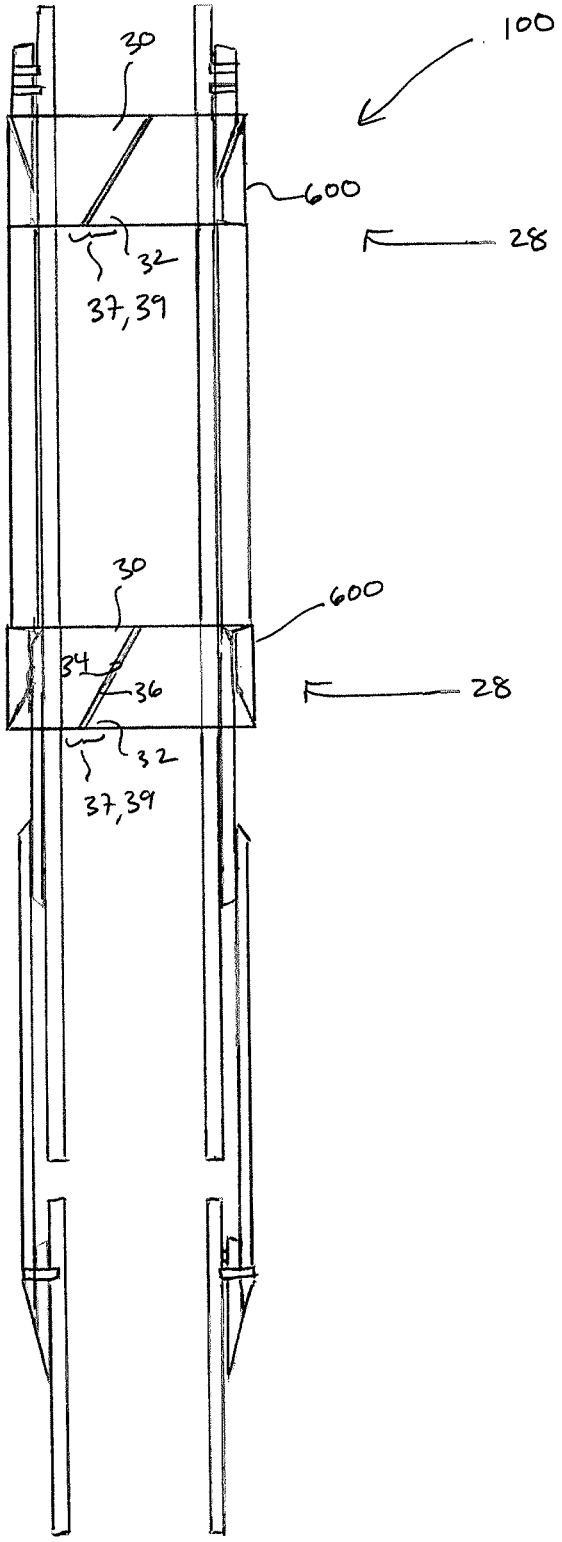
FIG. 31 is a schematic illustration of the wellbore completion apparatus of FIG. 30 in the engagement state.
Figure 22:
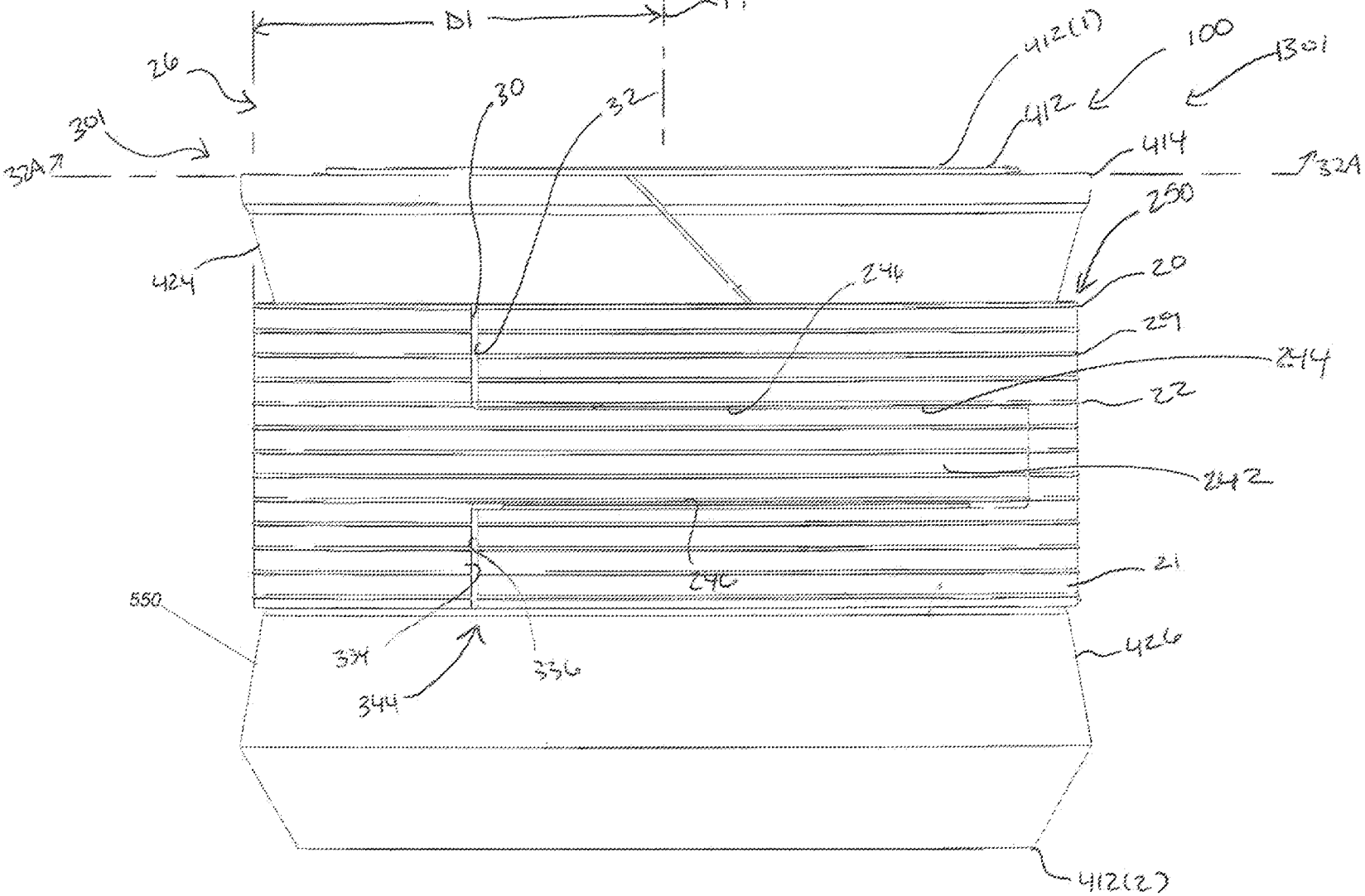

Referring now to FIGS. 30-31, there is shown another example embodiment of the wellbore completion apparatus 100 according to an example embodiment of the present disclosure.

As illustrated schematically in FIGS. 30-31, the wellbore completion apparatus 3100 is in the form of a back-up ring for effecting retention of a sealing member. In such example embodiment, actuation of the apparatus 100 such that the apparatus 100 transitions from the engagement-ready state 326 to the engagement state 328 such that at least a portion of the apparatus 100 is disposed further outwardly relative to the central axis 19 of the apparatus 100 effects retention of a sealing member relative to a wellbore feature as disposition of the apparatus 100 in the engagement state 328 blocks at least a portion of an annular space that exists between the passage-defining conductor surface 111 and the wellbore feature incorporating the sealing member. Accordingly, in some embodiments the apparatus 100 is disposed within the wellbore 100 and used in conjunction with an independent sealing member such that, while the apparatus 100 is disposed in the engagement state 328, the engager 20 reduces the gap or annulus between the passage-defining conductor surface 111 and a wellbore feature of other wellbore completion device for preventing extrusion or displacement of the sealing member through the gap or annulus when the sealing member is subjected to higher pressure situations.

Accordingly, in some embodiments, the present disclosure relates to a system 3000 comprising the wellbore completion apparatus 100 disposed within the wellbore 10 for use as a back-up ring for retaining a sealing member relative to a wellbore feature.

Therefore, while the wellbore completion apparatus disclosed in the present disclosure may be used as a frac plug, for effecting zonal isolation within a wellbore 10, it will be understood that, in some embodiments, the wellbore completion apparatus can be used for other applications within a wellbore and that the wellbore completion apparatus is not necessarily limited to use a frac plug. More specifically, in some embodiments, for example, the wellbore completion apparatus 100 can be used as a bridge plug, a cement retainer or an abandonment plug. However, it will be understood that the wellbore completion apparatus 100 is not necessarily limited to these uses and can be used in any application wherein an outward displacement of an outermost surface of an engageable surface-defining portion 20 from an engagement-ready state 26 to an engagement state 28 is required.

While various example embodiments of the wellbore completion apparatus have been described, it will be understood that certain adaptations and modifications of the described embodiments can be made. Therefore, the above discussed embodiments are considered to be illustrative and not restrictive.

What is claimed is:

1. A wellbore completion apparatus configured for deployment through a passage defined within a wellbore, comprising:

an engager;

wherein:

the apparatus is configurable in at least an engagement-ready state and an engagement state;

in the engagement-ready state:

the engager includes a first free end and a second free end;

the first free end is displaceable relative to the second free end;

in the engagement state:

the engager defines an engageable surface-defining loop; and the engageable surface-defining loop defines an engageable surface for engaging a wellbore surface of the wellbore;

the apparatus is transitionable from the engagement-ready state to the engagement state in response to relative displacement between the first free end and the second free end;

and the engageable surface is a band; and in the engagement state, the band has a minimum height of at least 0.25 inches.

2. The wellbore completion apparatus as claimed in claim 1;

wherein:

the passage is a casing.

3. The wellbore completion apparatus as claimed in claim 1;

wherein:

the wellbore surface is a wellbore surface-defined loop.

4. The wellbore completion apparatus as claimed in claim 1;

wherein:

the engagement for which the engageable surface is configured includes a gripping engagement to the wellbore surface; and the gripping engagement is with effect that displacement of the apparatus, relative to the wellbore surface, in a direction that is perpendicular to an axis that is normal to the engageable surface, is resisted.

5. The wellbore completion apparatus as claimed in claim 4;

wherein:

the resisted displacement includes displacement which is urged by a force, of at least 1000 pound-force, applied in a direction that is parallel to the central longitudinal axis of the wellbore.

6. The wellbore completion apparatus as claimed in claim 1;

wherein:

the engagement for which the engageable surface is configured includes a sealing engagement to the wellbore surface.

7. The wellbore completion apparatus as claimed in claim 1;

wherein:

in the engagement state, the apparatus further defines a seat, and the seat is co-operatively configured with a wellbore obstruction device with effect that seating of the wellbore obstruction device on the seat effects occluding of a flow communicator defined by the apparatus.

8. The wellbore completion apparatus as claimed in claim 7;

wherein:

the engagement for which the engageable surface is configured includes a sealing engagement to the wellbore surface; and the apparatus, the wellbore surface, and the wellbore obstruction device are co-operatively configured such that, while the apparatus is disposed within the wellbore in the engagement state such that the sealing engagement between the engageable surface and the wellbore surface is established and the seat is defined, and the wellbore obstruction device is seated on the seat, flow communication, across the apparatus, is sealed.

9. A wellbore completion apparatus configured for deployment through a passage defined within a wellbore, comprising:

an engager defining an engageable surface for engaging a wellbore surface of the wellbore;

wherein:

the apparatus is configurable in at least an engagement-ready state and an engagement state;

in the engagement-ready state:

the engager includes a first free end and a second free end; and the first free end is displaceable relative to the second free end;

the apparatus is transitionable from the engagement-ready state to the engagement state in response to relative displacement between the first free end and the second free end;

in response to the transitioning, at least a portion of the engageable surface becomes displaced outwardly relative to the central axis of the apparatus;

and the engageable surface is a band; and in the engagement state, the band has a minimum height of at least 0.25 inches.

10. The wellbore completion apparatus as claimed in claim 9;

wherein:

the passage is a casing.

11. The wellbore completion apparatus as claimed in claim 9;

wherein:

the wellbore surface is a wellbore surface-defined loop.

12. The wellbore completion apparatus as claimed in claim 9;

wherein:

the engagement for which the engageable surface is configured includes a gripping engagement to the wellbore surface; and the gripping engagement is with effect that displacement of the apparatus, relative to the wellbore surface, in a direction that is perpendicular to an axis that is normal to the engageable surface, is resisted.

13. The wellbore completion apparatus as claimed in claim 12;

wherein:

the resisted displacement includes displacement which is urged by a force, of at least 1000 pound-force, applied in a direction that is parallel to the central longitudinal axis of the wellbore.

14. The wellbore completion apparatus as claimed in claim 9;

wherein:

the engagement for which the engageable surface is configured includes a sealing engagement to the wellbore surface.

15. The wellbore completion apparatus as claimed in claim 9;

wherein:

in the engagement state, the apparatus further defines a seat, and the seat is co-operatively configured with a wellbore obstruction device with effect that seating of the wellbore obstruction device on the seat effects occluding of a flow communicator defined by the apparatus.

16. The wellbore completion apparatus as claimed in claim 15;

wherein:

the engagement for which the engageable surface is configured includes a sealing engagement to the wellbore surface; and the apparatus, the wellbore surface, and the wellbore obstruction device are co-operatively configured such that, while the apparatus is disposed within the wellbore in the engagement state such that the sealing engagement between the engageable surface and the wellbore surface is established and the seat is defined, and the wellbore obstruction device is seated on the seat, flow communication, across the apparatus, is sealed.

17. A wellbore completion apparatus for disposition within a passage defined within a wellbore, comprising:

an engager defining an engageable surface for engaging a wellbore surface of the wellbore;

wherein:

the engageable surface and the wellbore surface are co-operatively configured such that the engagement includes a sealing engagement of the engageable surface to the wellbore surface;

the apparatus is configurable in at least an engagement-ready state and an engagement state;

in the engagement-ready state:

the engager includes a first free end and a second free end;

the first free end is displaceable relative to the second free end; and while the apparatus is disposed within the wellbore, the engageable surface is spaced apart from the wellbore surface;

in the engagement state:

a seat is defined and co-operatively configured with a wellbore obstruction device with effect that seating of the wellbore obstruction device on the seat effects occluding of a flow communicator defined by the apparatus; and while the apparatus is disposed within the wellbore, and the wellbore obstruction device is seated on the seat, the engageable surface is engaged to the wellbore surface such that the sealing engagement of the engageable surface to the wellbore surface is established and the occluding of the flow communicator is established, and the sealing engagement and the occluding are co-operating with effect that flow communication, across the apparatus, is sealed;

and the apparatus is transitionable from the engagement-ready state to the engagement state in response to relative displacement between the first free end and the second free end.

18. The wellbore completion apparatus as claimed in claim 17;

wherein:

the engageable surface is a band; and in the engagement state, the band has a minimum height of at least 0.25 inches.

19. The wellbore completion apparatus as claimed in claim 17;

wherein:

in the engagement state, the engageable surface is defined by an engageable surface-defining loop.

20. The wellbore completion apparatus as claimed in claim 17;

wherein:

the engagement for which the engageable surface is configured includes a gripping engagement to the wellbore surface; and the gripping engagement is with effect that displacement of the apparatus, relative to the wellbore surface, in a direction that is perpendicular to an axis that is normal to the engageable surface, is resisted.

21. The wellbore completion apparatus as claimed in claim 20;

wherein:

the resisted displacement includes displacement which is urged by a force, of at least 1000 pound-force, applied in a direction that is parallel to the central longitudinal axis of the wellbore.

22. The wellbore completion apparatus as claimed in claim 20;

wherein:

the resisted displacement includes displacement which is urged in response to an applied pressure of at least 100 psi.

23. A wellbore completion apparatus configured for deployment through a passage defined within a wellbore, comprising:

an engager;

wherein:

the apparatus is configurable in at least an engagement-ready state and an engagement state;

in the engagement-ready state:

the engager includes a first free end and a second free end;

the first free end is displaceable relative to the second free end;

in the engagement state:

the engager defines an engageable surface-defining loop; and the engageable surface-defining loop defines an engageable surface for engaging a wellbore surface of the wellbore;

the apparatus is transitionable from the engagement-ready state to the engagement state in response to relative displacement between the first free end and the second free end;

the engagement for which the engageable surface is configured includes a gripping engagement to the wellbore surface;

the gripping engagement is with effect that displacement of the apparatus, relative to the wellbore surface, in a direction that is perpendicular to an axis that is normal to the engageable surface, is resisted; and the resisted displacement includes displacement which is urged by a force, of at least 1000 pound-force, applied in a direction that is parallel to the central longitudinal axis of the wellbore.

24. The wellbore completion apparatus as claimed in claim 23;

wherein:

in the engagement state, the apparatus further defines a seat, and the seat is co-operatively configured with a wellbore obstruction device with effect that seating of the wellbore obstruction device on the seat effects occluding of a flow communicator defined by the apparatus.

25. A wellbore completion apparatus configured for deployment through a passage defined within a wellbore, comprising:

an engager;

wherein:

the apparatus is configurable in at least an engagement-ready state and an engagement state;

in the engagement-ready state:

the engager includes a first free end and a second free end;

the first free end is displaceable relative to the second free end;

in the engagement state:

the engager defines an engageable surface-defining loop; and the engageable surface-defining loop defines an engageable surface for engaging a wellbore surface of the wellbore;

the apparatus is transitionable from the engagement-ready state to the engagement state in response to relative displacement between the first free end and the second free end; and in the engagement state, the apparatus further defines a seat, and the seat is co-operatively configured with a wellbore obstruction device with effect that seating of the wellbore obstruction device on the seat effects occluding of a flow communicator defined by the apparatus.

26. The wellbore completion apparatus as claimed in claim 25;

wherein:

the engagement for which the engageable surface is configured includes a sealing engagement to the wellbore surface; and the apparatus, the wellbore surface, and the wellbore obstruction device are co-operatively configured such that, while the apparatus is disposed within the wellbore in the engagement state such that the sealing engagement between the engageable surface and the wellbore surface is established and the seat is defined, and the wellbore obstruction device is seated on the seat, flow communication, across the apparatus, is sealed.

27. A wellbore completion apparatus configured for deployment through a passage defined within a wellbore, comprising:

an engager defining an engageable surface for engaging a wellbore surface of the wellbore;

wherein:

the apparatus is configurable in at least an engagement-ready state and an engagement state;

in the engagement-ready state:

the engager includes a first free end and a second free end; and the first free end is displaceable relative to the second free end;

the apparatus is transitionable from the engagement-ready state to the engagement state in response to relative displacement between the first free end and the second free end;

in response to the transitioning, at least a portion of the engageable surface becomes displaced outwardly relative to the central axis of the apparatus;

the engagement for which the engageable surface is configured includes a gripping engagement to the wellbore surface;

the gripping engagement is with effect that displacement of the apparatus, relative to the wellbore surface, in a direction that is perpendicular to an axis that is normal to the engageable surface, is resisted; and the resisted displacement includes displacement which is urged by a force, of at least 1000 pound-force, applied in a direction that is parallel to the central longitudinal axis of the wellbore.

28. The wellbore completion apparatus as claimed in claim 27;

wherein:

in the engagement state, the apparatus further defines a seat, and the seat is co-operatively configured with a wellbore obstruction device with effect that seating of the wellbore obstruction device on the seat effects occluding of a flow communicator defined by the apparatus.

* * * * *